US010768571B2

(12) United States Patent
Ishida

(10) Patent No.: US 10,768,571 B2
(45) Date of Patent: Sep. 8, 2020

(54) LOCK CONTROL DEVICE, IMAGE FORMING APPARATUS, LOCK CONTROL METHOD, AND LOCK SYSTEM

(71) Applicant: Masahiro Ishida, Kanagawa (JP)

(72) Inventor: Masahiro Ishida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/548,201

(22) Filed: Aug. 22, 2019

(65) Prior Publication Data

US 2020/0073320 A1 Mar. 5, 2020

(30) Foreign Application Priority Data

Sep. 5, 2018 (JP) ..... 2018-166302
Feb. 28, 2019 (JP) ..... 2019-035082

(51) Int. Cl.
*G03G 21/16* (2006.01)
*E05B 47/00* (2006.01)

(52) U.S. Cl.
CPC ..... *G03G 21/1647* (2013.01); *E05B 47/00* (2013.01); *E05B 47/0004* (2013.01); *E05B 2047/0048* (2013.01)

(58) Field of Classification Search
None
See application file for complete search history.

(56) References Cited

U.S. PATENT DOCUMENTS

2006/0104682 A1* 5/2006 Shimazawa ..... G03G 21/04 399/366
2010/0272452 A1* 10/2010 Tsukijima ..... G03G 15/553 399/27
2019/0196396 A1 6/2019 Yoshioka et al.

FOREIGN PATENT DOCUMENTS

| | | |
|---|---|---|
| JP | 7-197719 | 8/1995 |
| JP | 8-232519 | 9/1996 |
| JP | 8-246726 | 9/1996 |
| JP | 8-312215 | 11/1996 |
| JP | 2002-285746 | 10/2002 |
| JP | 2003-090160 | 3/2003 |
| JP | 2003-135565 | 5/2003 |
| JP | 2004-107883 | 4/2004 |
| JP | 2006-328757 | 12/2006 |
| JP | 2009-185451 | 8/2009 |
| JP | 2009-235800 | 10/2009 |
| JP | 2010-273094 | 12/2010 |
| JP | 2012-092646 | 5/2012 |
| JP | 2018-005198 | 1/2018 |
| JP | 2019-117887 | 7/2019 |

* cited by examiner

*Primary Examiner* — Roy Y Yi
(74) *Attorney, Agent, or Firm* — Harness, Dickey & Pierce, P.L.C.

(57) ABSTRACT

A lock control device is configured to control a plurality of lock devices respectively provided in a plurality of storage sections. The lock control device includes control circuitry. The control circuitry is configured to: cause an indicator to indicate a plurality of pieces of storage section information representing the plurality of storage sections; receive an input of partial storage section information of the plurality of pieces of storage section information; and output an unlocking signal to a lock device of the plurality of lock devices corresponding to the partial storage section information, to unlock the lock device.

9 Claims, 34 Drawing Sheets

LOCK CONTROL DEVICE, IMAGE FORMING APPARATUS, LOCK CONTROL METHOD, AND LOCK SYSTEM

CROSS-REFERENCE TO RELATED APPLICATIONS

This patent application is based on and claims priority pursuant to 35 U.S.C. § 119(a) to Japanese Patent Application Nos. 2018-166302, filed on Sep. 5, 2018, and 2019-035082, filed on Feb. 28, 2019, in the Japan Patent Office, the entire disclosure of each of which is hereby incorporated by reference herein.

BACKGROUND

Technical Field

Aspects of the present disclosure relate to a lock control device, an image forming apparatus, a lock control method, and a lock system.

Related Art

An image forming apparatus is known that includes a controller to control a sheet, which is ejected by executing a job with another image forming apparatus, so as to be ejected in a sheet ejection section that can be locked.

A remote control key is known that includes: a lock button to be operated when a lock operation of a licensed cabinet is performed; an unlock button to be operated when an unlock operation of the licensed cabinet is performed; and an all-lock button to be operated when a lock operation of all cabinets is performed.

An unlock and lock device for electronic lock is known, with which all of electronic lock units that store the same authentication information are unlocked and locked by providing a communication control unit capable of mutual communication and an electronic lock unit in each of multiple arranged electronic equipment storage cabinets and by manually entering the authentication information in any one of the electronic lock units.

SUMMARY

In an aspect of the present disclosure, there is provided a lock control device configured to control a plurality of lock devices respectively provided in a plurality of storage sections. The lock control device includes control circuitry. The control circuitry is configured to: cause an indicator to indicate a plurality of pieces of storage section information representing the plurality of storage sections; receive an input of partial storage section information of the plurality of pieces of storage section information; and output an unlocking signal to a lock device of the plurality of lock devices corresponding to the partial storage section information, to unlock the lock device.

In another aspect of the present disclosure, there is provided an image forming apparatus including an image forming section configured to form an image on a target and the lock control device.

In still another aspect of the present disclosure, there is provided a lock control method for controlling a plurality of lock devices respectively provided in a plurality of storage sections. The lock control method includes causing an indicator to indicate a plurality of pieces of storage section information representing the plurality of storage sections; receiving an input of partial storage section information of the plurality of pieces of storage section information; and outputting an unlocking signal to a lock device of the plurality of lock devices corresponding to the partial storage section information, to unlock the lock device.

In still yet another aspect of the present disclosure, there is provided a lock system that includes a plurality of storage sections and an image forming apparatus. The plurality of storage sections includes a plurality of lock devices, respectively. The image forming apparatus is configured to form an image on a target. The image forming apparatus includes an indicator and control circuitry. The control circuitry is configured to cause the indicator to indicate a plurality of pieces of storage section information representing the plurality of storage sections; receive an input of partial storage section information of the plurality of pieces of storage section information; and output an unlocking signal to a lock device of the plurality of lock devices corresponding to the partial storage section information, to unlock the lock device.

In still yet another aspect of the present disclosure, there is provided an image forming apparatus configured to form an image. The image forming apparatus includes an operating device and control circuitry. The operating device is configured to receive a user operation. The control circuitry is configured to perform locking control and unlocking control on a lock device of an external apparatus, based on the user operation received by the operating device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
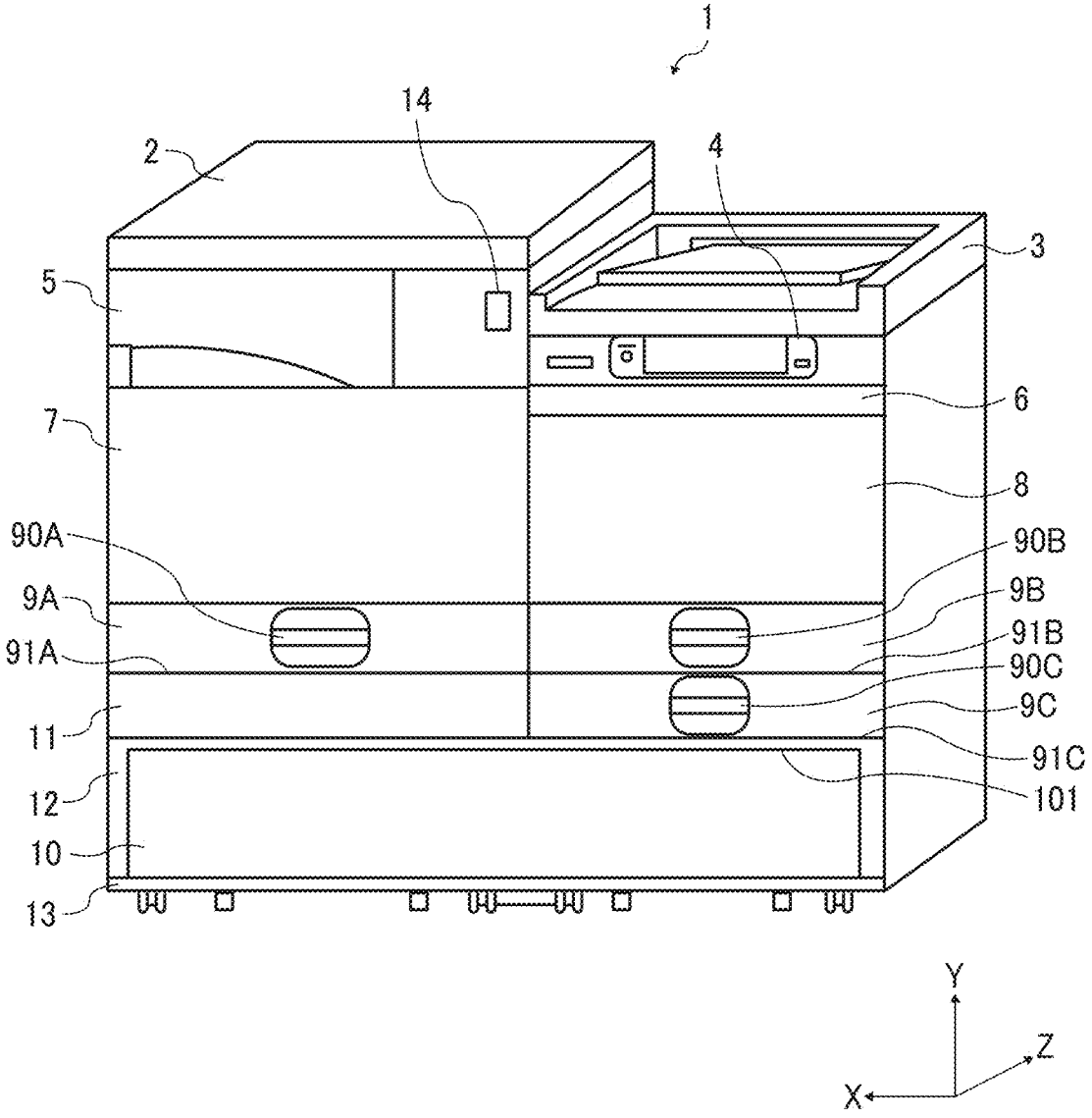
FIG. 1 is a perspective view of an image forming apparatus according to one embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present invention will be described based on the attached drawings. In each of the drawings for explaining the embodiments of the present invention, members, constituent elements of components, and the like, which have the same function or shape, are described once by attaching the same reference numerals as much as possible, and after that its description will be omitted.

FIG. 1 is a perspective view of an image forming apparatus according to one embodiment of the present invention.

An image forming apparatus 1 is an information processing apparatus that processes various information to execute various functions including, as an example, a copy function, a printer function, a scanner function, and a facsimile function, and it may be referred to as MFP (Multi-Function Printer/Peripheral/Product), but it is not limited to this.

The image forming apparatus 1 includes: a scanner 2 as an example of a reading device that reads an image of a manuscript; an auto document feeder 3 that feeds a manuscript to read an image of the fed manuscript; an operation panel 4 that receives an operation input to the image forming apparatus 1; a sheet ejection section 5 in which a sheet on which an image has been formed is ejected; a document table 6 on which a manuscript, a sheet, and the like are placed; an image forming section 7 that forms an image on a recording medium such as a sheet; a jam handling section 8 that handles paper jam of the sheets created in the image forming section 7, sheet trays 9A, 9B, and 9C in each of which sheets to be fed to the image forming section 7 are stacked; an opening 10 formed in a lower portion of the image forming apparatus 1; a storage section 11; an exterior 12 that covers an internal configuration of the image forming apparatus 1; a bottom plate 13; and a card reader 14.

Hereinafter, a user performs an operation in front of the image forming apparatus 1 of each view. When a user operates the image forming apparatus 1, a face of the image forming apparatus 1 that the user faces is referred to as a front face of the image forming apparatus 1. An X-axis direction illustrated in FIG. 1 is a width direction of the image forming apparatus 1, a Y-axis direction is a height direction of the image forming apparatus 1, and a Z-axis direction is a depth direction of the image forming apparatus 1.

The operation panel 4, an operating device, receives various inputs in accordance with operations by users, and displays various information (e.g., information indicating a received operation, information indicating an operating state of the image forming apparatus 1, and information indicating a setting state of the image forming apparatus 1). The operation panel 4 is configured with a liquid crystal display (LCD) loaded with, as an example, a touch panel function, but it is not limited to this. For example, the operation panel 4 may be configured with an organic electro-luminescence (EL) display device loaded with a touch panel function. In addition to or instead of this, an operating device such as a hardware key, or an indicator such as a lamp may be provided.

An upper portion of the sheet ejection section 5 is covered with part of the image forming apparatuses 1, as an example, with the scanner 2 in FIG. 1. The sheet ejection section 5 is provided within the dimension in the width direction of the image forming apparatus 1, whereby space-saving in the width direction of the image forming apparatus 1 can be achieved.

The sheet trays 9A, 9B, and 9C include handles 90A, 90B, and 90C for pulling out the sheet trays 9A, 9B, and 9C, respectively. A user can pull out at least part of each of the sheet trays 9A, 9B, and 9C from the inside of the image forming apparatus 1 by pulling each of the handles 90A, 90B, and 90C in the front face direction of the image forming apparatus 1 from a state where each of the sheet trays is housed inside the image forming apparatus 1.

The opening 10 has an opening upper end 101 that is an upper end of the opening 10. In FIG. 1, the opening 10 is opened toward the front face of the image forming apparatus 1, so that a wheelchair user can approach the image forming apparatus 1 to operate it, without colliding with the lower portion of the image forming apparatus 1. The opening 10 is provided, as an example, as part of the exterior 12 in FIG. 1, and it can also be said that the opening upper end 101 is part of the exterior 12.

The storage section 11 has a space that a user can use for storage.

The exterior 12 has at least a front face, a side face, and a back face that cover the internal configuration of the image forming apparatus 1. In the example illustrated in FIG. 1, the front face, the side face, and the back face of the exterior 12 correspond to a front face, a side face, and a back face of the image forming apparatus 1, respectively, and the depth and the width of the image forming apparatus 1 are determined by a depth (a distance between the front face and the back face) and a width (a distance between both the side faces) of the exterior 12, respectively.

The bottom plate 13 is a bottom of the image forming apparatus 1. Further, the bottom plate 13 is configured as a bottom of the opening 10.

The card reader 14 reads user information from a card for authenticating a user who uses the image forming apparatus 1. As an example, when a user holds a contactless IC card using radio frequency identification (RFID) over the card reader 14, the card reader 14 reads the user information set in the contactless IC card in advance. As a result, the user information is input to the image forming apparatus 1.

Herein, a positional relationship between a plurality of the sheet trays 9A, 9B, and 9C and the opening 10 will be described. Assuming that bottoms of the sheet trays 9A, 9B, and 9C are a bottom 91A, a bottom 91B, and a bottom 91C, respectively, the bottom 91C is the lowest among the bottom 91A, the bottom 91B, and the bottom 91C. The upper end of the opening 10 is located below the bottom 91C of the sheet tray 9C that is a sheet tray whose bottom is the lowest among the three sheet trays 9A, 9B, and 9C. With such a configuration, an image forming apparatus that is easy to operate for users can be provided. As an example, operativity of the lowest sheet tray becomes good. Since the opening 10 is opened to the front face of the image forming apparatus 1, a wheelchair user, etc., can perform an operation of pulling out the sheet tray 9C, or the like, in a state close to the apparatus with a footrest put into the opening 10, whereby the operativity is good.

Next, a positional relationship among the plurality of the sheet trays 9A, 9B, and 9C will be described. The sheet tray 9C, as a first sheet tray that is a sheet tray whose bottom is the lowest among the plurality of the sheet trays, and the sheet tray 9A, as a second sheet tray, are arranged in parallel in the width direction, that is, in the X-axis direction in FIG. 1. With such a configuration, the operativity of the lowest sheet tray can be made good, and capacities of the plurality of the sheet trays can be secured. When the plurality of the sheet trays is arranged in parallel, there may or may not be a portion where the respective sheet trays overlap in the height direction of the image forming apparatus 1, that is, in the Y-axis direction in FIG. 1. As an example, the sheet tray 9A and the sheet tray 9C are arranged in parallel, in which there is not a portion where the sheet tray 9A and the sheet tray 9C overlap in the height direction of the image forming apparatus 1.

The positional relationship between the plurality of the sheet trays 9A, 9B, and 9C and the opening 10 will be further described. The sheet tray 9C, as the first sheet tray that is a sheet tray whose bottom is the lowest among the plurality of the sheet trays, and the sheet tray 9A, as the second sheet tray, are arranged in parallel, and the opening 10 is located below at least one of the sheet tray 9C that is the first sheet tray and the sheet tray 9A that is the second sheet tray. The opening 10 is located below the sheet tray 9C and the sheet tray 9A.

Further, the opening 10 is located below a portion between the sheet tray 9C and the sheet tray 9A. That is, the opening 10 is continuously formed from immediately below the sheet tray 9C to immediately below the sheet tray 9A. With such a configuration, a wheelchair user, etc., can easily operate both the first sheet tray and the second sheet tray, with the footrest put into the opening 10.

Herein, a configuration of the front face of the image forming apparatus 1 will be described. In FIG. 1, in a state where the sheet trays 9A, 9B, and 9C are housed inside the image forming apparatus 1, the front face of each sheet tray is almost the same plane as the front face of the exterior 12, as an example. That is, a portion of the exterior 12, which forms the opening 10, is almost the same plane also as the front face of each sheet tray in a state where the sheet trays 9A, 9B, and 9C are housed inside the image forming apparatus 1.

Maximum storage sizes of sheets that can be stored in both the sheet tray 9C, as the first sheet tray that is a sheet tray whose bottom is the lowest among the plurality of the sheet trays, and the sheet tray 9A, as the second sheet tray that is arranged parallel to the sheet tray 9C, may be different from each other. Also, maximum storage numbers of sheets that can be stored may be different from each other. By appropriately arranging, in relation to other members, sheet trays having storage sizes different from each other, that is, having widths different from each other in a left-right direction of the apparatus, or sheet trays having maximum storage numbers different from each other, that is, having widths different from each other in the height direction of the apparatus, flexibility in layout of the image forming apparatus 1 is increased. As an example, the maximum sizes/maximum storage numbers of the respective sheet trays are legal/500 with the sheet tray 9A, A4/100 with the sheet tray 9B, and A4/250 with the sheet tray 9C.

Figure 2A:
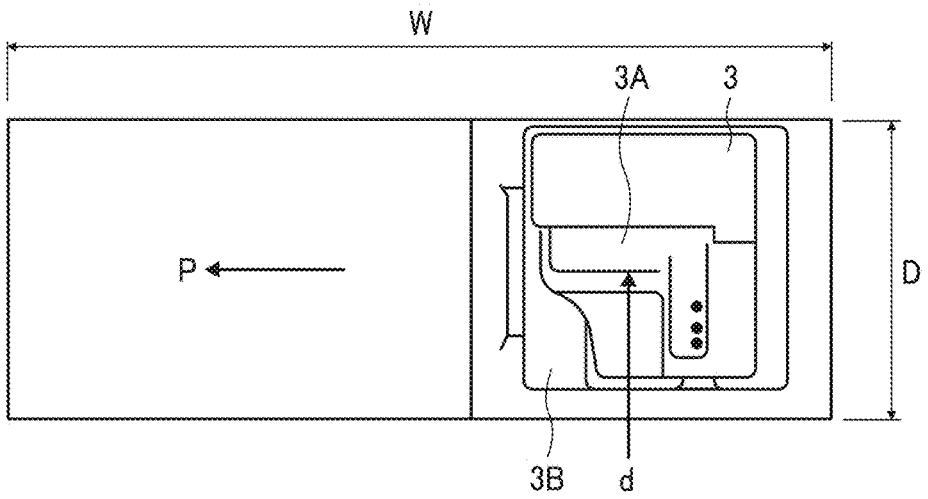
FIGS. 2A and 2B are a front view and a front view of the image forming apparatus according to one embodiment of the present invention.
Figure 2B:
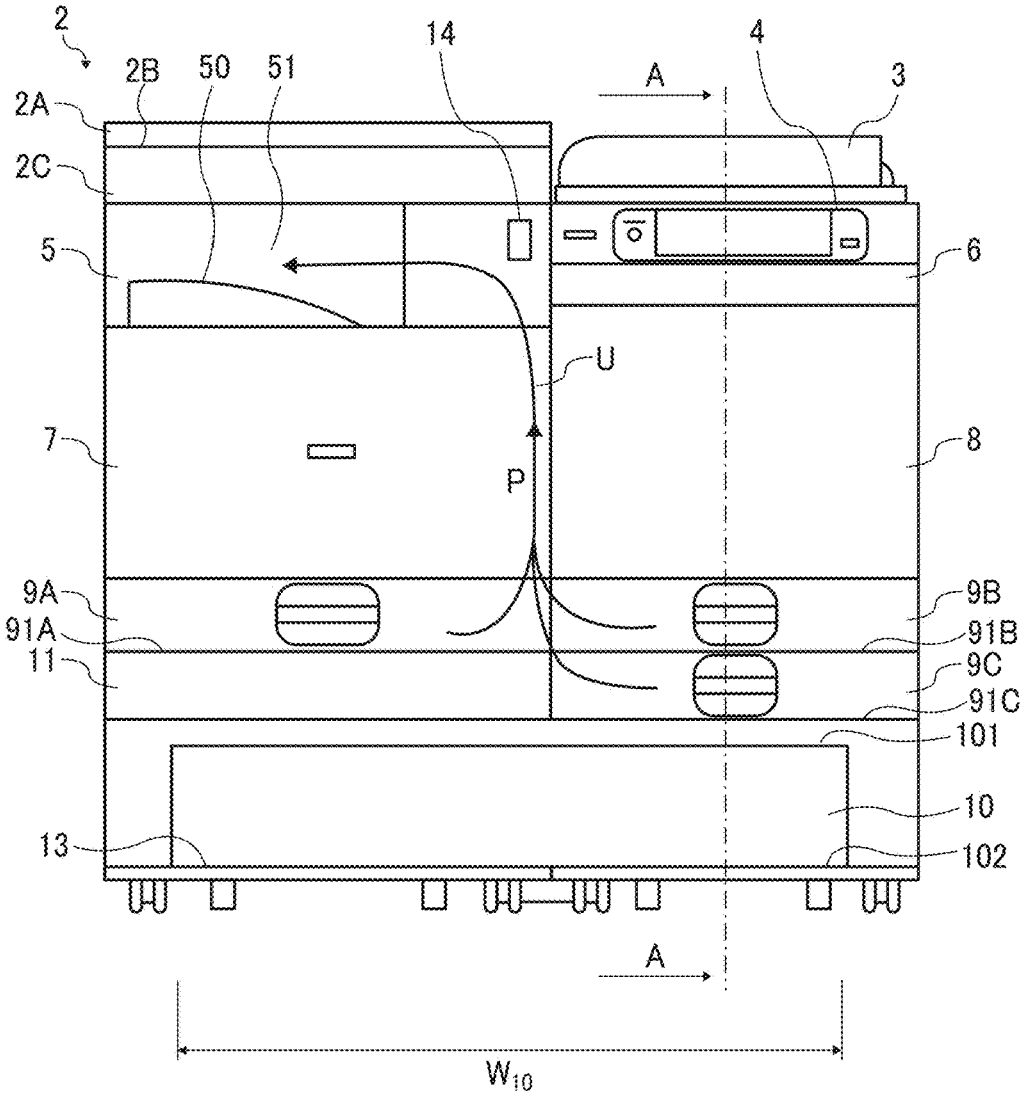

FIGS. 2A and 2B are a top view and a front view of the image forming apparatus according to one embodiment of the present invention.

FIG. 2A is a top view of the image forming apparatus 1. In FIG. 2A, W represents a size in the width direction of the image forming apparatus 1, and, as an example, W represents a distance between both the side faces of the exterior 12. D represents a size in the depth direction of the image forming apparatus 1, and, as an example, D represents a distance between the front face and the back face of the exterior 12. The auto document feeder 3 includes a manuscript stacking section 3A on which manuscripts are stacked, and a manuscript ejection section 3B in which the fed manuscript is ejected.

An arrow P represents a direction in which a sheet is fed when an image is to be formed and a sheet, on which an image has been formed, is ejected, and an arrow d represents a direction in which a manuscript is fed in the auto document feeder 3, in which the arrow P and the arrow d cross each other at right angles. That is, a manuscript feeding direction in which a manuscript is fed by the auto document feeder 3, and a sheet feeding direction in which a sheet, on which an image is to be formed, is fed, cross each other at right angles. With such a configuration, for example, when a long sheet is copied, an increase in the width of the image forming apparatus can be suppressed.

As an example, W is 900 mm or less. By determining in this way the width based on the size of office furniture, as an example, a cabinet that stores documents and the like, the image forming apparatus 1 does not protrude into a passage that originally exists, when the image forming apparatus 1 is installed in an office. For example, a passage for wheelchair users can be easily secured.

As an example, D is 450 mm or less. As an example, W is 900 mm or less. By determining in this way the width based on the size of office furniture, as an example, a cabinet that stores documents and the like, the image forming apparatus 1 does not protrude into a passage that originally exists, when the image forming apparatus 1 is installed in an office. For example, a passage for wheelchair users can be easily secured.

FIG. 2B is a front view of the image forming apparatus 1. In FIG. 2B, W10 represents a size in the width direction of the opening 10, and the arrow P represents the direction in which a sheet is fed and ejected. The image forming apparatus 1 includes the bottom plate 13 at the bottom. The bottom plate 13 is configured as the bottom of the opening 10, and an end of the bottom plate 13 on the side of the front face of the image forming apparatus 1 is configured as an opening lower end 102 that is a lower end of the opening 10. The image forming apparatus 1 also includes, in its inside, a feeding path U that is a sheet feeding section through which a sheet stored in the sheet tray 9A, 9B, or 9C is fed to the image forming section 7 and the sheet ejection section 5. The sheet stored in the sheet tray 9A, 9B, or 9C is fed through the feeding path U, and an image is formed when the sheet passes through the image forming section 7 from below to above.

The scanner 2 includes a pressure plate 2A that presses a manuscript, a reading section 2B on which a manuscript to be read is placed, and a scanner body 2C that reads an image of the manuscript placed on the reading section 2B. The sheet ejection section 5 includes a sheet stacking section 50 in which a sheet, on which an image has been formed, is stacked, and an outlet 51 from which a user removes a sheet on which an image has been formed. Since the outlet 51 is opened to the front face of the image forming apparatus 1, a wheelchair user can remove a sheet, on which an image has been formed, from the outlet 51 in a state closer to the image forming apparatus 1, with the footrest put in the opening 10.

The pressure plate 2A can be opened and closed to the reading section 2B. That is, the pressure plate 2A can take a closing position at which the plate covers an upper portion of the reading section 2B to close it, and an opening position at which the plate opens the upper portion of the reading section 2B. FIGS. 2A and 2B illustrate a case where the pressure plate 2A is at the closing position. A user places a manuscript on the reading section 2B in a state where the pressure plate 2A is moved to the opening position, and the user makes the scanner body 2C read the manuscript by moving the pressure plate 2A to the closing position. The pressure plate 2A applies pressure to a manuscript at the closing position, whereby a shift of the manuscript can be prevented. Further, the pressure plate 2A serves as a background plate at the closing position while a manuscript is being read, whereby good reading can be made.

The auto document feeder 3 can be opened and closed to the document table 6. That is, the auto document feeder 3 can take a closing position at which the feeder covers an upper portion of the document table 6 to close it, and an opening position at which the feeder opens the upper portion of the document table 6. FIGS. 2A and 2B illustrate a case where the auto document feeder 3 is at the closing position. A user places and removes a manuscript or a sheet on and from the document table 6 in a state where the auto document feeder 3 is moved to the opening position, and the user uses the auto document feeder 3 by moving the auto document feeder 3 to the closing position.

As an example, W10 is 600 mm or more. Or, W10 is more than or equal to a wheelchair seat width W1 determined in JIS-T9201. With such a configuration, the footrest of a wheelchair can be put in the opening 10, whereby it is easy for a wheelchair user to approach and operate the apparatus. For example, by setting the width of the image forming apparatus 1 to be within a range of 600 mm to 900 mm (inclusive), an opening, in which the footrest of a wheelchair is put, can be provided, and further, when installed in an office, the image forming apparatus 1 does not protrude into a passage that originally exists. In the embodiment of the image forming apparatus 1 described above, at least two of the sheet ejection section 5, the scanner 2, and the auto document feeder 3 are arranged in parallel so as to overlap each other in the height direction (Y-axis direction in FIG. 1). Further, two of the sheet ejection section 5, the scanner 2, and the auto document feeders 3 are stacked in the height direction, and a remaining one is arranged in parallel to a stacked section including the two stacked items so as to overlap the stacked section in the height direction. Thereby, the height of the image forming apparatus 1 including three of the sheet ejection section 5, the scanner 2, and the auto document feeder 3 is suppressed, so that the image forming apparatus 1 having good operativity for users is provided.

The two stacked items are stacked such that both ends in the width direction of one item are located at almost the same positions as both ends of the other item. Thereby, the widths of the two stacked items are suppressed, whereby the image forming apparatus 1 having good operativity for users is provided.

Specifically, the auto document feeder 3 and at least one of the sheet ejection section 5 and the scanner 2 are arranged in parallel so as to overlap each other in the height direction, and the sheet ejection section 5 and the scanner 2 are stacked to form the stacked section. In more detail, a top face of the stacked section including the sheet ejection section 5 and the scanner 2 is higher than a top face of the auto document feeder 3, and a lower face of the stacked section is lower than a lower face of the auto document feeder 3.

Figure 3:
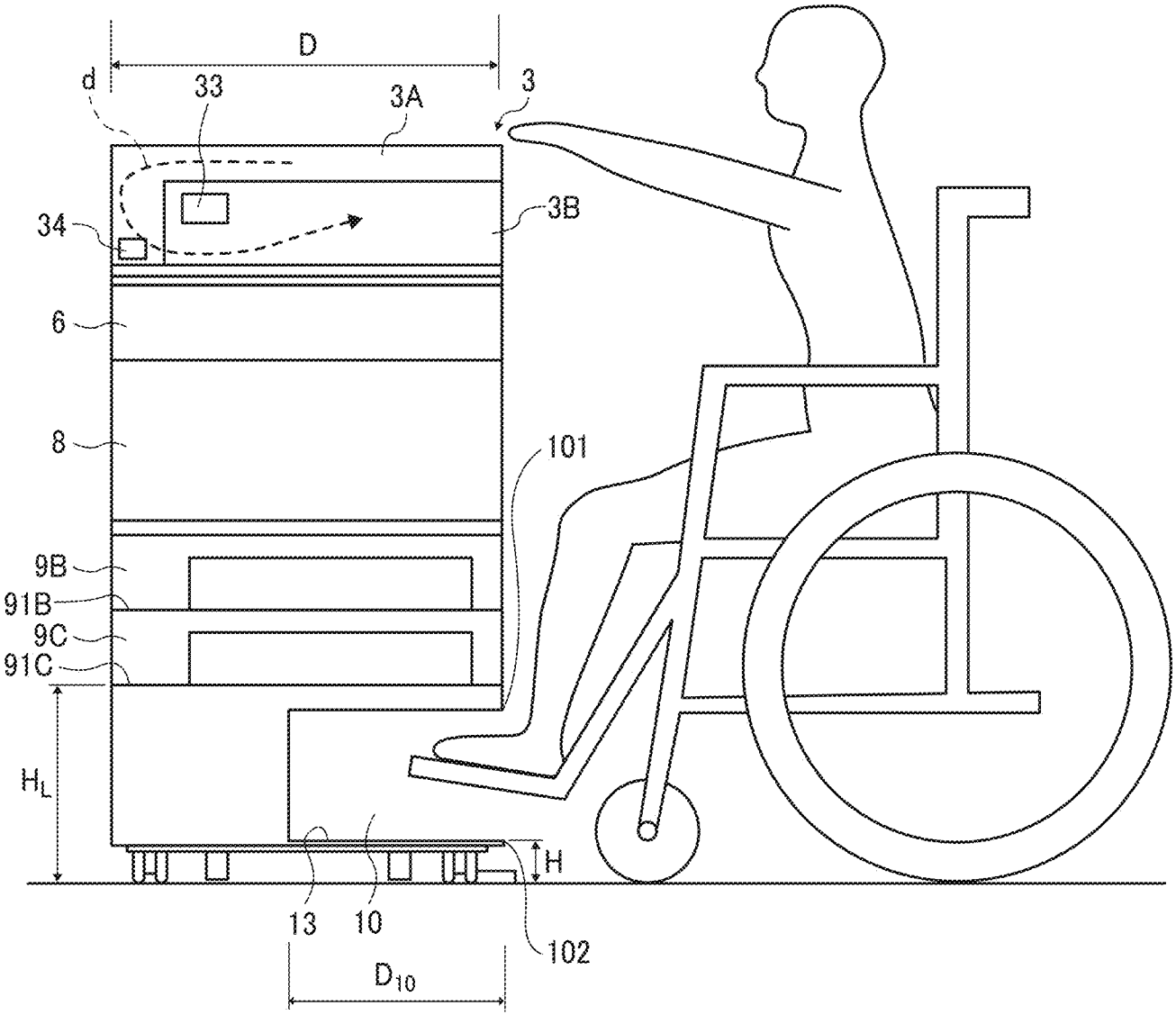
FIG. 3 is a cross-sectional view of the image forming apparatus according to one embodiment of the present invention.

FIG. 3 is a cross-sectional view of the image forming apparatus according to one embodiment of the present invention. FIG. 3 is a cross-sectional view of the embodiment illustrated in FIGS. 2A and 2B, taken along a line A-A. H is a height of the bottom plate 13 from a floor. It can also be said that H is a height of the opening lower end 102 from the floor. HL is a height to the bottom 91C of the sheet tray 9C, the bottom 91C being the lowest from the floor. D10 represents a size in the depth direction of the opening 10. The auto document feeder 3 includes a back face reading section 33 that reads an image of a back face of a manuscript to be fed (a lower face of the manuscript placed on the manuscript stacking section 3A), and a top face reading section 34 that reads an image of a top face of the manuscript to be fed (a top face of the manuscript placed on the manuscript stacking section 3A).

While a manuscript placed on the upper portion of the auto document feeder 3 by a user is being fed through a route indicated by the arrow d, an image of the back face of the manuscript is read when the manuscript passes through the back face reading section 33, and an image of the top face of the manuscript is read when the manuscript passes through the top face reading section 34. With such a configuration, images of both faces of a manuscript can be read while each manuscript is being fed in one direction one time. With such a configuration, a feeding route becomes short compared to a case where each manuscript is fed in two or more directions, whereby a paper jam occurrence rate in the auto document feeder 3 can be lowered and operativity can be improved. Such a configuration may be referred to as a single pass double-sided reading configuration.

Herein, as an example, H is lower than 50 mm that is a foot support height H7 of a wheelchair determined in JIS-T9201. D10 is more than or equal to a foot support length L5 of a wheelchair determined in JIS-T9201. With such a configuration, a wheelchair user can operate the image forming apparatus 1 at a position closer to the apparatus, without hitting the footrest on the image forming apparatus 1.

As an example, HL is 300 mm or more. With such a configuration, a wheelchair user can perform, for example, operations of opening and closing the sheet trays at a position closer to the image forming apparatus 1, without hitting the footrest on the image forming apparatus 1.

In the present embodiment described above, when the opening 10 is continuously formed from the lower portion of the first sheet tray 9A to the lower portion of the second sheet tray 9C, as illustrated also in FIG. 1, a wheelchair user can perform, at an almost central position of the image forming apparatus 1, various operations of the image forming apparatus 1 in a state where the footrest is put in the opening 10, as illustrated in FIG. 3.

Specifically, the operation panel 4, located at almost the center of the image forming apparatus 1, can be operated almost in front of the operation panel 4. Further, both the left and right sheet trays, aligned in the width direction to sandwich the feeding path U located near the center of the image forming apparatus 1, are within a reach and operable. Further, both the left and right sheet trays, aligned in the width direction to sandwich the feeding path U located near the center of the image forming apparatus 1, are within a reach and operable. Furthermore, the image forming section 7 and the jam handling section 8, aligned to sandwich the near center of the image forming apparatus 1, are both within a reach, and parts replacement processing on the image forming section 7 and paper jam handling in the jam handling section 8 can be performed. Still furthermore, the scanner 2 and the auto document feeder 3, aligned to sandwich the near center of the image forming apparatus 1, are both within a reach and operable.

Figure 4:
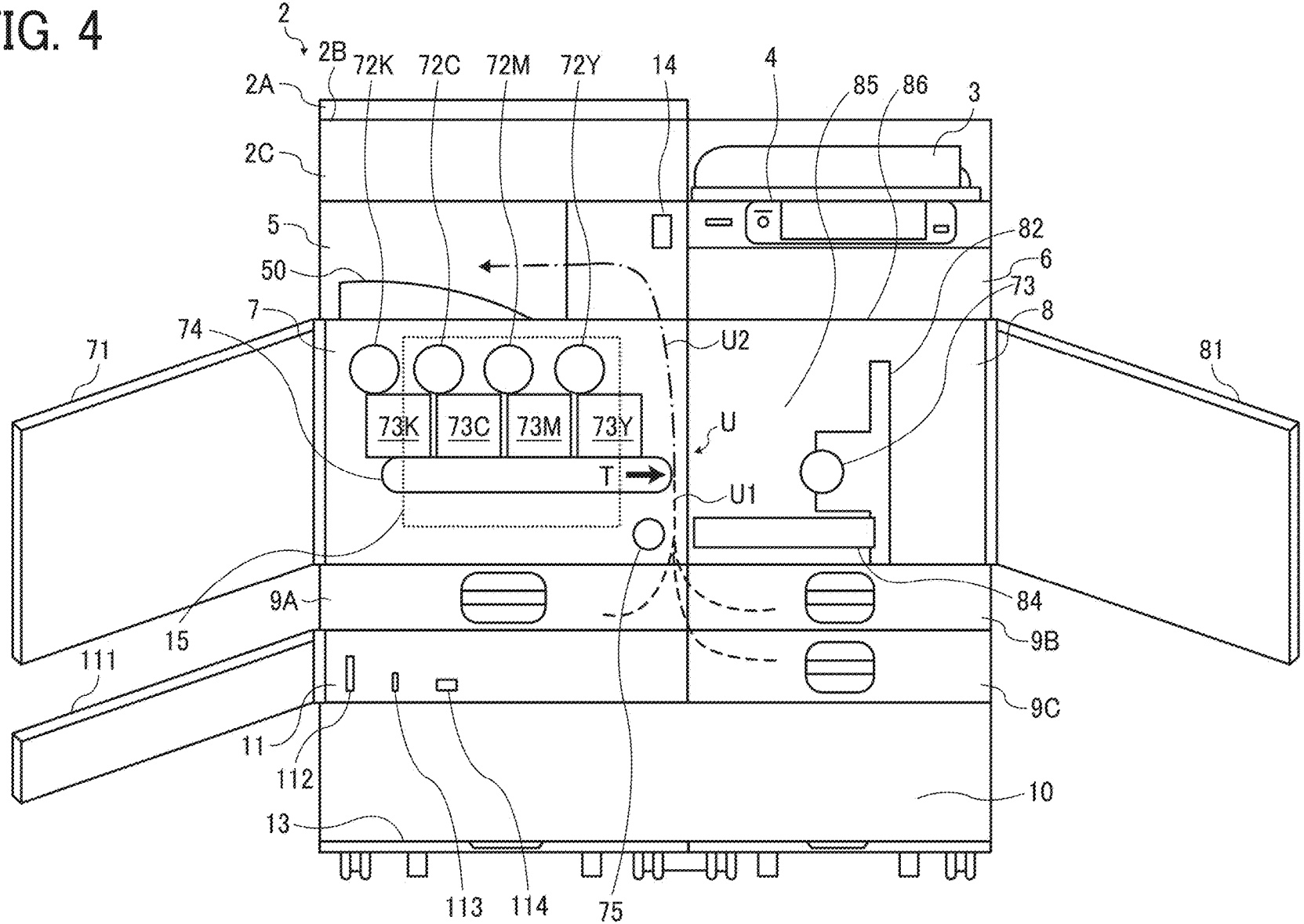
FIG. 4 is a front view illustrating an internal configuration of the image forming apparatus according to one embodiment of the present invention.

FIG. 4 is a front view illustrating the internal configuration of the image forming apparatus 1. The image forming apparatus 1 includes a control board 15, an opening and closing section 71 that opens an inside of the image forming section 7, an opening and closing section 81 that opens an inside of the jam handling section 8, and an opening and closing section 111 that opens an inside of the storage section 11.

The image forming section 7 includes, in its inside, toner bottles 72K, 72C, 72M, and 72Y that store toner of respective colors of black, cyan, magenta, and yellow, and image forming units 73K, 73C, 73M, and 73Y that form an image of respective colors of black, cyan, magenta, and yellow by using the toners supplied from the toner bottles 72K, 72C, 72M, and 72Y.

The image forming section 7 also include, in its inside, an intermediate transfer unit 74 that transfers the image of the respective colors formed by the image forming units 73K, 73C, 73M, and 73Y, a secondary transfer section 73 that secondarily transfers the image, which has been transferred by the intermediate transfer unit 74, to a sheet fed through the feeding path U, and a registration roller 75 that feeds a sheet to the secondary transfer section 73.

The jam handling section 8 includes a paper jam handling opening and closing cover 82 that is a feeding section cover for covering the feeding path U at least when an image is formed, a slide rail 84 that slides and moves the paper jam handling opening and closing cover 82, a paper jam handling space 85 that is a sheet removing space where paper jam handling, such as removal of a sheet from the feeding path U by a user, is performed, and a paper jam handling space opening 86 that opens the paper jam handling space 85 to the front face of the image forming apparatus 1.

The secondary transfer section 73 is attached to the paper jam handling opening and closing cover 82, and with the paper jam handling opening and closing cover 82 moving, the secondary transfer section 73 can move between a secondary transfer position, at which an image is secondarily transferred to a sheet, and an opening position at which the feeding path U is opened.

The storage section 11 is arranged to be parallel to the sheet tray 9C and overlap it in the height direction (Y-axis direction FIG. 1), and has, in its inside, a space that a user can use for storage. The storage section 11 further includes in its inside: a secure digital (SD) card slot 112 into which an SD card, a storage medium, can be inserted; a universal serial bus (USB) memory slot 113 into which a USB memory, a storage medium, can be inserted; and a local area network (LAN) cable coupling port 114 to which a LAN cable can be coupled. The SD card slot 112, the USB memory slot 113, and the LAN cable coupling port 114 are provided in the front face of the image forming apparatus 1. With such a configuration, a user, who is performing another operation in front of the image forming apparatus 1, can also operate the storage section 11, as the user is. When a user wants to increase the capacity of the sheets to be stored in the image forming apparatus 1, a further sheet tray may be provided in a place where the storage section 11 is arranged, instead of the storage section 11.

The control board 15 as control circuitry controls the whole image forming apparatus 1 based on the operations input from the operation panel 4, the card reader 14, and other external apparatuses. As an example, the control board is a control board on which: a central processing unit (CPU); a read only memory (ROM) and a hard disk drive (HDD)

that are storage media for storing programs and data necessary for the operation of the CPU; a random access memory (RAM) that is a work area when the CPU executes a program; a power supply circuit that controls power supply from a main power supply of the image forming apparatus 1 to, as an example, each device of the image forming apparatus; and the like, are provided.

Herein, how to form an image on a sheet by the image forming section 7 will be described with reference to FIG. 4. The feeding path U illustrated by solid lines in FIG. 2B includes a sheet feeding path U1 and an ejected sheet feeding path U2 that are illustrated by broken lines in FIG. 4. The sheet stored in the sheet tray 9A, 9B, or 9C is fed to the image forming section 7 through the sheet feeding path U1, and an image is formed. The sheet, on which the image has been formed, is fed through the ejected sheet feeding path U2 and ejected in the sheet ejection section 5.

The sheet feeding path U1 is provided to pass through, in the height direction, near both a gap in the width direction between the sheet tray 9A and the sheet tray 9C and a gap in the width direction between the sheet tray 9C and the sheet tray 9B. While a sheet is being fed in the height direction through the sheet feeding path U1, an image is provided to the sheet on the feeding path U on either the left or right side in the width direction. In FIG. 4, an image is provided to the sheet at a position indicated by an arrow T and from a direction indicated by the arrow T, i.e., from the left side in the width direction. The sheet, on which the image has been provided, is fed through the ejected sheet feeding path U2 and ejected in the sheet ejection section 5. As described with reference to FIG. 1, the sheet ejection section 5 is provided within the size in the width direction of the image forming apparatus 1, and in the present embodiment, after an image is formed, the ejected sheet feeding path U2 reaches the sheet ejection section 5, without passing through the outside of the image forming apparatus 1.

Herein, sheets are stored in the sheet trays 9A, 9B, and 9C such that both sides of a sheet are located up and down. As a result, in FIG. 4, an image is provided to a face that has been an upper face in the state of being stored in the sheet tray 9A, and an image is provided to a lower face that has been an opposite face in the state of being stored in the sheet tray 9B or the sheet tray 9C that are arranged in parallel to the sheet tray 9A.

An image may be provided from the right side of the feeding path U. In the case, an image is provided to a face that has been a lower face in the state of being stored in the sheet tray 9A, and an image is provided to an upper face that has been an opposite face in the state of being stored in the sheet tray 9B or the sheet tray 9C that are arranged in parallel to the sheet tray 9A.

Since the feeding path U is configured as described above, a face of a sheet stored in the first sheet tray, on which an image is to be formed by the image forming section, and a face of a sheet stored in the second sheet tray, on which an image is to be formed by the image forming section, are opposite to each other in the up-down direction in the state of being stored in the first sheet tray or the second sheet tray. With such a configuration, images can be formed efficiently within the width of the image forming apparatus 1.

Herein, paper jam handling will be described with reference to FIG. 4. The paper jam handling space 85 is arranged within the width dimension of the image forming apparatus 1. As an example, the paper jam handling space is arranged above any one of the plurality of the sheet trays. With such a configuration, an operation of the sheet trays and an operation for removing a sheet from the feeding path can be performed within the width dimension of the image forming apparatus 1. Further, the paper jam handling space 85 is arranged below the auto document feeder 3, and an operation of the sheet trays, an operation for removing a sheet from the feeding path, and an operation of the auto document feeder can be performed within the width dimension of the image forming apparatus 1.

The paper jam handling opening and closing cover 82, a feeding section cover, can move in the paper jam handling space 85. As an example, with moving from a closing position, at which the feeding path U is covered, to an opening position, at which the feeding path U is opened to the paper jam handling space 85, the paper jam handling opening and closing cover 82 can open and close the feeding path U to the paper jam handling space 85. With such a configuration, an operation of a sheet feeding tray and an operation for removing a sheet from the feeding path can be performed by opening the feeding section cover within the width dimension of the image forming apparatus 1.

The paper jam handling space 85 also includes a removing space opening 86 that is opened to the front face of the image forming apparatus 1. With such a configuration, a user, who is performing another operation in front of the image forming apparatus 1, can also perform paper jam handling.

The opening and closing section 81 can open and close the removing space opening 86 to the outside of the image forming apparatus 1. With such a configuration, the inside of the image forming apparatus 1 can be protected and the appearance of the image forming apparatus 1 can be improved by closing the removing space except when a sheet is removed from the feeding section.

In FIG. 4, description has been made by taking the image forming section 7 of a so-called full color electrophotographic method as an example, but the method of the image forming section 7 is not limited to this. For example, the image forming section 7 of a monochrome electrophotographic method, in which an image is formed with only black toner, may be adopted. Alternatively, the image forming section 7 of an inkjet method, in which an image is formed on the sheet fed from each sheet tray by an inkjet head, may be adopted. The recording medium, a target on which an image is to be formed, is not limited to a sheet, but roll paper and the like may be used.

Figure 5:
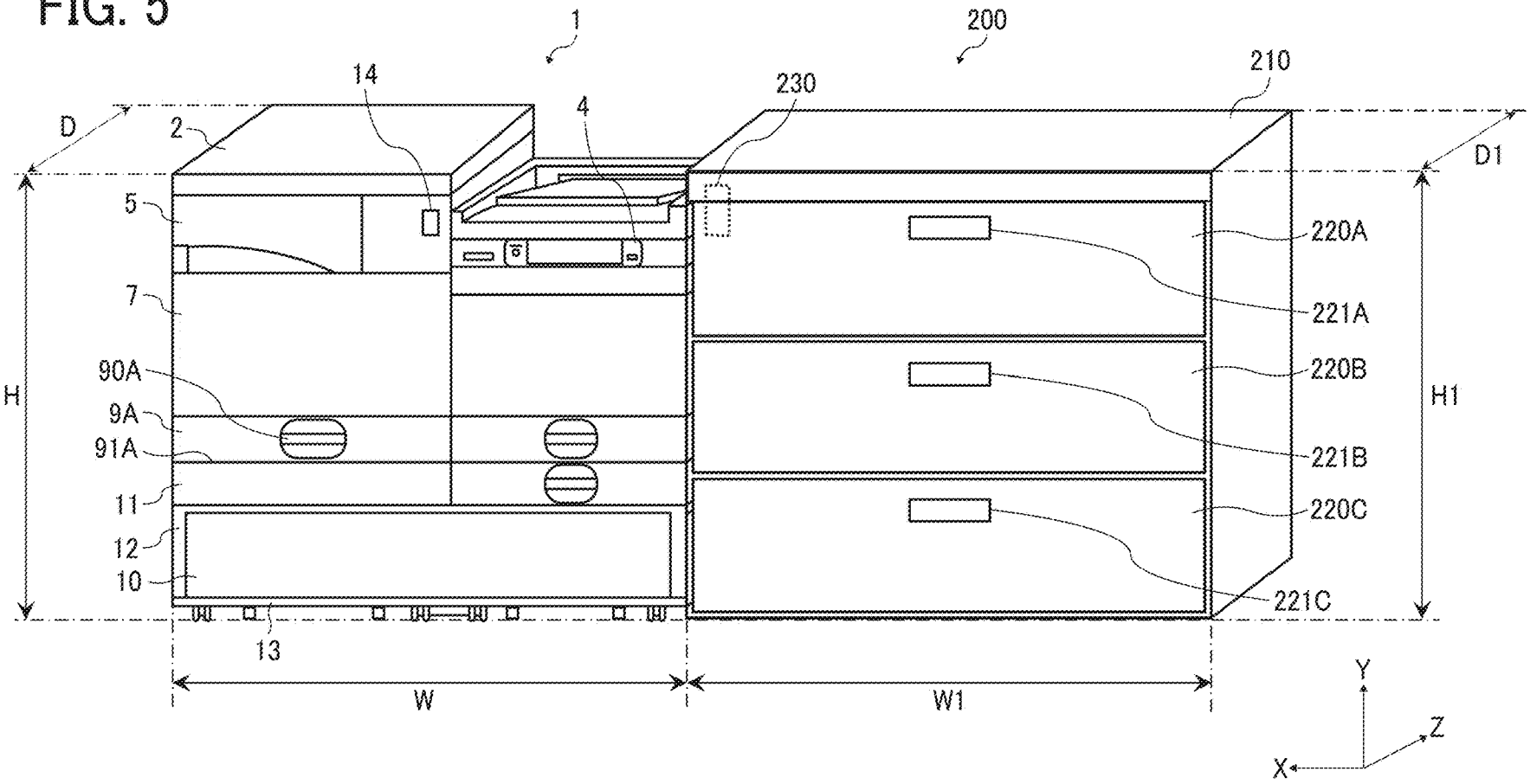
FIG. 5 is a perspective view illustrating a first example of a usage state of the image forming apparatus according to one embodiment of the present invention.

FIG. 5 is a perspective view illustrating a first example of a usage state of the image forming apparatus 1. As an example, the image forming apparatus 1 is used in a state of being installed next to a storage apparatus 200. The storage apparatus 200 includes an exterior 210, storage sections 220A, 220B, and 220C that are internal spaces in which articles can be stored, and a lock device 230. Examples of the articles include various documents, sheet bundles for replenishing a sheet tray with sheets when sheets run out in the sheet tray, replacement toner bottles, and the like, but they are not limited to these.

The storage sections 220A, 220B, and 220C include handles 221A, 221B, and 221C for pulling out the storage sections 220A, 220B, and 220C, respectively. By pulling the handles 221A, 221B, and 221C toward the front face of the storage apparatus 200 from a state where the storage sections 220A, 220B, and 220C are located inside the storage apparatus 200, a user can pull out at least part of the storage sections 220A, 220B, and 220C from the storage apparatus 200.

When the storage sections 220A, 220B, and 220C are located inside the storage apparatus 200, the storage spaces of the storage sections 220A, 220B, and 220C are covered with the storage sections 220A, 220B, and 220C or the exterior 210 of the storage apparatus 200 in the front-back direction (Z-axis direction), the up-down direction (Y-axis direction), and the left-right direction (X-axis direction), respectively. Therefore, in this state, the storage sections 220A, 220B, and 220C can hold the articles, stored in the respective storage spaces, so as not to be brought out and not to be seen. At this time, it is said that the storage sections 220A, 220B, and 220C are located at storage positions.

On the other hand, when a user removes an article located inside from the storage space, these storage sections 220A, 220B, and 220C are pulled out from the storage apparatus 200, respectively, whereby the storage spaces and the stored articles are brought into a state of being exposed. At this time, the storage sections 220A, 220B, and 220C are located at removal positions. The storage sections 220A, 220B, and 220C move between their respective storage positions and removal positions.

The lock device 230 locks the storage section 220A at the storage position such that the storage section 220A cannot move to the removal positions even if the handle 221A is pulled. When the lock device 230 is in an unlocked state, the storage section 220A can move to the removal position. As an example, the lock device 230 is an electronic lock (electric lock) that can be electrically operated. In FIG. 5, the lock device 230 is provided inside the storage apparatus 200 as an example, but the lock device is not limited to this. In FIG. 5, the lock device 230 is illustrated by dot lines in order to indicate that it is located inside the storage apparatus 200.

As illustrated in FIG. 5, the width W, a depth D, and a height H of the image forming apparatus 1 are almost the same as a width W1, a depth D1, and a height HI of the storage apparatus 200, respectively. When the height H of the image forming apparatus 1 is not constant in the width direction or the depth direction, a height of the highest portion of the image forming apparatus 1 is defined as the height H.

A configuration or an operation common among the storage sections 220A, 220B, and 220C may be described by denoting with a storage section 220. A configuration or an operation common among the handles 221A, 221B, and 221C may be described by denoting with a handle 221.

Figure 6:
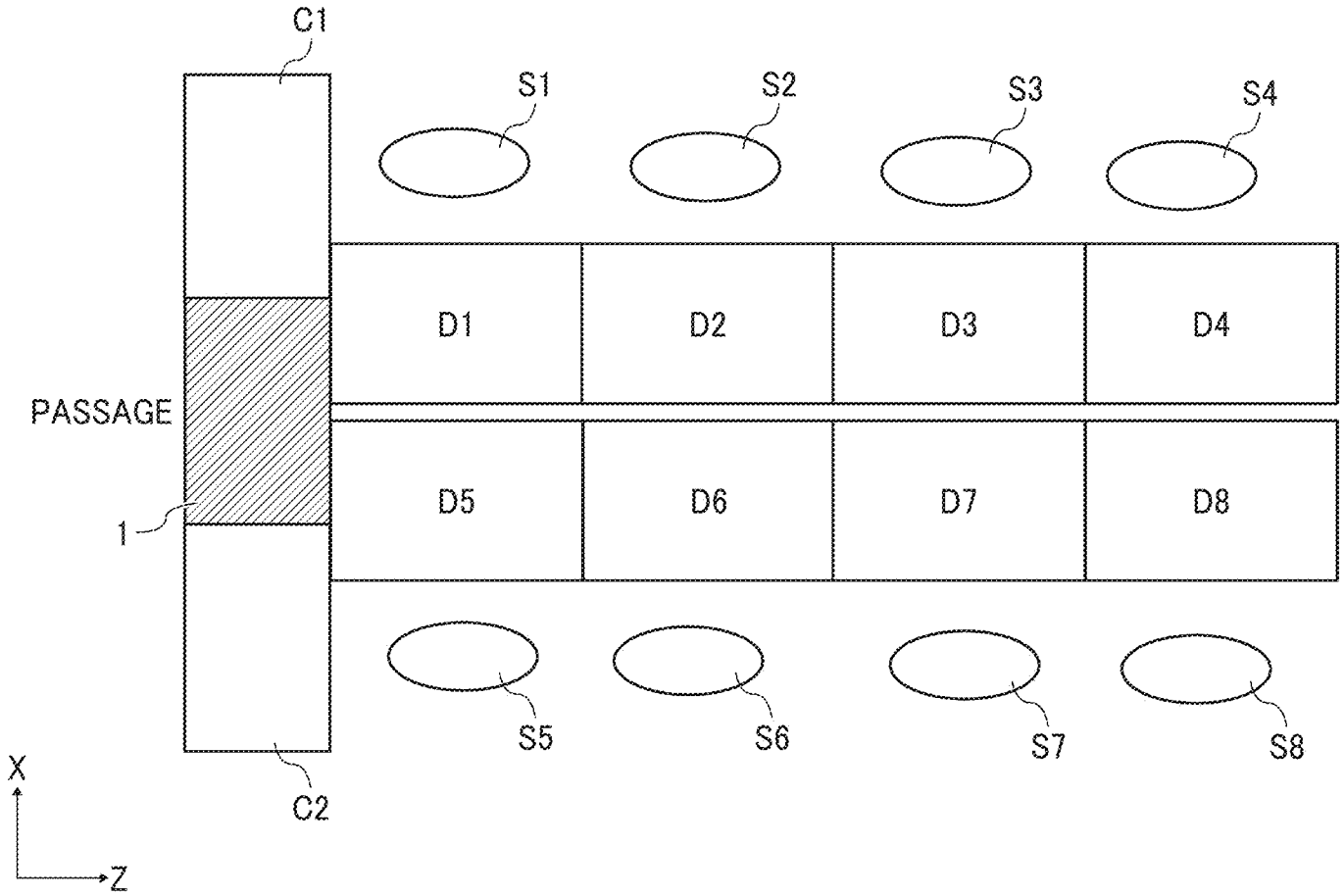
FIG. 6 is a view for explaining an advantage of the image forming apparatus according to one embodiment of the present invention.

The width and depth of the image forming apparatus 1 will be described with reference to FIG. 6. FIG. 6 is a top view illustrating a second example of the usage state of the image forming apparatus 1. In FIG. 6, D1 to D8 indicate office desks, S1 to S8 indicate office chairs, and C1 and C2 indicate the storage apparatuses 200 each of which is used as a cabinet in an office. The image forming apparatus 1 is installed between the cabinets C1 and C2 so as to be adjacent to each of the cabinets C1 and C2. In this case, when the depth D of the image forming apparatus 1 is less than or equal to the depth D1 of the storage apparatus 200, the image forming apparatus 1 does not hamper people from passing through, the hamper being caused when the apparatus protrudes into a passage, whereby the image forming apparatus 1 is easy to use in the office.

Further, when the depth D and the depth D1 are almost the same, as illustrated in, for example, FIG. 6, the office looks good, and it is easy for a user to operate both the image forming apparatus 1 and the storage apparatus 200 that are next to each other.

Furthermore, when the width W of the image forming apparatus 1 and the width W1 of the storage apparatus 200 are almost the same, as illustrated in, for example, FIG. 6, in an office where the cabinets are originally installed, the image forming apparatus 1 can be installed at the place where the cabinet was installed, without changing the layout.

Figure 7:
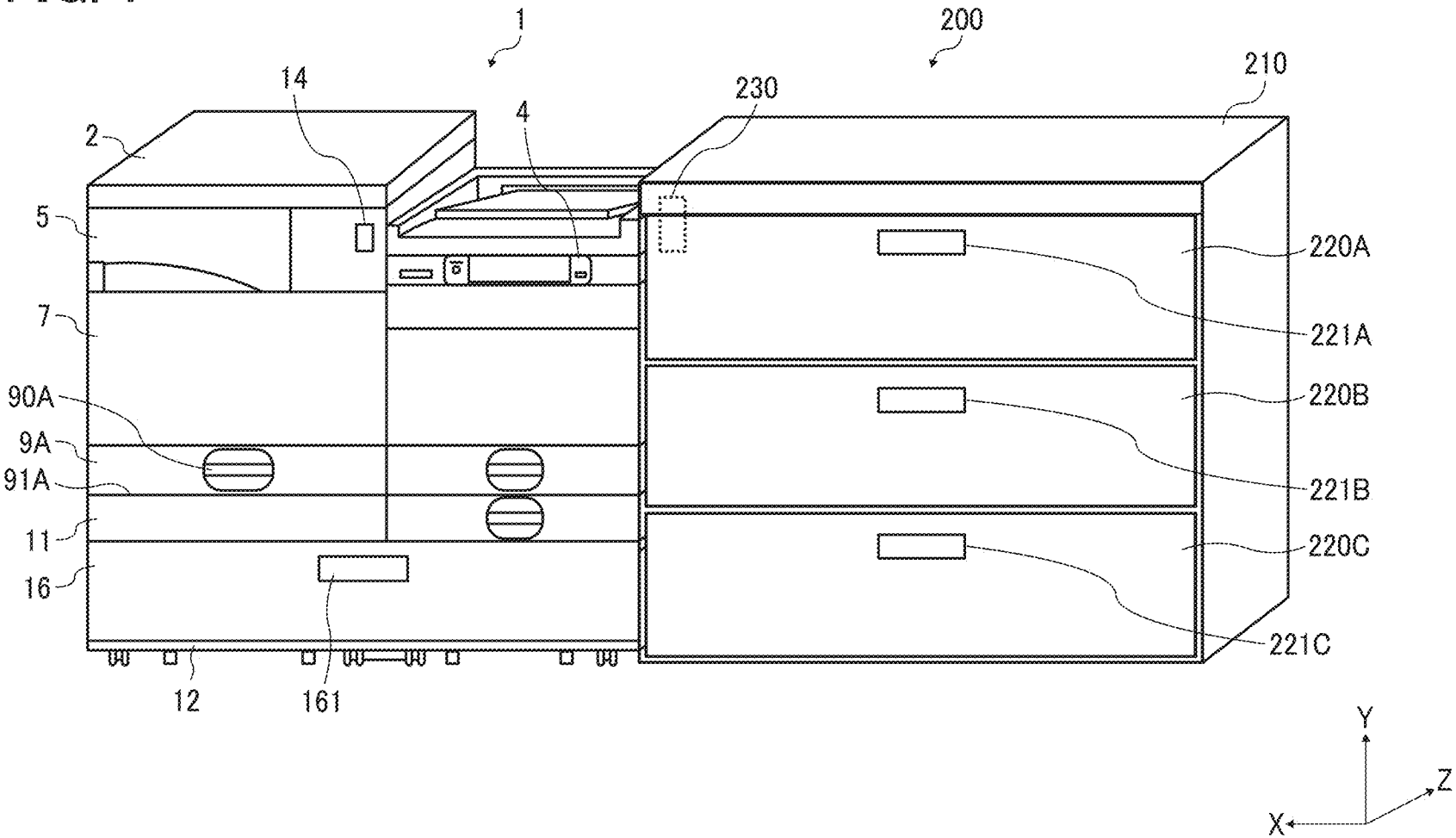
FIG. 7 is a perspective view illustrating a second example of the usage state of the image forming apparatus according to one embodiment of the present invention.

FIG. 7 illustrates a variation of the image forming apparatus 1. In the image forming apparatus 1 illustrated in FIG. 7, a storage section 16 is provided at the position of the opening 10 of the image forming apparatus 1 illustrated in FIG. 5. The storage section 16 includes a handle 161 for pulling out the storage section 16 from the image forming apparatus 1. As described above, part of the image forming apparatus 1 can be used for storage in accordance with a demand of a user for increasing storage.

In this case, the image forming apparatus 1 may include a lock device that locks such that the storage section 16 at a storage position cannot be moved to a removal position even if the handle 161 is pulled, in the same way in which the storage apparatus 200 includes the lock device 230.

Figure 8:
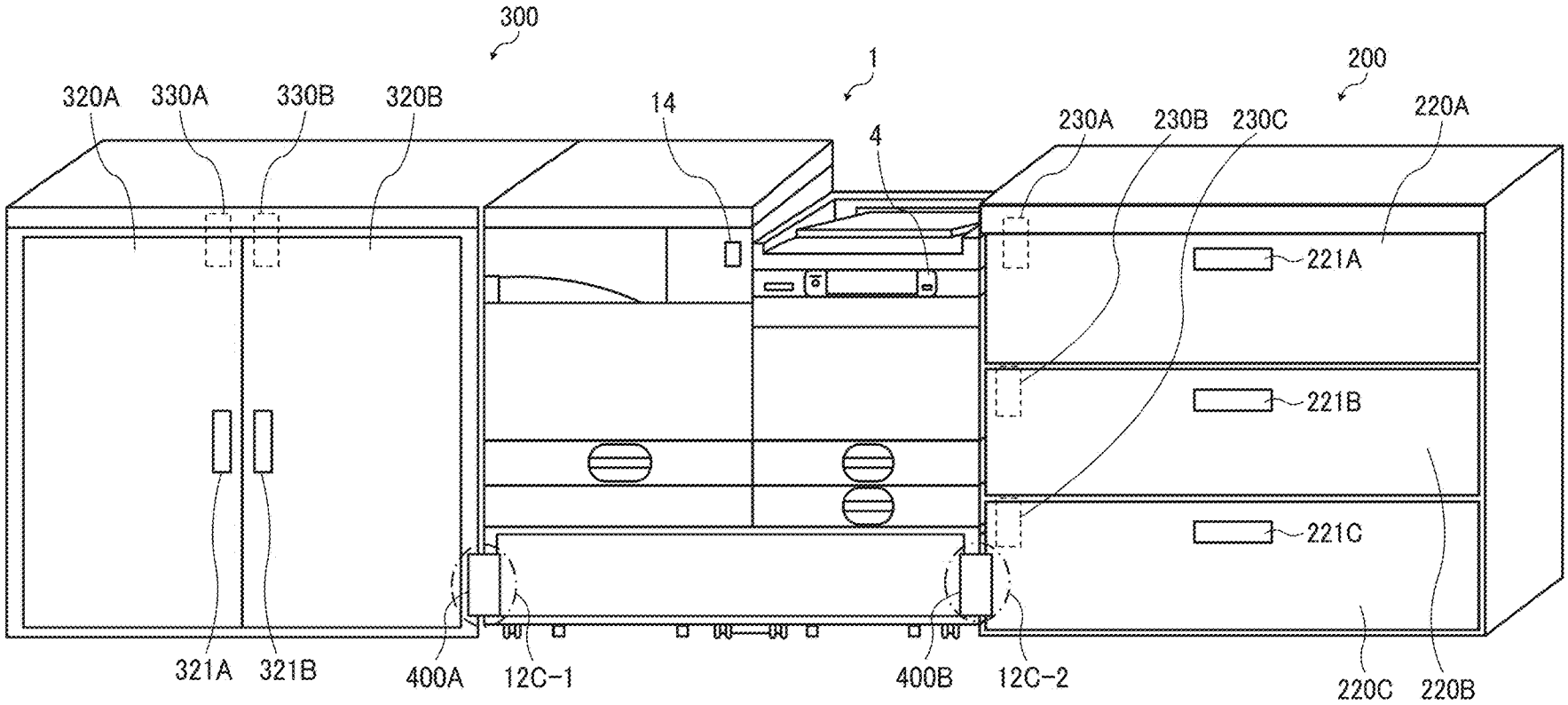
FIG. 8 is a perspective view illustrating a third example of the usage state of the image forming apparatus according to one embodiment of the present invention.

FIG. 8 is a perspective view illustrating a third example of the usage state of the image forming apparatus 1. In FIG. 8, the image forming apparatus 1 is installed between the storage apparatus 200 and a storage apparatus 300 so as to be adjacent to both of them.

The storage apparatus 300 is an open-door type storage apparatus that includes doors 320A and 320B and handles 321A and 321B, and has, in its inside, a storage space appearing when the handles 321A and 321B are pulled and the doors 320A and 320B are rotated, respectively. Lock devices 330A and 330B are provided in the doors 320A and 320B, respectively. As an example, the lock devices 330A and 330B are electronic locks like the lock device 230, and they can lock such that the doors 320A and 320B are not opened even if the handles 321A and 321B are pulled. As described above, the present invention can be applied also to a storage apparatus having a different form of storage.

The storage apparatus 200 includes lock devices 230A to 230C, and the lock devices 230A to 230C lock the storage sections 220A to 220C located at their respective storage positions so as not to be moved to the removal positions even if the handles 221A to 221C are pulled.

In FIG. 8, the image forming apparatus 1 and the storage apparatus 300 are coupled with a coupling tool 400A. The image forming apparatus 1 and the storage apparatus 200 are coupled with a coupling tool 400B. The coupling tool 400A has a plate shape, as an example, and couples the image forming apparatus 1 and the storage apparatus 300 to each other with part of the tool secured to part of each of the image forming apparatuses 1 and the storage apparatuses 300 by a screw, or the like. The coupling tool 400B has a plate shape, as an example, and couples the image forming apparatus 1 and the storage apparatus 200 to each other with part of the tool secured to part of each of the image forming apparatuses 1 and the storage apparatuses 200 by a screw, or the like. As an example, the image forming apparatus 1 includes, as parts of the exterior, coupling tool attaching portions 12C-1 and 12C-2 to which coupling tools can be attached, and fall or a misalignment of the image forming apparatus 1 and a storage apparatus can be prevented by being coupled to each other.

A configuration or an operation common between the doors 320A and 320B may be described by denoting with a door 320. A configuration or an operation common between the handles 321A and 321B may be described by denoting with a handle 321. A configuration or an operation common between the lock devices 330A and 330B may be described by denoting with a lock device 330.

Figure 9:
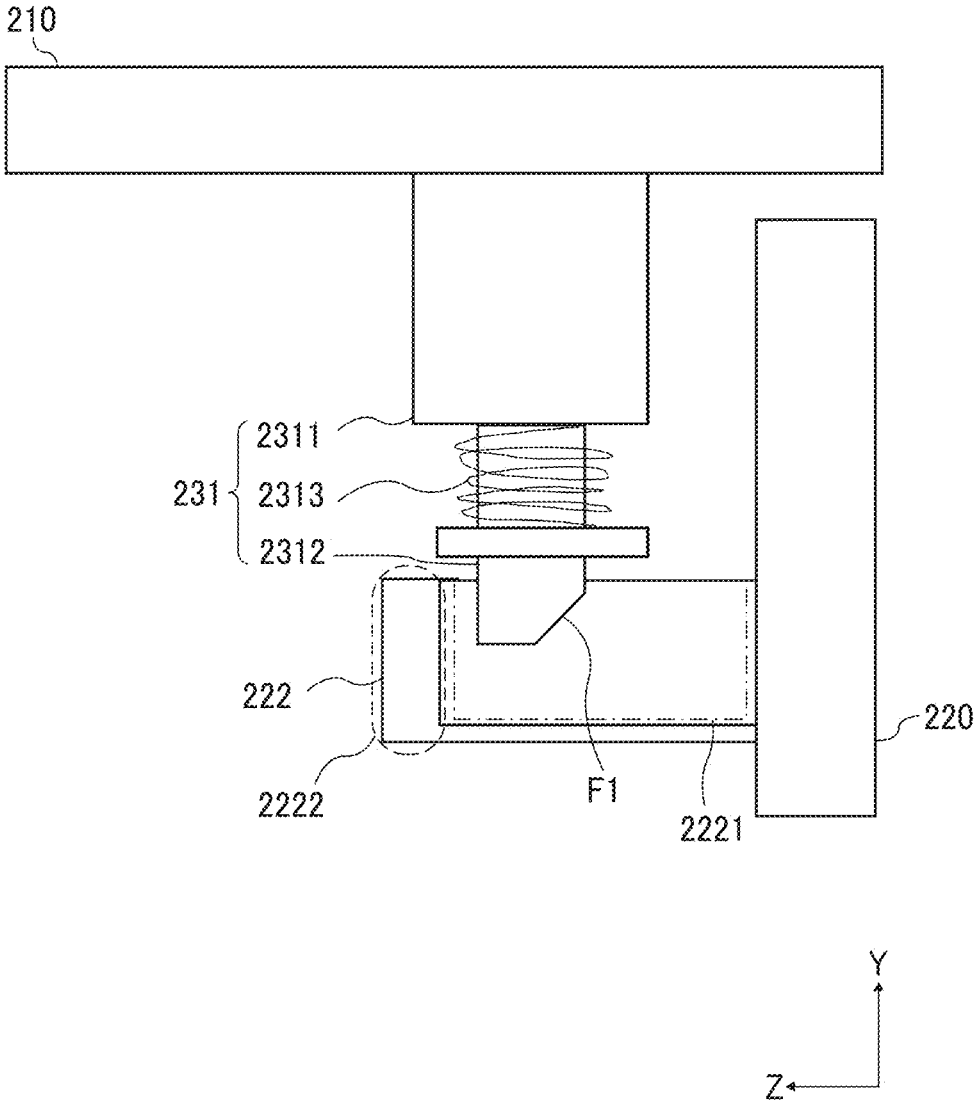
FIG. 9 is a first illustrative view illustrating an operation of a lock device.

FIG. 9 is a first illustrative view illustrating an operation of a lock device of the storage apparatus 200. FIG. 9 illustrates a state of being locked. As illustrated in FIG. 9, the lock device 230 includes an electronic lock (electric lock) 231 using a solenoid coil, as an example. The electronic lock 231 includes a coil 2311, an iron core 2312, and a spring 2313. The iron core 2312 has a slope FI whose diameter becomes smaller as it goes to the tip.

In a state where power supply to the coil 2311 is off, the spring 2313 pushes down the iron core 2312, whereby the coil 2311 enters a concave portion 2221 of a locking coupling section 222. This position of the lock device 230 may be referred to as a locking position of the lock device 230. Since the right direction in FIG. 9 is a direction in which the storage section 220 is pulled out, a portion 2222 of the storage section 220, illustrated by broken lines in the view, is hooked on the iron core 2312 in this state, whereby a user cannot pull out the storage section 220. At this time, the storage section 220 is located at a storage position, at which a manuscript is stored inside the storage apparatus 200 and cannot be removed from the inside. Since the storage section is locked when located at this position, it may also be said that the storage section is located at the locking position.

Figure 10:
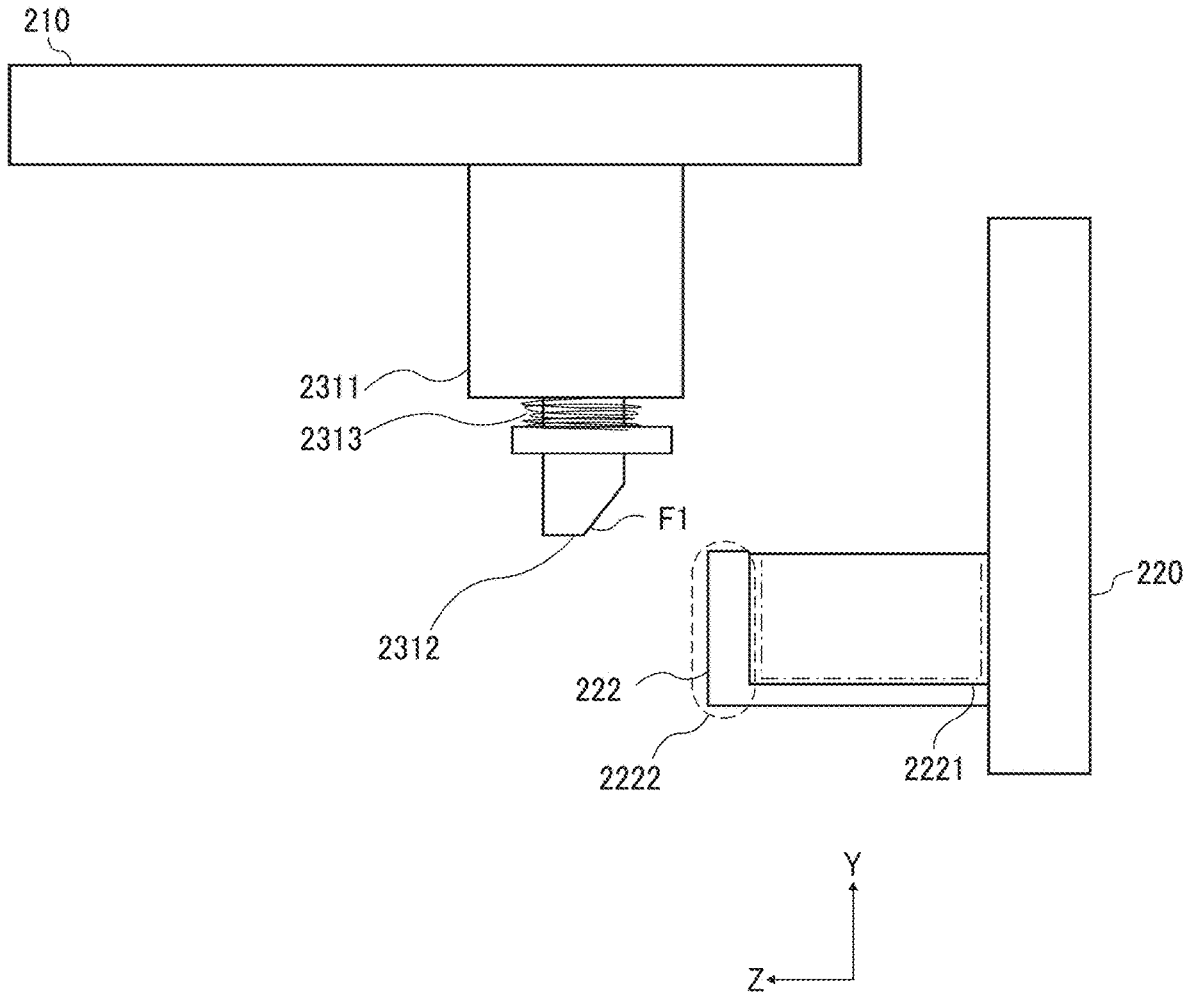
FIG. 10 is a second illustrative view illustrating the operation of the lock device.

FIG. 10 is a second illustrative view illustrating an operation of the lock device. FIG. 10 illustrates a state of being unlocked.

In a state where power supply to the coil 2311 is on, the coil 2311 operates such that the iron core 2312 pushes up the spring 2313, whereby the iron core 2312 comes out of the concave portion 2221 of the locking coupling section 222. This position of the lock device 230 is referred to as an unlocking position of the lock device 230. At this time, a user can pull out the storage section 220, without being hooked on the iron core 2312. At this time, the storage section 220 is located at a removal position at which a manuscript is exposed to the outside of the storage apparatus 200 and can be removed from the inside. Herein, a direction in which the storage section 220 moves from the storage position to the removal position is the same as the direction in which a manuscript is ejected in the manuscript ejection section 3B, as illustrated in FIG. 2B, and these directions face the front direction of the image forming apparatus 1 (Z-axis direction in FIG. 7). Thereby, the direction in which the storage section 220 is pulled out can be made the same as the direction in which a manuscript is removed from the manuscript ejection section 3B, whereby the operativity, when the image forming apparatus 1 and the storage apparatus 200 are both used, is improved.

Figure 11:
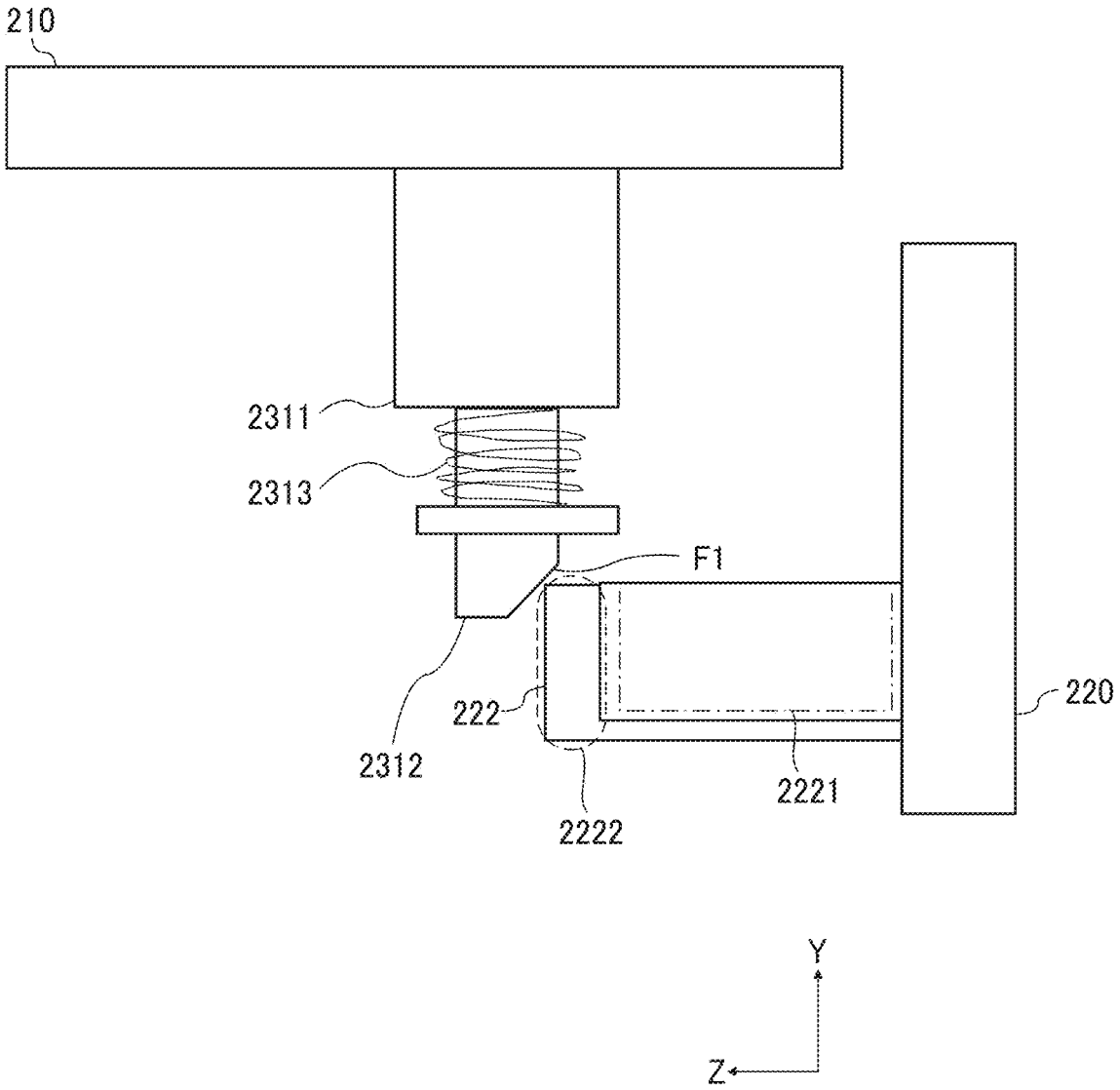
FIG. 11 is a third illustrative view illustrating the operation of the lock device.

FIG. 11 is a third illustrative view illustrating an operation of the lock device. FIG. 11 illustrates a state where the storage section 220 moves from the position at which the section is pulled out to the storage position.

In a state where power supply to the lock device 230 is off, the iron core 2312 is pushed down like FIG. 9. That is, the lock device 230 is at the locking position, like FIG. 9. When the storage section 220 is pushed into the right in FIG. 9 in this state, the locking coupling section 222 contacts the slope FI, and a force, which contracts the spring 2313, is exerted on the spring 2313 by a pushing force, so that the iron core 2312 climbs over the portion 2222 of the concave portion 2221 of the locking coupling section 222, illustrated by broken lines in the view, and enters the inside of the concave portion 2221, whereby a locking state is created. After the storage section 220 is pushed in and the locking state is created, the storage section cannot be pulled out, unless power is supplied to the coil 2311, as described with reference to FIG. 9.

In FIG. 11, the case, where the storage section 220 moves from the state where power supply is off to the storage position, has been described. In this case, when the storage section 220 is pushed into the image forming apparatus 1, the section can be locked automatically, but it is not limited to this. That is, another configuration may be adopted, in which power supply to the coil 2311 is turned off by closing a tray 62 in the state of FIG. 11 and then by a user inputting a locking instruction from the operation panel 4, whereby the storage section is locked.

With the solenoid coil to be used in the lock device 230 made common to a solenoid coil to be used in another member in the image forming apparatus 1, that is, by using a solenoid coil of the same type, the purchase cost can be reduced by purchasing as a component of the image forming apparatus 1, and further part of the control can be made common. An example of the another member in the image forming apparatus 1 includes the intermediate transfer unit 74. A solenoid coil is used for operating both an intermediate transfer gear and a drive gear that drive an intermediate transfer belt of the intermediate transfer unit 74. That is, the solenoid coil engages the gears with each other or separates from each other, depending on when the intermediate transfer gear is driven or when it is not driven.

Figure 12:
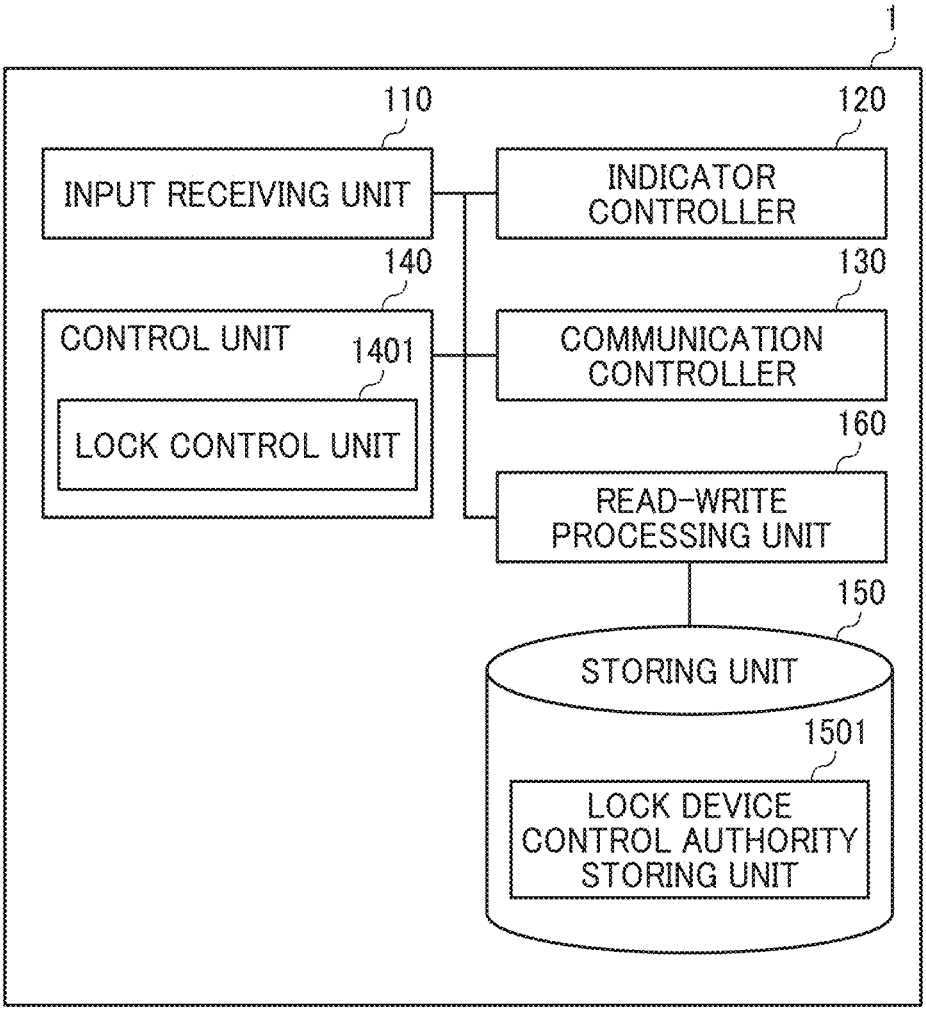
FIG. 12 is a functional block diagram of the image forming apparatus according to one embodiment of the present invention.

Next, a configuration of the image forming apparatus 1, which controls the lock device of the storage apparatus, will be described. FIG. 12 is a functional block diagram of the image forming apparatus 1. The image forming apparatus 1 includes: an input receiving unit 110 that receives an input; an indicator controller 120 that controls display on the operation panel 4; a communication controller 130 that controls communication between the image forming apparatus 1 and an external apparatus; a control unit 140 that controls the whole image forming apparatus 1; a storing unit 150 that stores various data and programs on the image forming apparatus 1; and a read-write processing unit 160 that reads and writes various data and programs for the storing unit 150. The control unit 140 further includes a lock control unit 1401 that controls the lock device 230. The storing unit 150 further includes a lock device control authority storing unit 1501.

The input receiving unit 110 is implemented by CPU processing of the control board 15, and executes a function to receive an input from a user to the image forming apparatus 1, the input from a user being made by using the operation panel 4 (an example of the input device) or the card reader 14 (an example of the input device). Examples of the input from a user include: a login demand based on user information for using the image forming apparatus 1; instructions for executing a copy function, a printer function, and a scanner function and an instruction for storing data; a control instruction on the lock device 230 of the storage apparatus 200; and the like, but they are not limited to these.

The indicator controller 120 is implemented by CPU processing of the control board 15, and executes a function to control a display screen to be displayed on the operation panel 4 (an example of the indicator).

The communication controller 130 is implemented by CPU processing of the control board 15, and executes a function to control a communication interface of the image forming apparatus 1 with an external apparatus. The communication may be wireless communication or wired communication.

The control unit 140 is implemented by CPU processing of the control board 15, and executes a function to control an operation for the image forming apparatus 1 in accordance with a user operation. The lock control unit 1401 (an example of an unlock control unit) is implemented by CPU processing of the control board 15, and executes a function to perform control on the lock device 230 in accordance with a user operation. Examples of the control on the lock device 230 include lock control and unlock control to lock and unlock the lock device 230, but they are not limited to these.

The storing unit 150 is executed by ROM or HDD processing of the control board 15, and executes a function to store a program, document data, various setting information required for the operation of the image forming apparatus 1, an action log of the image forming apparatus 1, and the like. The lock device control authority storing unit 1501 stores in advance a lock device control authority table in which user information and presence or absence of authority for executing lock device control, an operation on the lock device 230, are associated with each other. An example of the user information includes a login identification (ID) for logging in to use the image forming apparatus 1, but it is not limited to this. Examples of the lock device control include control of unlocking, locking, and information acquisition of the lock device 230, but they are not limited to these. The authority table may be provided for every control, or may be provided for a plurality of control. When a plurality of the lock devices 230 is controlled, the authority table may be provided for every lock device.

The read-write processing unit 160 is executed by CPU processing of the control board 15, and executes functions to store various data in the storing unit 150 and to read the various data stored in the storing unit 150.

In the present embodiment, a lock control device is configured with the input receiving unit 110, the indicator controller 120, and the lock control unit 1401.

Figure 13:
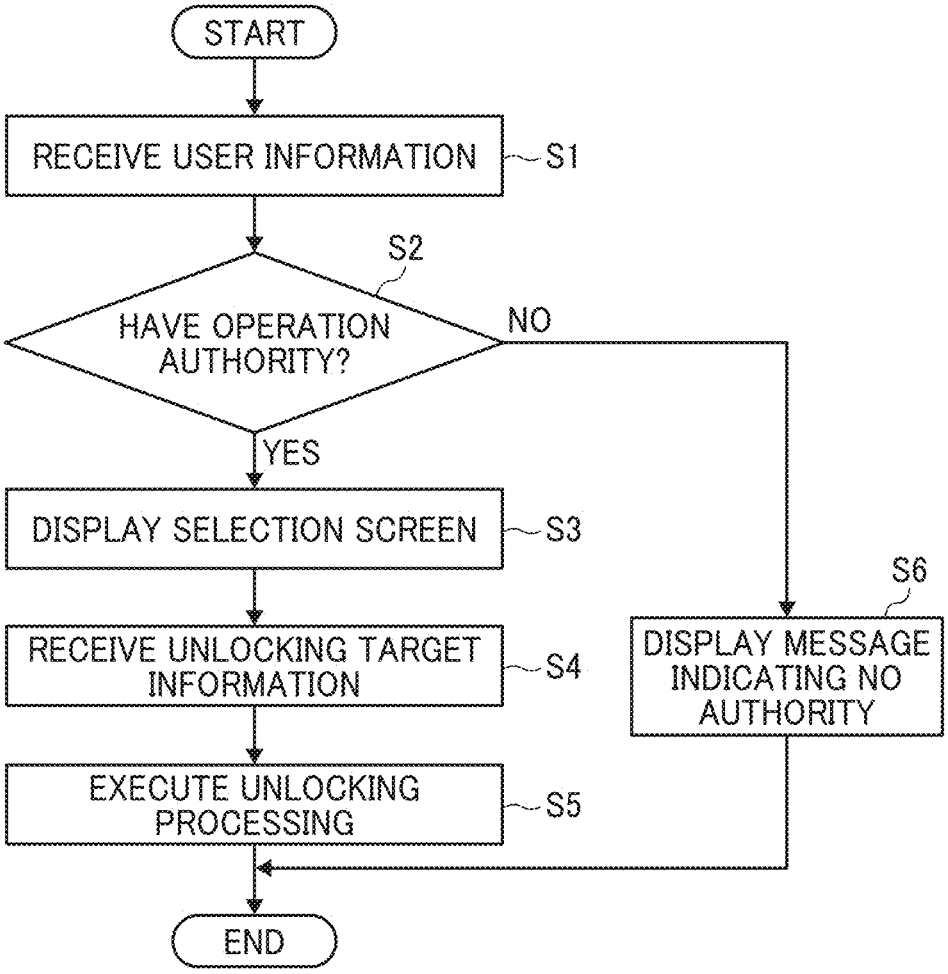
FIG. 13 is a flowchart illustrating lock device control processing.

FIG. 13 is a flowchart illustrating lock device control processing. The lock device control processing is started when a user instructs an operation of the lock device 230 from the operation panel 4. Examples of the operation instruction include unlocking, locking, acquisition of information, and the like, but they are not limited to these.

First, the input receiving unit 110 receives user information (S1). Then, the lock control unit 1401 determines based on the input user information whether a user has operation authority to the lock device by referring to the lock device control authority table in the lock device control authority storing unit 1501 (S2).

When it is determined that the user has authority (YES) in step S2, the indicator controller 120 makes candidates for the storage section 220, a target of unlocking, displayed on the operation panel 4 (S3). The input receiving unit 110 receives operation target information input by the user, as an example, information by which the storage section 220 that is a target of unlocking can be identified (S4). When the number of the storage sections to be controlled by the lock control unit 1401 is one, step S4 may be omitted.

Then, the lock control unit 1401 executes operation processing of the storage section 220 that is an input operation target (S5), and outputs an unlocking signal that designates the storage section 220 to be unlocked, whereby the processing flow ends. When the operation instruction is unlocking, the operation processing is, as an example, the power supply to the coil 2311 that has been described with reference to FIG. 10, but it is not limited to this.

On the other hand, when it is determined that the user does not have authority (NO) in step S2, the indicator controller 120 displays a message reading that the user does not have unlocking authority on the operation panel 4 (S6), whereby the processing flow ends.

Since the lock device 230, provided in the storage section 220 of the storage apparatus 200, can be unlocked by an input from the operation panel 4 of the image forming apparatus 1, as described above, security of an article stored in the storage apparatus 200 can be secured by the image forming apparatus 1. Examples of the article whose security is to be secured include, for example, a replacement toner bottle and supplementary sheets that are to be used in the image forming apparatus 1. They have relatively high monetary value of articles themselves, so their securities should be secured. Also, for example, a manuscript to be copied in the image forming apparatus 1 and a copied manuscript may be highly confidential depending on their contents, so their securities should be secured. The securities of these articles, stored in the storage apparatus 200 that stores articles relating to the image forming apparatus 1, can be secured by the image forming apparatus 1.

As the user information in the lock device control authority table, user information registered as users of the image forming apparatus 1 are used. Therefore, user registration for performing locking-unlocking control of the storage apparatus 200 is not particularly needed. Further, an operation history of the lock device 230 of the storage apparatus 200, an external apparatus, can be managed by a log management (history management) function based on the user information usually executed in the image forming apparatus 1.

Furthermore, when a highly confidential document, copied in the image forming apparatus 1, is stored in a lockable storage apparatus, or when a document stored in a locked storage apparatus is removed to be copied or scanned in the image forming apparatus 1, it is unnecessary to move a long distance carrying the document, with the image forming apparatus 1 and the storage apparatus 200 installed next to each other.

Next, examples of screens displayed on the image forming apparatus 1 will be described with reference to FIGS. 14A to 14D and 15A to 15D. FIGS. 14A to 14D illustrate a first example of screen transitions displayed on the image forming apparatus 1.

Figure 14A:
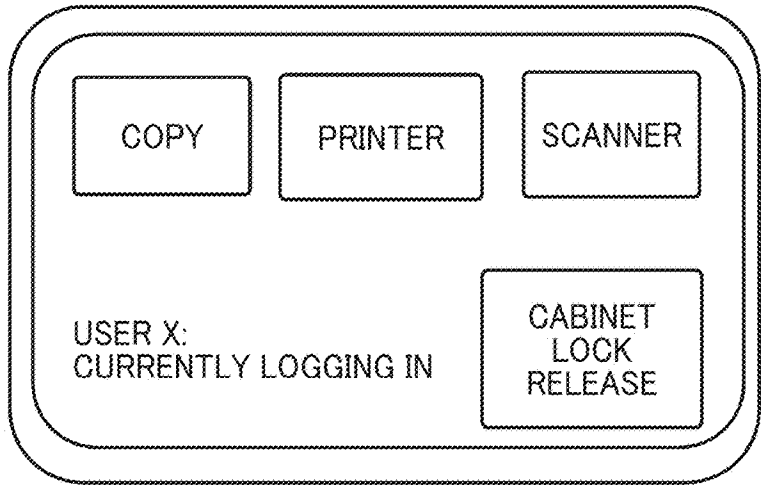
FIGS. 14A to 14D illustrate a first example of screen transitions displayed on an image forming apparatus.

A screen illustrated in FIG. 14A is an initial screen (home screen) displayed on the operation panel 4 of the image forming apparatus 1. Buttons labeled with "copy", "printer", "scanner", and "cabinet lock release", which can be executed in the image forming apparatus 1, are displayed, so that a user can select a function, which the user wants to execute in the image forming apparatus 1, by pushing a button labeled with the function. A user is logging in to the image forming apparatus 1 by inputting a password from the operation panel 4 or by making the card reader 14 read an ID card, and the user currently logging in is displayed on the screen of FIG. 14A as "User X: Currently logging in." A user who wants to unlock any one of the storage sections 220 selects the button labeled with "cabinet lock release" in FIG. 14A.

Figure 14B:
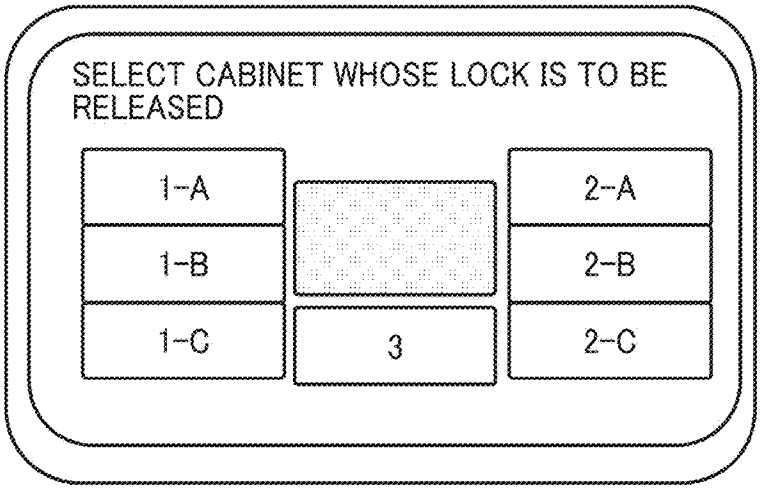

FIG. 14B illustrates a screen displayed when the button labeled with "cabinet lock release" is selected in FIG. 14A. As candidates for the cabinet whose lock is to be released, seven types of buttons of "1-A", "1-B", "1-C", "3", "2-A", "2-B", and "2-C" are displayed on the screen of FIG. 14B. As an example, "1-A", "1-B", and "1-C" represent the three storage sections 220 of the storage apparatus 200, which are installed in order from the top on the left side of the image forming apparatus 1. "3" represents the storage section 16 in the lower portion of the image forming apparatus 1. "2-A", "2-B", and "2-C" represent the three storage sections 220 of the storage apparatus 200, which are installed in order from the top on the right side of the image forming apparatus 1. In FIG. 14B, a user selects a button labeled with a cabinet that the user wants to unlock.

The image forming apparatus 1 may be configured such that in FIG. 14B, the storage apparatus 200, the lock device 230 of which a user has operation authority to, is only displayed based on the user information on the user currently logging in, and the storage apparatus 200, the lock device 230 of which a user does not have operation authority to, is not displayed. Or, the image forming apparatus 1 may be configured such that in FIG. 14B, the storage apparatus 200, the lock device 230 of which a user has operation authority to, is displayed based on the user information on the user currently logging in, but it cannot be selected.

After the button labeled with "cabinet lock release" is pushed in FIG. 14A, the image forming apparatus 1 determines, based on the user information on the user currently logging in, whether the user has operation authority to the lock device 230. When the user does not have the authority, it may be displayed on the operation panel 4 that the user does not have the authority.

Figure 14C:
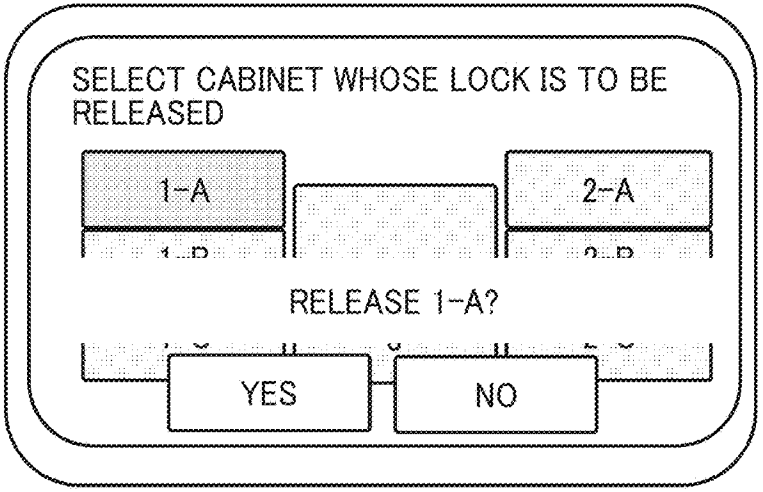

FIG. 14C illustrates a screen displayed when the button labeled with "1-A" is selected in FIG. 14B. The screen of FIG. 14C indicates that "1-A" selected as a target of unlocking is displayed in a darker color than the other candidates. And, "1-A to be released?", "Yes", and "No" are displayed as confirmation messages. When the target of unlocking is right, a user selects "Yes."

Figure 14D:
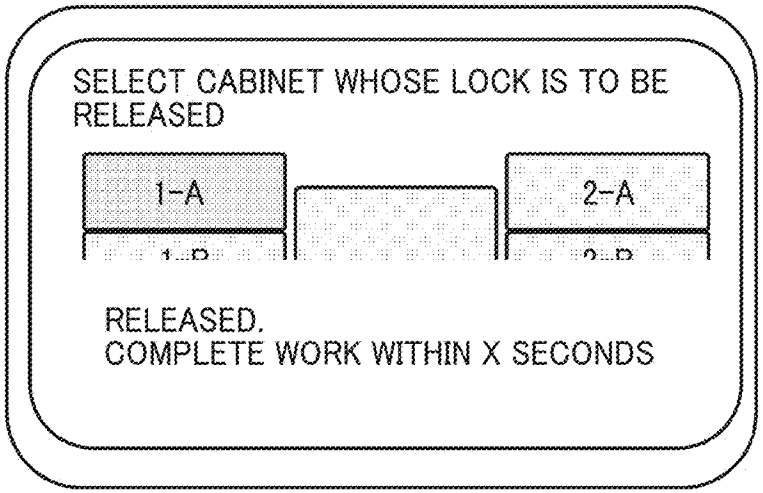

FIG. 14D illustrates a screen displayed when the button labeled with "Yes" is selected in FIG. 14C. In FIG. 14D, a message reading "Released. Complete work within X seconds." is displayed as a message indicating an operation state of the lock device 230. When this message is displayed, a user can confirm that the target of unlocking has been unlocked, and an article can be stored in or removed from the storage section 220.

These display contents of FIGS. 14A to 14D and switching of the display are controlled by the indicator controller 120.

Figure 15A:
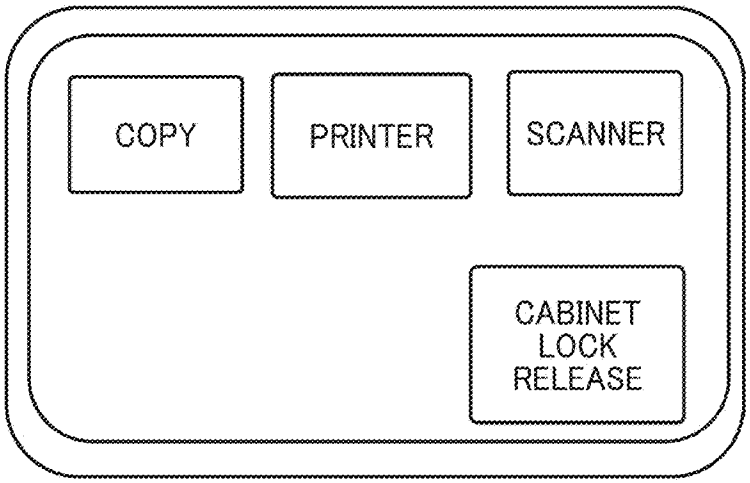
FIGS. 15A to 15D illustrate a second example of the screen transitions displayed on the image forming apparatus.

FIGS. 15A to 15D illustrate a second example of the screen transitions displayed on the image forming apparatus 1. A screen illustrated in FIG. 15A is an initial screen (home screen) displayed on the operation panel 4 of the image forming apparatus 1. Buttons labeled with "copy", "printer", "scanner", and "cabinet lock release", which can be executed in the image forming apparatus 1, are displayed, so that a user can select a function, which the user wants to execute in the image forming apparatus 1, by pushing a button labeled with the function.

Figure 15B:
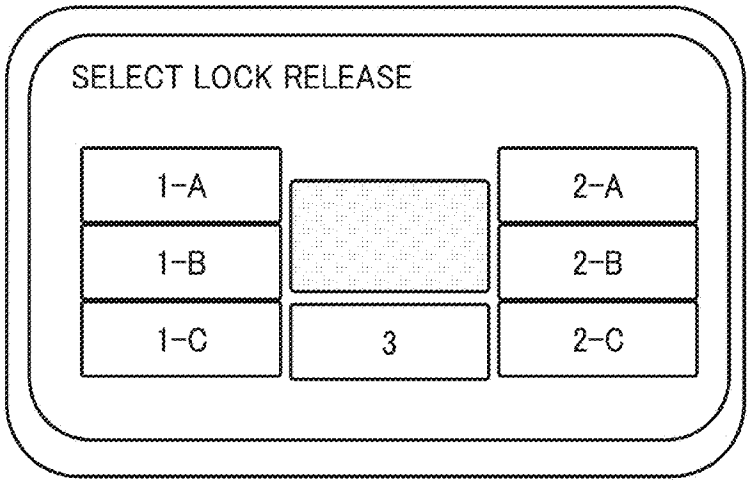

FIG. 15B illustrates a screen displayed when the button labeled with "cabinet lock release" is selected in FIG. 15A. As candidates for the cabinet whose lock is to be released, seven types of buttons of "1-A", "1-B", "1-C", "3", "2-A", "2-B", and "2-C" are displayed on the screen of FIG. 15B. As an example, "1-A", "1-B", and "1-C" represent the three storage sections 220 of the storage apparatus 200 installed on the left side of the image forming apparatus 1. "3" represents the storage section 16 of the image forming apparatus 1. "2-A", "2-B", and "2-C" represent the three storage sections 220 of the storage apparatus 200 installed on the right side of the image forming apparatus 1. In FIG. 15B, a user selects a button labeled with a cabinet that the user wants to unlock.

Figure 15C:
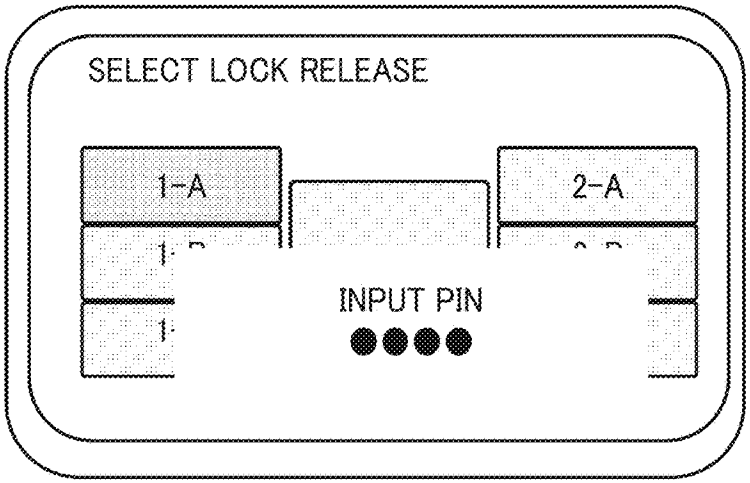

FIG. 15C illustrates a screen displayed when the button labeled with "1-A" is selected in FIG. 15B. The screen of FIG. 14C indicates that "1-A" selected as a target of unlocking is displayed in a darker color than the other candidates. And, an authentication message reading as "Input PIN" is displayed. In the screen of FIG. 15C, a user inputs a PIN as user information from the operation panel 4.

Figure 15D:
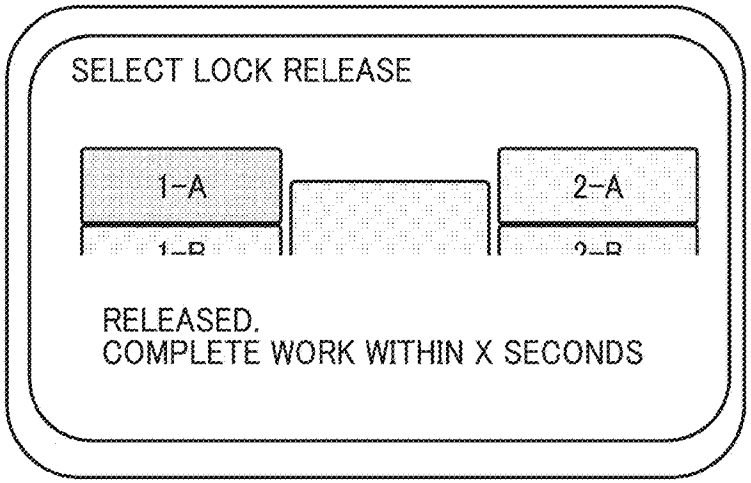

FIG. 15D illustrates a screen displayed when it is determined, based on the PIN as user information input in FIG. 15C, that the user has operation authority to the lock device 230. In FIG. 15D, a message reading "Released. Complete work within X seconds." is displayed as a message indicating an operation state of a lock device 230. When this message is displayed, a user can confirm that the target of unlocking has been unlocked, and an article can be stored in or removed from the storage section 220.

When the image forming apparatus 1 determines, based on the user information as a PIN input in FIG. 15C, whether the user has operation authority to the lock device 230, and when the user does not have the authority, it may be displayed on the operation panel 4 that the user does not have the authority.

These display contents of FIGS. 15A to 15D and switching of the display are controlled by the indicator controller 120.

In FIGS. 14A to 14D and 15A to 15D, the operation panel 4 doubles as the indicator and the input device, but the indicator and the input device may be configured separately.

Figure 16:
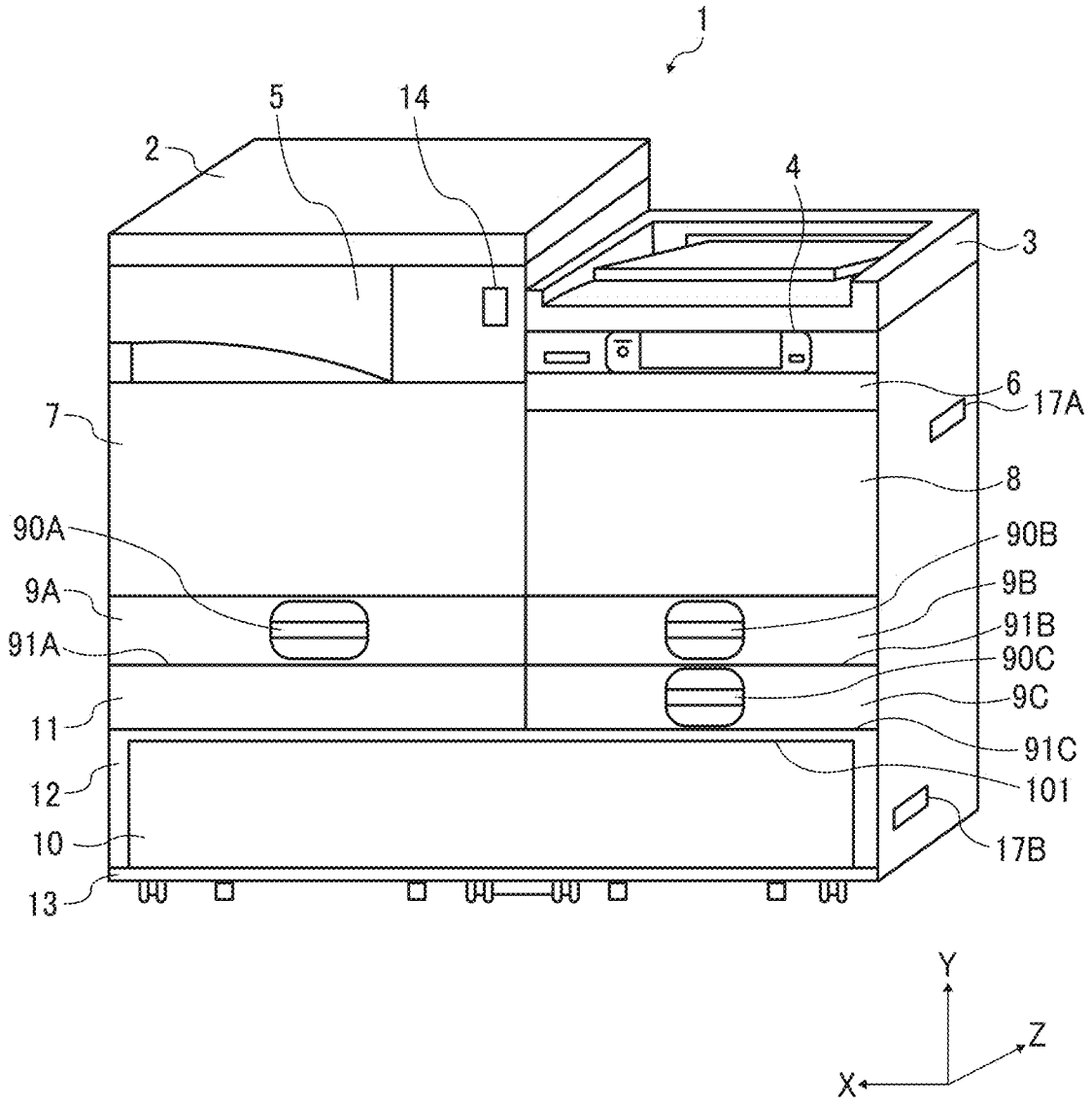
FIG. 16 is a perspective view illustrating a coupling configuration of the image forming apparatus according to one embodiment of the present invention to a storage apparatus.

Next, a hardware configuration for coupling the image forming apparatus 1 and the storage apparatus 200 will be described. FIG. 16 is a perspective view of the image forming apparatus 1, like FIG. 1. In FIG. 16, coupling sections 17A and 17B, at which the image forming apparatus 1 is to be coupled to the storage apparatus 200, are provided, of the exterior 12, in a side face 12R that is a portion forming one side face of the image forming apparatus 1. Each of the coupling sections 17A and 17B has at least one opening.

Figure 17C:
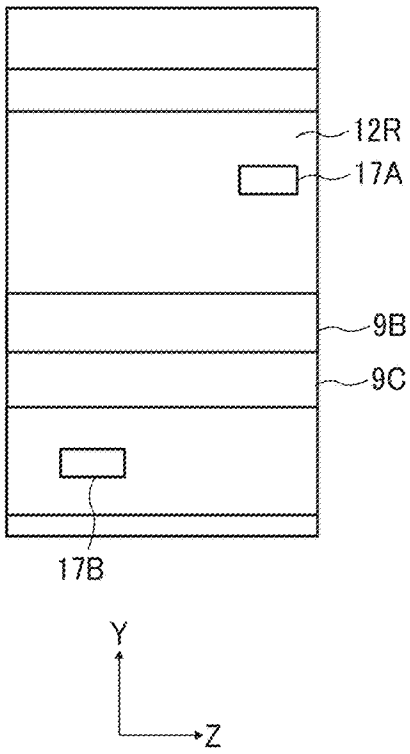
FIGS. 17A to 17C are a front view and side views illustrating the coupling configurations of the image forming apparatus according to one embodiment of the present invention to the storage apparatus.
Figure 17B:
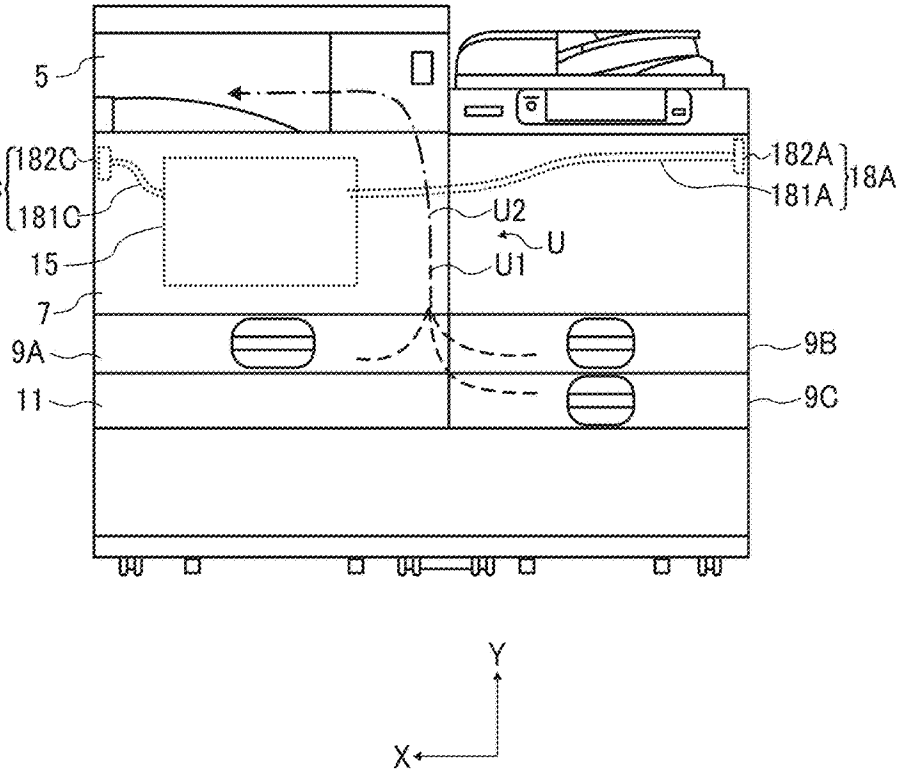
Figure 17A:
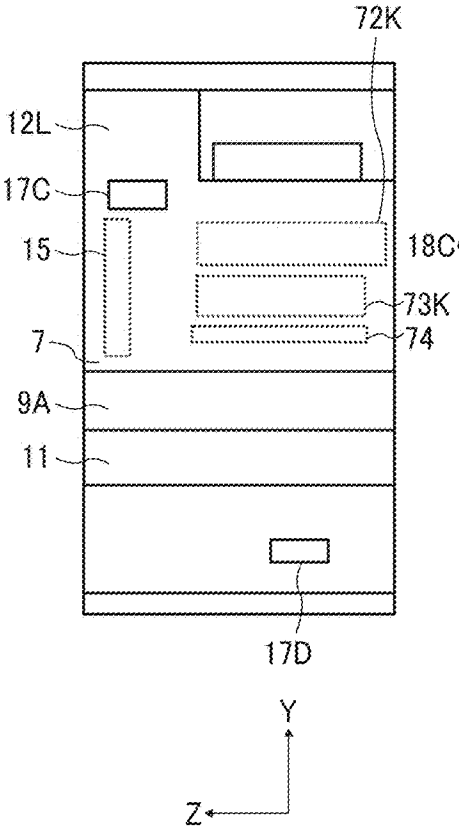

FIG. 17A is a side view illustrating an opposite face to the side face 12R of the image forming apparatus 1. Hereinafter, the side face opposite to the side face 12R may be referred to as a side face 12L. Coupling sections 17C and 17D are provided in the side face 12L. Each of the coupling sections 17C and 17D has at least one opening. In FIG. 17A, part of the respective members provided near the side face 12L, when viewed from the front of the image forming apparatus 1, i.e., the control board 15, the toner bottle 72K, the image forming unit 73K, and the intermediate transfer unit 74 are illustrated by broken lines. The control board 15 is provided near the back face of the image forming apparatus 1. The coupling section 17C is provided at a position closer to the control board 15 than the coupling section 17D.

FIG. 17B is a front view of the image forming apparatus 1. In FIG. 17B, the control board 15 located inside is illustrated by dot lines. And, cables 18A and 18C, coupled to the power supply circuit, a control circuit, and the like that are on the control board 15, are illustrated. The cable 18A includes a cable section 181A and a connector section 182A. The cable 18C includes a cable section 181C and a connector section 182C. In the present embodiment, the cables 18A and 18C are cables to be electrically coupled to the lock device 230 of the storage apparatus 200.

FIG. 17C illustrates the side face 12L of the image forming apparatus 1. The coupling sections 17A and 17B, described with reference to FIG. 16, are illustrated. The coupling section 17A is provided at a position closer to the control board 15 than the coupling section 17B.

Hereinafter, a configuration or an operation common among the coupling sections 17A, 17B, 17C, and 17D may be described by denoting with a coupling section 17. A configuration or an operation common between the cables 18A and 18C may be described by denoting with a cable 18.

A configuration or an operation common between the cable sections 181A and 181C may be described by denoting with a cable section 181. A configuration or an operation common between the connector sections 182A and 182C may be described by denoting with a connector section 182.

As described with reference to FIG. 4, the ejected sheet feeding path U2 reaches the sheet ejection section 5, without passing through the outside of the image forming apparatus 1. Therefore, in a space outside the image forming apparatus 1, more specifically, in a space outside the exterior 12 of the image forming apparatus 1, the cable 18 exists, but the sheet ejection section 5 and the ejected sheet feeding path U2 do not exist. Therefore, the cable 18 is hardly affected by a user action of removing a copied sheet that has been ejected outside the image forming apparatus 1 or ejected toward the outside of the image forming apparatus 1. Further, when the cable 18 is laid out, it is unnecessary to take into consideration interference with a mechanism for ejecting sheets outside the image forming apparatus 1, whereby flexibility in the layout of the cable 18 is increased.

Figure 18:
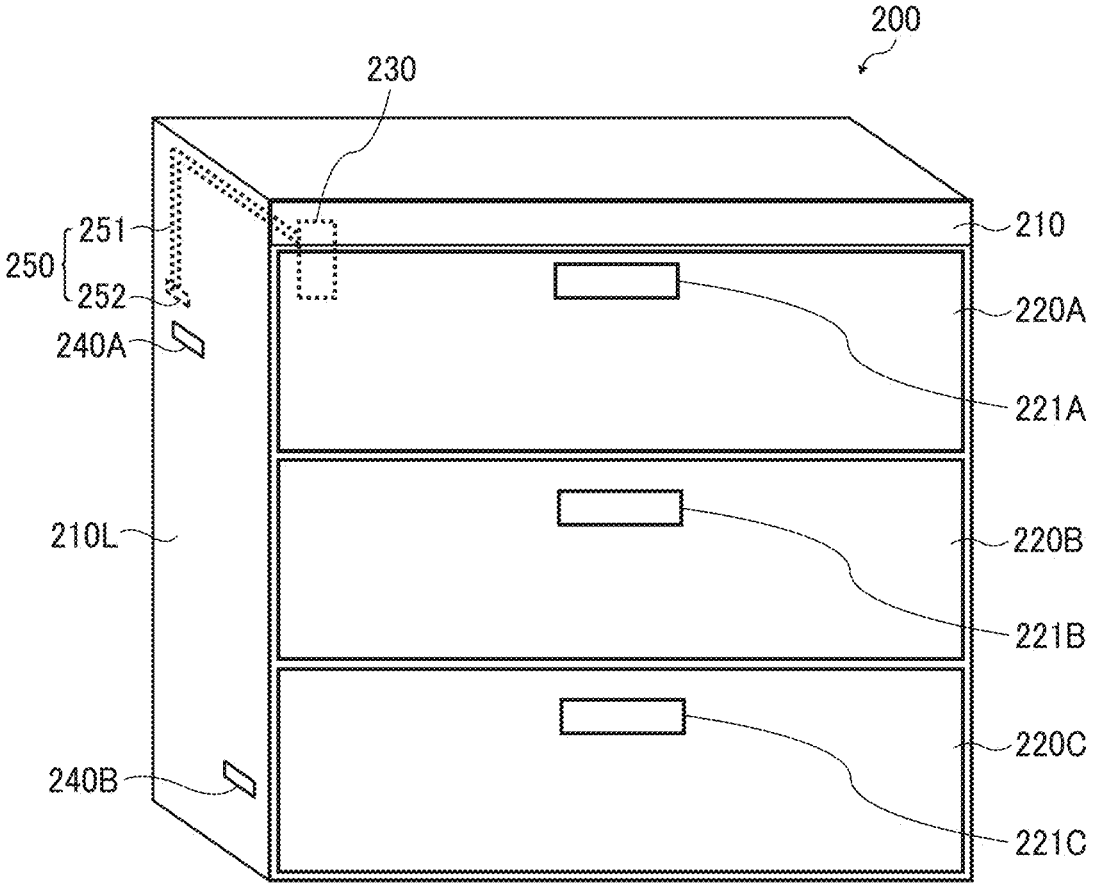
FIG. 18 is a perspective view illustrating a coupling configuration of the storage apparatus.

FIG. 18 is a perspective view of the storage apparatus 200. In FIG. 18, coupling sections 240A and 240B, at which the storage apparatus 200 is to be coupled to the image forming apparatus 1, are provided, of the exterior 210, in a side face 210L that is a portion facing (or contacting) the side face of the image forming apparatus 1. Each of the coupling sections 240A and 240B has at least one opening.

In FIG. 18, the lock device 230 provided inside is illustrated. The lock device 230 includes a cable 250 for receiving power and a control signal. The cable 250 includes a cable section 251 and a connector section 252.

The coupling sections 240A and 240B are provided at positions at which when the image forming apparatus 1 illustrated in FIGS. 17A to 17C and the storage apparatus 200 illustrated in FIG. 18 are arranged next to each other as illustrated in FIG. 5, the coupling sections 240 and 240B are almost opposite to the coupling sections 17A and 17B, respectively.

As described above with reference to FIGS. 16, 17A to 17C, and 18, the image forming apparatus 1 includes the coupling section 17, corresponding to the coupling section 240 of the storage apparatus 200, in the side face facing (or contacting) the side face of the storage apparatus 200. With this coupling section 17, wired electrical coupling or securing coupling to secure each other can be made between the image forming apparatus 1 and the storage apparatus 200. The storage apparatus 200 includes the coupling section 240, corresponding to the coupling section 17 of the image forming apparatus 1, in the side face facing (or contacting) the side face of the image forming apparatus 1. With this coupling section 240, wired electrical coupling or securing coupling to secure each other can be made between the storage apparatus 200 and the image forming apparatus 1. More preferably, the coupling section 17 is provided at a position almost opposite to the coupling section 240. The coupling section 240 is provided at a position almost opposite to the coupling section 17. In that case, the electrical coupling or the securing coupling can be made more easily and surely.

It can be appropriately set to use the coupling section 17 for the securing coupling or the electrical coupling, but in the present embodiment, the cable section 181A and the connector section 182A are arranged such that the connector section 182A is oriented toward the coupling section 17A, as illustrated in FIGS. 17A to 17C. And, the cable section 181C and the connector section 182C are arranged such that the connector section 182C is oriented toward the coupling section 17C.

In the present embodiment, each of the coupling sections 17A and 17C has an opening for electrically coupling the image forming apparatus 1 and the storage apparatus 200 through an electrical coupling cable, as described above. In this case, the coupling sections 17A and 17C are electrical coupling sections. On the other hand, each of the coupling sections 17D and 17B has an opening for securing the image forming apparatus 1 and the storage apparatus 200 to each other. In this case, the coupling sections 17B and 17D are securing coupling sections.

Alternatively, the coupling section 17 may have a plurality of openings such that each of the securing coupling and the electrical coupling is formed by using part of the openings. In that case, the coupling section 17 is the securing coupling section and the electrical coupling section. If one side face has a plurality of the securing coupling sections, the image forming apparatus 1 and the storage apparatus 200 are secured more stably.

The image forming apparatus 1 has a plurality of the coupling sections 17 in its one side face. With the electrical coupling section provided at a position closer to the control board 15 than the securing coupling section, a length of the cable 18 in the image forming apparatus 1 can be shortened.

The cable 250 extends toward the coupling section 240A opposite to the coupling section 17A that is the electrical coupling section of the image forming apparatus 1. Since the lock device 230, illustrated in FIG. 18, is provided near the front face of the apparatus, the cable 250 is arranged to extend toward the back face of the apparatus. When the lock device 230 is provided near the back face, the cable 250 can be shortened. When a plurality of the lock devices 230 are provided, as illustrated in FIG. 8, the cables 250, each corresponding to each lock device 230, are provided. On the other hand, the same number of the coupling sections 17 may be provided, or a plurality of the cables 250 may be provided for one coupling section 17 in consideration of the coupling to the image forming apparatus 1, as described above. The positions at which the lock devices 230 are provided and wiring of the cables 250 can be appropriately selected.

Figure 19:
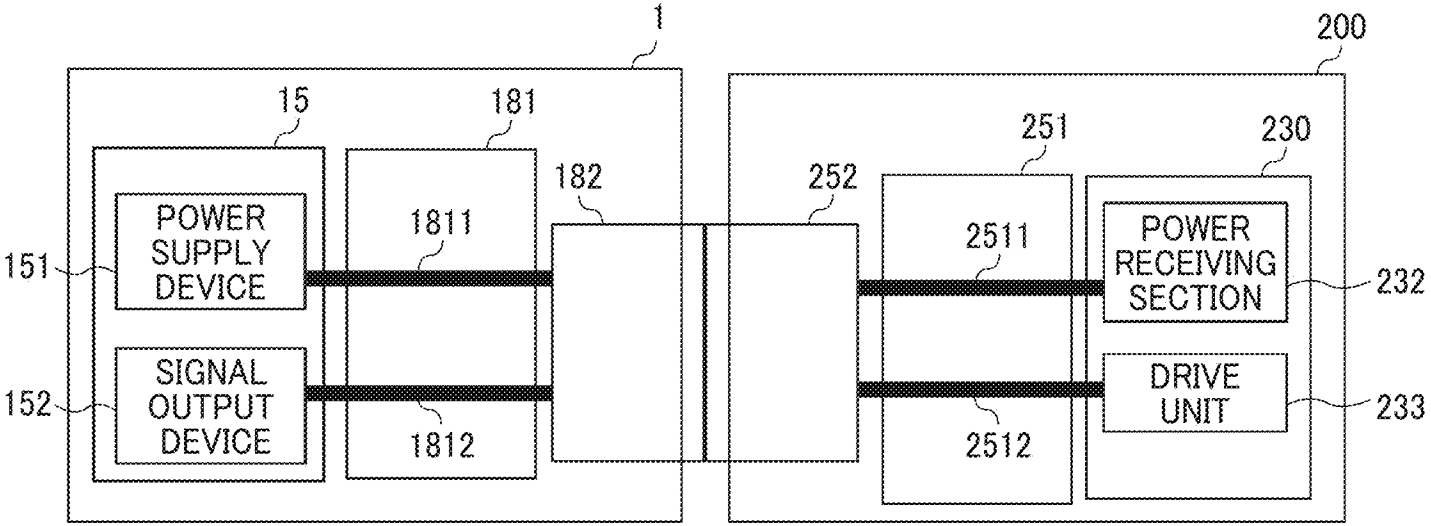
FIG. 19 is a conceptual diagram illustrating electrical coupling between the image forming apparatus and the storage apparatus.

FIG. 19 is a schematic configuration diagram illustrating the electrical coupling between the image forming apparatus 1 and the storage apparatus 200. The control board 15 includes a power supply device 151 and a signal output device 152. The power supply device 151 is a circuit for supplying power to each section of the lock device 230. The signal output device 152 is a circuit for outputting a control signal over each section of the lock device 230. The cable section 181 includes a power supply cable 1811 and a signal output cable 1812. The power supply cable 1811 is a cable that is to be coupled to the power supply device 151 to supply power to each section of the lock device 230. The signal output cable 1812 is a cable that is to be coupled to the signal output device 152 to send a control signal to each section of the lock device 230. The connector section 182 is coupled to the power supply cable 1811 and the signal output cable 1812 to function as a power supply connector section and a signal output connector section. The connector section 182 is coupled to the connector section 252.

The lock device 230 includes a power receiving section 232 and a drive unit 233. The power receiving section 232 receives power supply required for the operation of each section of the lock device 230. The drive unit 233 drives each section of the lock device 230 based on a signal from the signal output device 152. The cable section 251 includes a power receiving cable 2511 and a signal input cable 2512. The power receiving cable 2511 is a cable for receiving power to be supplied to each section of the lock device 230. The signal input cable 2512 is a cable for sending a control signal from the signal output device 152 to each section of the lock device 230. The connector section 252 is coupled to the power receiving cable 2511 and the signal input cable 2512 to function as a power receiving connector section and a signal input connector section. The connector section 252 is coupled to the connector section 182.

As described above, the cable 18 coupled to the control board 15 is electrically coupled to the lock device 230 via the cable 250. That is, the cable 18 is coupled to the electronic lock 231, the power receiving section 232, and the drive unit 233 that are included in the lock device 230. Therefore, the lock device 230, and the electronic lock 231, the power receiving section 232, and the drive unit 233 that are included in the lock device 230, are controlled based on an operation received from the operation panel 4 or the like of the image forming apparatus 1.

When the lock device 230 is locked or unlocked depending on the presence or absence of power supply to the electronic lock 231, as described as an example with reference to FIGS. 9 to 11, the lock device 230 can be locked or unlocked with the lock control unit 1401 controlling the power supply from the power supply device 151, even if the drive unit 233 is not necessarily provided. That is, in the case of the configuration of FIGS. 9 to 11, the lock device 230 can be unlocked by supplying power from the image forming apparatus 1 to the coil 2311, as described with reference to FIG. 10. On the other hand, the lock device 230 can be locked by pushing the storage section 220 into the storage apparatus 200, even if the image forming apparatus 1 is powered off and power is not supplied from the image forming apparatus 1, as described with reference to FIG. 11. Therefore, the lock device 230 of FIGS. 9 to 11 can be locked also when the image forming apparatus 1 is powered off, while it can be unlocked when the image forming apparatus 1 is powered on.

Figure 20:
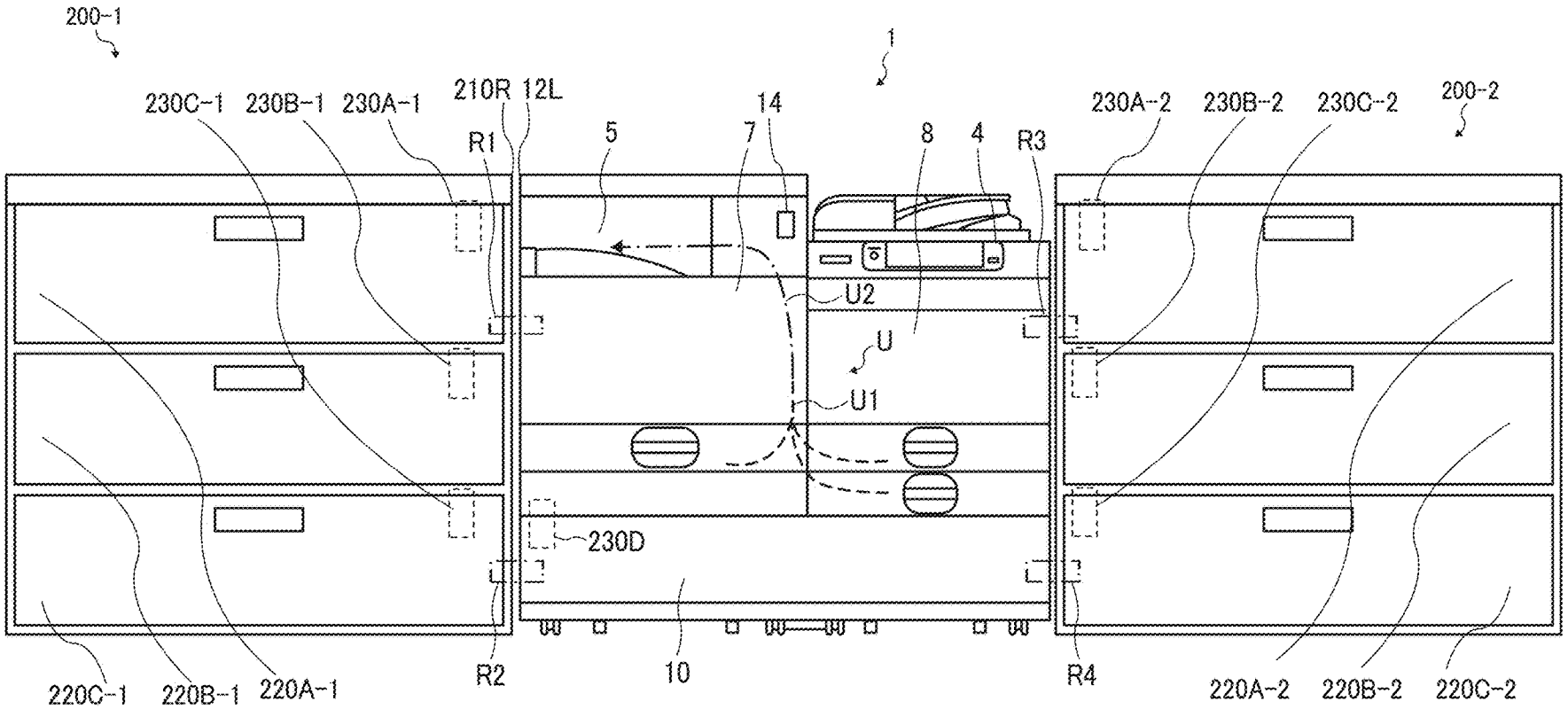
FIG. 20 is a front view illustrating a fourth example of the usage state of the image forming apparatus according to one embodiment of the present invention.

FIG. 20 is a view illustrating an example of a usage state where an image forming apparatus and storage apparatuses are installed next to each other. The image forming apparatus 1 is installed between a storage apparatus 200-1 and a storage apparatus 200-2. Each of regions indicated by R1, R2, R3, and R4 is a region where the coupling section 17 and the coupling section 240 are almost opposite to each other.

The storage apparatus 200-1 includes storage section 220A-1, 220B-1, and 220C-1, and lock devices 230A-1, 230B-1, and 230C-1 as the lock devices 230 of the respective storage sections. The storage apparatus 200-2 includes storage sections 220A-2, 220B-2, and 220C-2, and lock devices 230A-2, 230B-2, and 230C-2 as the lock devices 230 of the respective storage sections. With each lock device 230 provided at a position closer, in the width direction, to the image forming apparatus 1, as illustrated in FIG. 20, the cable 250 can be shortened in the storage apparatus 200. The image forming apparatus 1 includes the storage section 16 and a lock device 230D in its lower portion.

That is, the storage sections 220A-1, 220B-1, and 220C-1 are installed in order from the top on the left side of the image forming apparatus 1, and they correspond to "1-A", "1-B", and "1-C" as the storage section information illustrated in FIGS. 14B and 15B. The storage sections 220A-2, 220B-2, and 220C-2 are installed in order from the top on the right side of the image forming apparatus 1, and they correspond to "2-A", "2-B", and "2-C" as the storage section information illustrated in FIGS. 14B and 15B. The storage section 16 is arranged in the lower portion of the image forming apparatus 1, and it corresponds to "3" as the storage section information illustrated in FIGS. 14B and 15B.

As described with reference to FIG. 4, the ejected sheet feeding path U2 reaches the sheet ejection section 5, without passing through the outside of the image forming apparatus 1. Therefore, in a space between the image forming apparatus 1 and the storage apparatus 200-1, more specifically, in a space between the exterior 12 of the image forming apparatus 1 and the exterior 210 of the storage apparatus 200-1, the cable 18A exists, but the sheet ejection section 5 and the ejected sheet feeding path U2 do not exist. Also, in a space between the image forming apparatus 1 and the storage apparatus 200-2, more specifically, in a space between the exterior 12 of the image forming apparatus 1 and the exterior 210 of the storage apparatus 200-2, the cable 18C exists, but the sheet ejection section 5 and the ejected sheet feeding path U2 do not exist. Therefore, the cable 18 is hardly affected by a user action of removing a copied sheet that has been ejected outside the image forming apparatus 1 or ejected toward the outside of the image forming apparatus 1. Further, when the cable 18 is laid out, it is unnecessary to take into consideration interference with a mechanism for ejecting sheets outside the image forming apparatus 1, whereby flexibility in the layout of the cable is increased.

Herein, a coupling configuration between the coupling section 17 of the image forming apparatus 1 and the coupling section 240 of the storage apparatus 200 will be described with reference to FIGS. 21 to 28.

Figure 21:
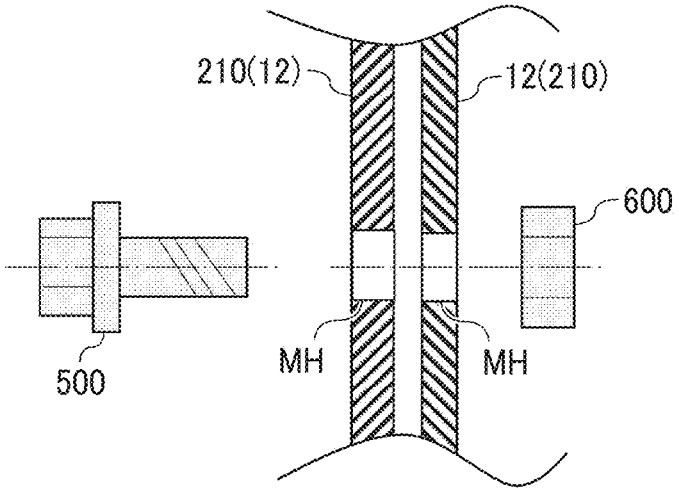
FIG. 21 illustrates a first example of a coupling configuration of a coupling section.

FIG. 21 illustrates a first example of a coupling configuration of the coupling section. An example of the securing coupling section is illustrated. The coupling section 17 and the coupling section 240 have holes for a screw 500 and a nut 600, i.e., screw holes MH, respectively, whereby the exterior 12 and the exterior 210 are secured to each other by a screw.

With the image forming apparatus 1 and the storage apparatus 200 screwed in the coupling section 17 and the coupling section 240, as described above, fall and a misalignment of installation positions can be prevented.

Figure 22:
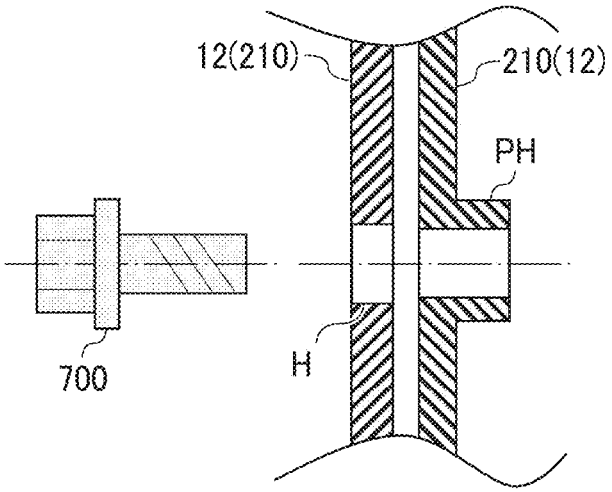
FIG. 22 illustrates a second example of a coupling configuration of a coupling section.

FIG. 22 illustrates a second example of a coupling configuration of the coupling section. Another example of the securing coupling section is illustrated. The coupling section 17 and the coupling section 240 have openings for a tapping screw 700, i.e., pilot holes PH for a tapping screw, respectively, whereby the exterior 12 and the exterior 210 are secured to each other by a tapping screw.

With the image forming apparatus 1 and the storage apparatus 200 screwed in the coupling section 17 and the coupling section 240, as described above, fall and a misalignment of installation positions can be prevented.

An example, in which the coupling configurations described with reference to FIGS. 21 and 22 are applied to the configuration described with reference to FIGS. 17A to 17C, will be described. In the configuration described with reference to FIGS. 17A to 17C, the coupling sections 17A and 17C are electrical coupling sections, and the coupling sections 17B and 17D are securing coupling sections, as desirable configurations in accordance with the position of the control board 15. Therefore, the securing coupling sections described with reference to FIGS. 21 and 22 can be applied to the coupling sections 17B and 17D in the configuration described with reference to FIGS. 17A to 17C.

Figure 23:
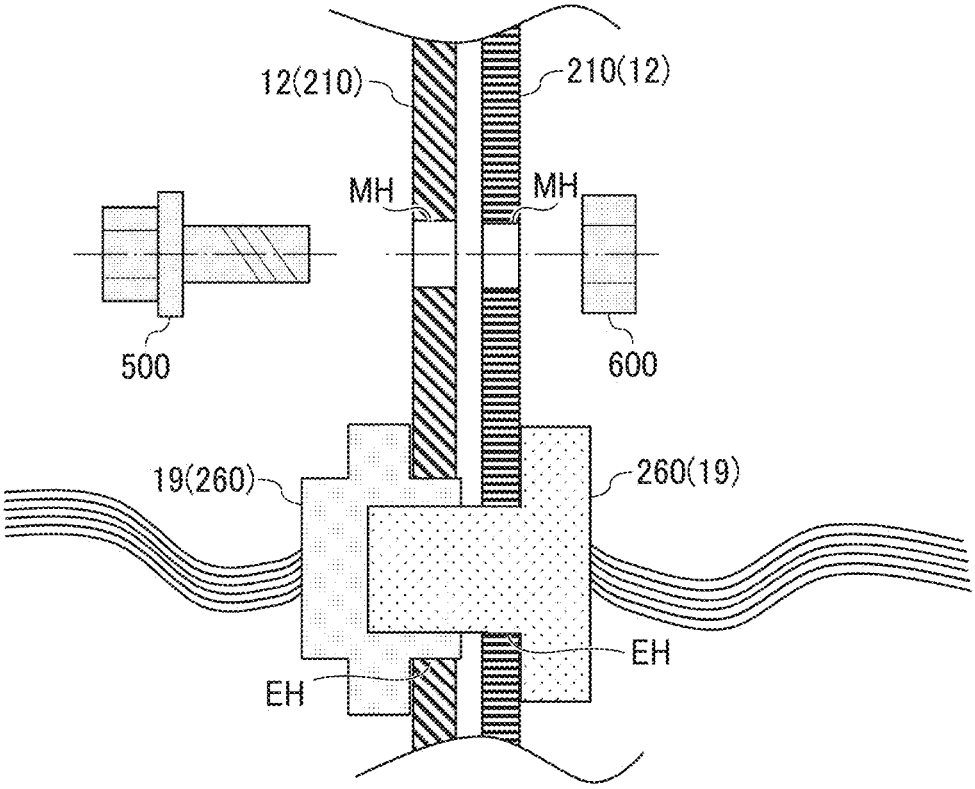
FIG. 23 illustrates a third example of a coupling configuration of a coupling section.

FIG. 23 illustrates a third example of a coupling configuration of the coupling section. An example of the coupling section, which is an electrical coupling section and a securing coupling section, is illustrated. A connector on the left side in FIG. 23 is a concave connector and a connector on the right side is a convex connector, and EH indicates an opening for the connector. The coupling section 17 and the coupling section 240 have holes for a screw 500 and a nut 600, i.e., screw holes MH, respectively, whereby the exterior 12 and the exterior 210 are secured to each other by a screw. By providing an opening for the electrical coupling and an opening for the securing coupling close to each other, as described above, for example, vibrations and the like, caused by a misalignment between the image forming apparatus 1 and the storage apparatus 200, are hardly transmitted to the electrical coupling section, whereby the electrical coupling is stabilized.

Figure 24:
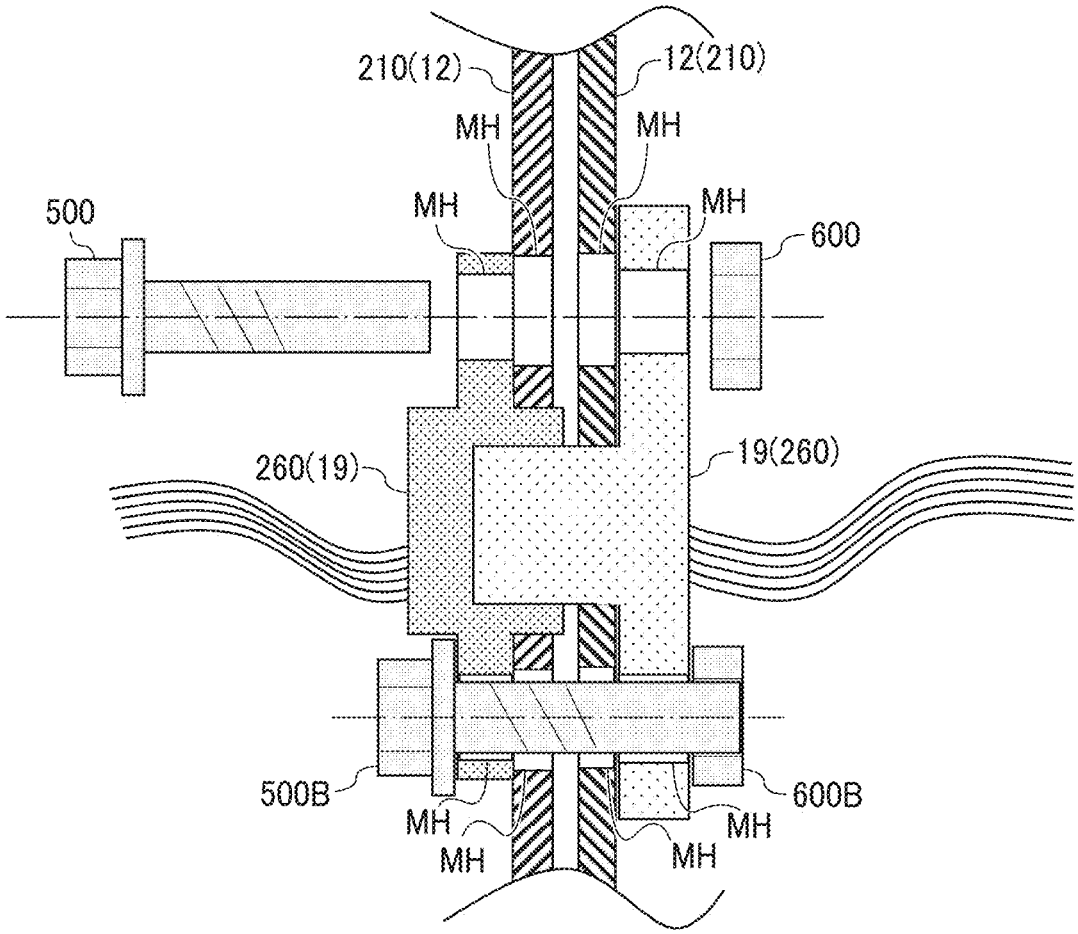
FIG. 24 illustrates a fourth example of a coupling configuration of a coupling section.

FIG. 24 illustrates a fourth example of a coupling configuration of the coupling section. An example of the coupling section, which is an electrical coupling section and a securing coupling section, is illustrated. In FIG. 24, each of a concave connector and a convex connector also has an opening MH, so that the whole connectors are screwed. By providing an opening for the electrical coupling and an opening for the securing coupling close to each other, as described above, for example, vibrations and the like, caused by a misalignment between the image forming apparatus 1 and the storage apparatus 200, are hardly transmitted to the electrical coupling section, whereby the electrical coupling is stabilized.

An example, in which the coupling configurations described with reference to FIGS. 23 and 24 are applied to the configuration described with reference to FIGS. 17A to 17C, will be described. In the configuration described with reference to FIGS. 17A to 17C, the coupling sections 17A and 17C are the electrical coupling sections, and the coupling sections 17B and 17D are the securing coupling sections, as desirable configurations in accordance with the position of the control board 15. Therefore, the coupling sections described with reference to FIGS. 23 and 24, each of which is an electrical coupling section and a securing coupling section, can be applied to the coupling sections 17A and 17C in the configuration described with reference to FIGS. 17A to 17C.

Herein, differences between the coupling in the region R1 in FIG. 20 and the couplings in the other regions R2 to R4 will be described. First, the image forming apparatus 1 has in advance an internal space section, a member that has a space for a predetermined purpose, in its inside. Examples of the internal space section include: the opening 10 having a space for putting in the footrest of a wheelchair; the storage section 16 having a space for storing an article and the like in its inside; and the jam handling section 8 having the paper jam handling space 85, a space for removing a sheet, which is for performing jam handling such as sheet removal, but they are not limited to these. On the other hand, the image forming apparatus 1 has, in its inside, an internal dense section that is a member not having a space for a predetermined purpose. An example of the internal dense section includes the image forming section 7. The storage apparatus 200 has the storage section 220 as the internal space section. Each of such an internal space section the image forming apparatus 1 has and such an internal space section the storage apparatus 200 has can be used as a space for configuring coupling or a space for coupling work where a user, or the like, forms coupling in the coupling section 17 and the coupling section 240.

In this case, there are internal space sections both on the image forming apparatus 1 side and on the storage apparatus 200 side, in the regions R2 to R4. Therefore, in the regions R2 to R4, the internal space sections on the image forming apparatus 1 side can also be used as a space for coupling work using a tool, etc., like the storage section 220 of the storage apparatus 200. On the other hand, in the region R1, the side of the image forming apparatus 1 is coupled in the coupling section 17C provided in a portion corresponding to the image forming section 7, the internal dense section. In this case, the image forming section 7, the internal dense section, does not have a large space in its inside, unlike the internal space section, and hence the space that can be used for coupling or coupling work is also small. Therefore, it is preferable, on the image forming apparatus 1 side, that a screw for the securing coupling and a connector for the electrical coupling are smaller. Hereinafter, a coupling configuration in this region R1 will be described.

Figure 25:
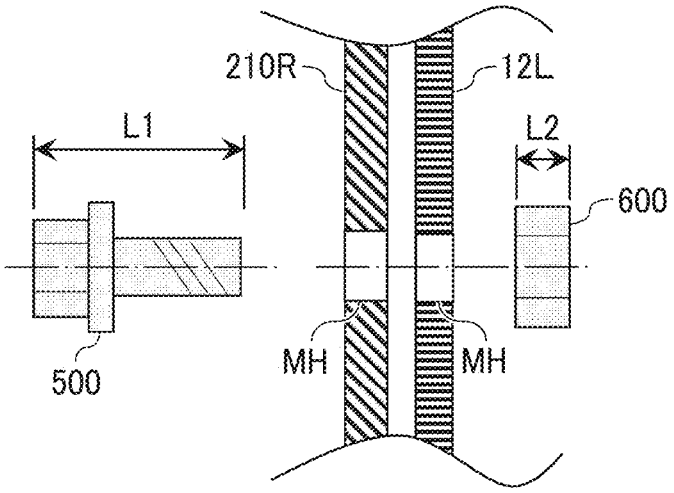
FIG. 25 illustrates a fifth example of a coupling configuration of a coupling section.

FIG. 25 illustrates a fifth example of a coupling configuration of the coupling section. An example of the securing coupling section in the region R1 is illustrated. The coupling section 17C and the coupling section 240C have holes for the screw 500 and the nut 600, i.e., screw holes MH, respectively, whereby the exterior 12 and the exterior 210 are secured to each other by a screw. A case, where a length (L1) of the screw 500 is larger than a length (L2) of the nut 600, is illustrated. This case shows a coupling configuration screwed from the storage apparatus 200 side, as illustrated in FIG. 25. Therefore, even if the internal space section on the image forming apparatus 1 side is the image forming section 7, the internal dense section, so that the internal space section on the image forming apparatus 1 side has a small coupling work space, a user can perform coupling work, such as screwing, from the storage apparatus 200 side by putting, into the storage apparatus 200 side having a coupling work space, the screw 500, a larger member than the nut 600, a tool for coupling, and the like.

Figure 26:
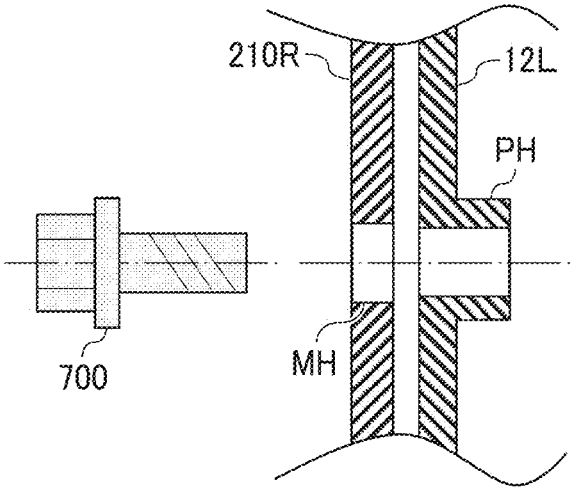
FIG. 26 illustrates a sixth example of a coupling configuration of a coupling section.

FIG. 26 illustrates a sixth example of a coupling configuration of the coupling section. An example of the securing coupling section in the region R1 is illustrated. The coupling section 17C and the coupling section 240C have openings for a tapping screw 700, i.e., pilot holes PH for a tapping screw, respectively, whereby the exterior 12 and the exterior 210 are secured to each other by a tapping screw. This case shows a coupling configuration screwed from the storage apparatus 200 side, as illustrated in FIG. 26. Therefore, even if the internal space section on the image forming apparatus 1 side has a small coupling work space because it is the image forming section 7, the internal dense section, a user can perform coupling work, such as screwing, from the storage apparatus 200 side by putting, into the storage apparatus 200 side having a coupling work space, a screw, a tool for coupling, and the like.

Figure 27:
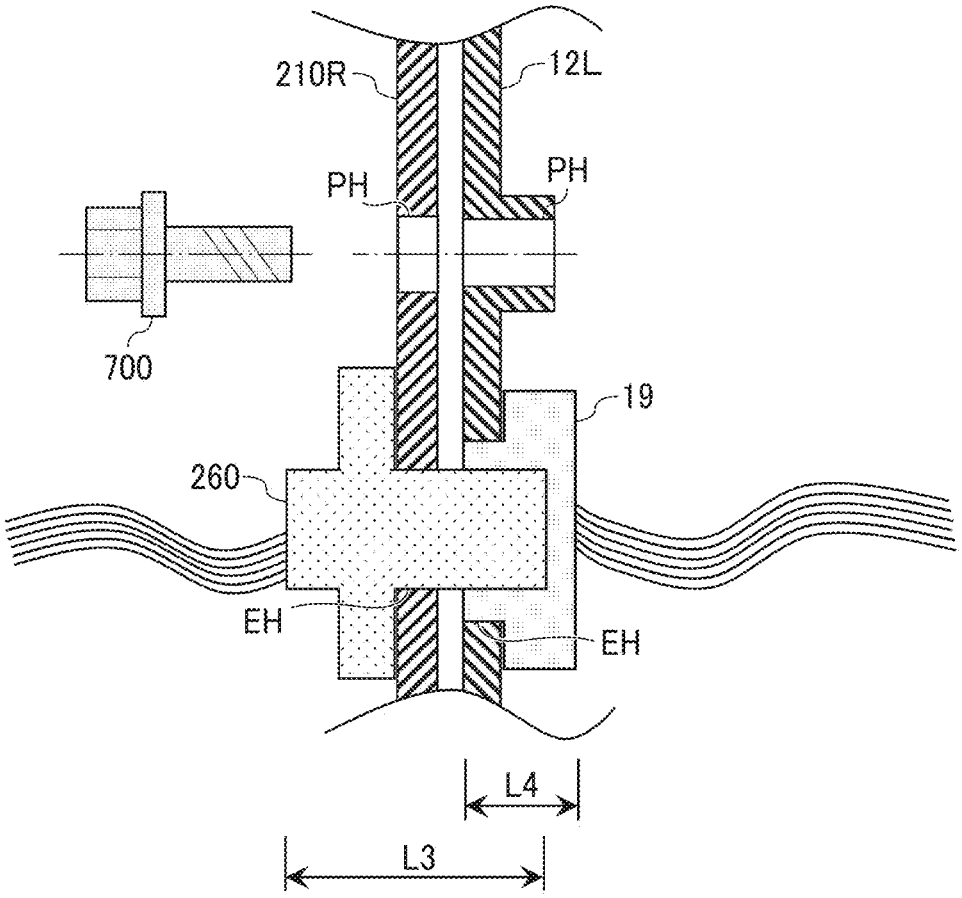
FIG. 27 illustrates a seventh example of a coupling configuration of a coupling section.

FIG. 27 illustrates a seventh example of a coupling configuration of the coupling section. An example of the coupling section in the region R1, which is an electrical coupling section and a securing coupling section, is illustrated. In FIG. 27, the connector section 260 on the storage apparatus 200 side is a convex connector, and the connector 19 on the image forming apparatus 1 side is a concave connector. A case, where a length (L3) of the convex connector is larger than a length (L4) of the concave connector, is illustrated. In this case, a configuration is formed, in which a connector having a relatively large shape, i.e., the convex connector is inserted from the storage apparatus 200 side, as illustrated in FIG. 27. Therefore, even if the internal space section on the image forming apparatus 1 side has a small coupling work space because it is the image forming section 7, the internal dense section, a user can perform coupling work by inserting a convex connector having a relatively large shape into the storage apparatus 200 side having a coupling work space. This case shows a coupling configuration screwed from the storage apparatus 200 side, as illustrated in FIG. 27. Therefore, even if the internal space section on the image forming apparatus 1 side has a small coupling work space because it is the image forming section 7, the internal dense section, a user can perform work, such as screwing, from the storage apparatus 200 side having a coupling work space.

Figure 28:
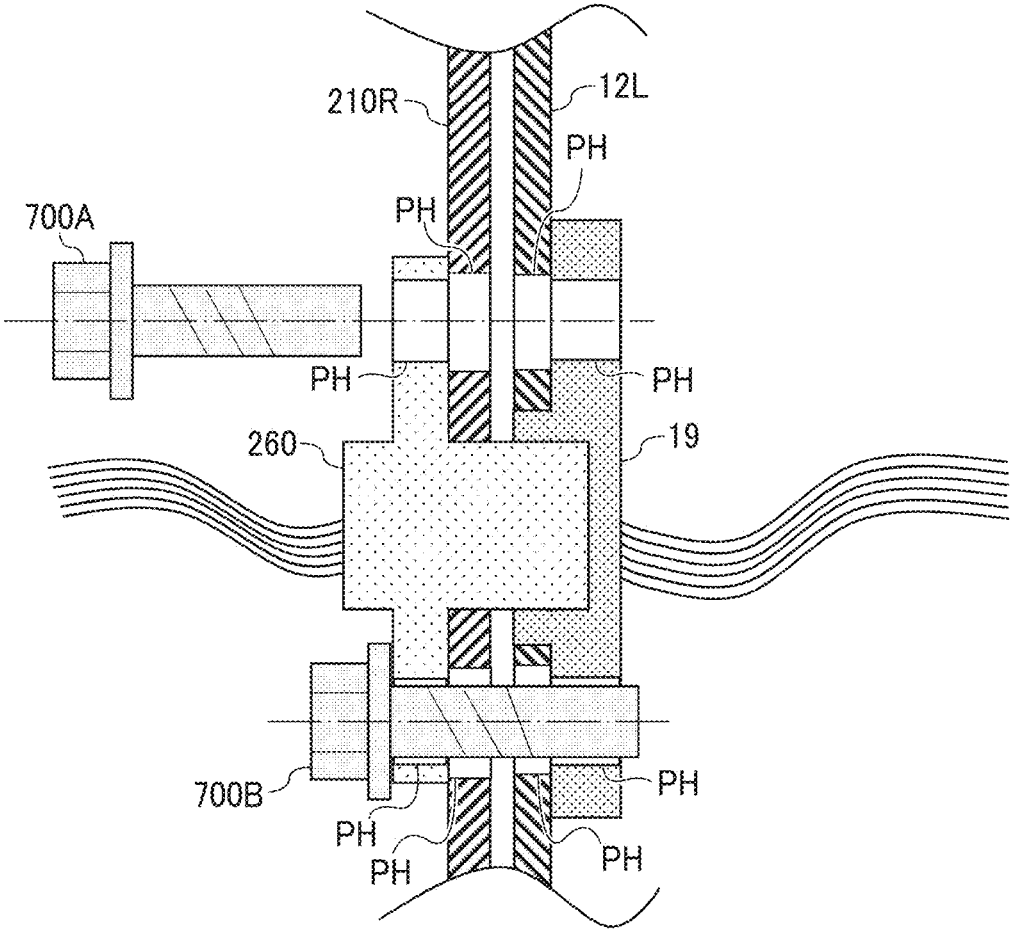
FIG. 28 illustrates an eighth example of a coupling configuration of a coupling section.

FIG. 28 illustrates an eighth example of a coupling configuration of the coupling section. An example of the coupling section, which is an electrical coupling section and a securing coupling section, is illustrated. In FIG. 28, a configuration is formed, in which the connector 19 that is a concave connector and a connector section 260 that is a convex connector also have openings PH, so that the whole connectors are screwed by tapping screws 700A and 700B. In this case, a configuration is formed, in which a connector having a relatively large shape, i.e., the convex connector is inserted from the storage apparatus 200 side, as illustrated in FIG. 27. Therefore, even if the internal space section on the image forming apparatus 1 side has a small coupling work space because it is the image forming section 7, the internal dense section, a user can perform coupling work by inserting a convex connector having a large shape from the storage apparatus 200 side having a coupling work space. This case shows a coupling configuration screwed from the storage apparatus 200 side, as illustrated in FIG. 27. Therefore, even if the internal space section on the image forming apparatus 1 side has a small coupling work space because it is the image forming section 7, the internal dense section, a user can perform work, such as screwing, from the storage apparatus 200 side having a coupling work space.

An example, in which the coupling configurations described with reference to FIGS. 27 and 28 are applied to the configuration described with reference to FIGS. 17A to 17C, will be described. In the configuration described with reference to FIGS. 17A to 17C, the coupling sections 17A and 17C are formed into electrical coupling sections, and the coupling sections 17B and 17D are formed into securing coupling sections, as desirable configurations in accordance with the position of the control board 15. In the configuration described with reference to FIGS. 17A to 17C, the coupling section facing the image forming section 7, the internal dense section, is 17C. Therefore, it is better that the coupling sections, each of which is an electrical coupling section and a securing coupling section, described with reference to FIGS. 27 and 28, are applied to the coupling section 17C in the configuration described with reference to FIGS. 17A to 17C.

Figure 29:
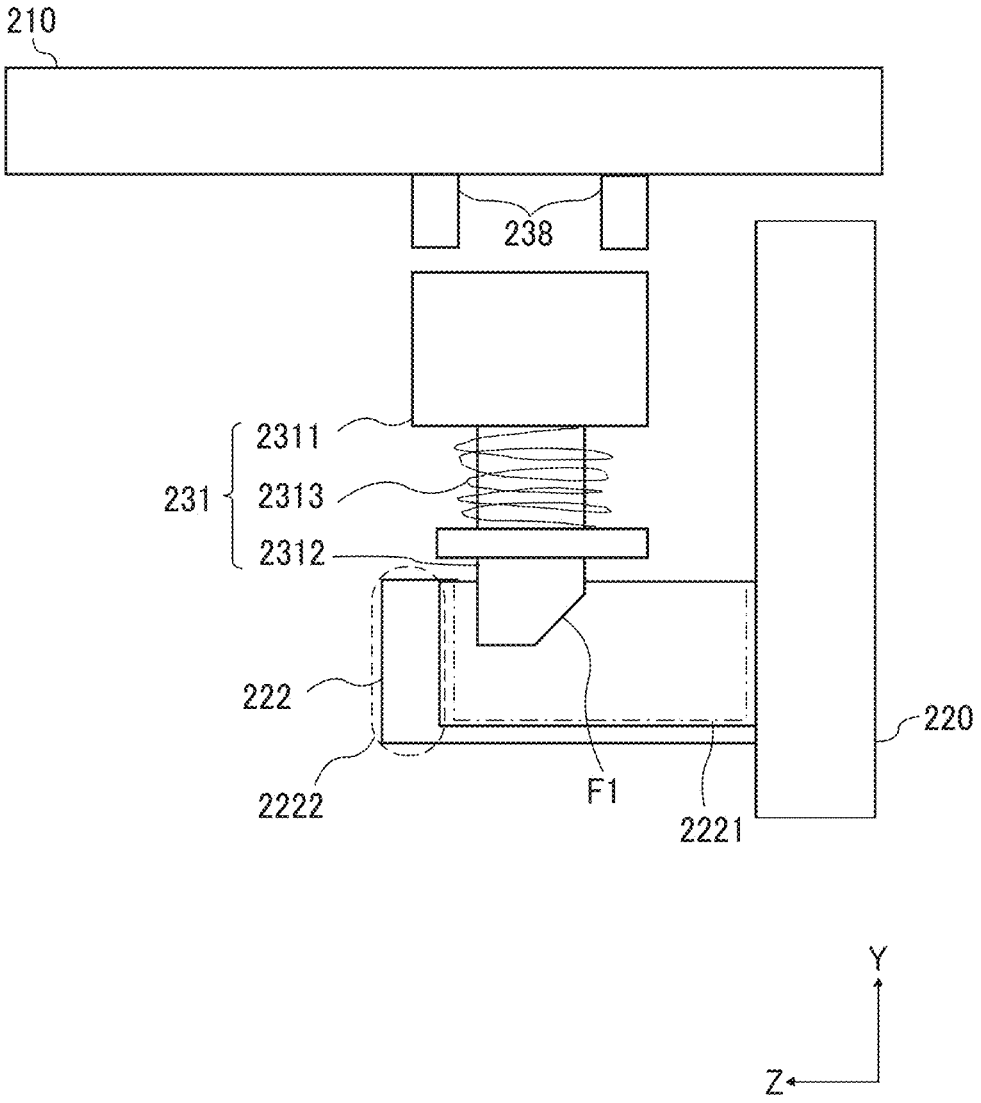
FIG. 29 is a fourth illustrative view illustrating the operation of the lock device.

FIG. 29 is a fourth illustrative view illustrating an operation of the lock device. The lock device 230 illustrated in FIG. 29 includes a sensor 238 that detects the iron core 2312, and the other configurations are the same as the configurations of FIG. 9. The sensor 238 is a light transmission type sensor including a light emitter and a light receiver, and it outputs a detection signal when the iron core 2312 is located in an area of the sensor 238. FIG. 29 illustrates a state of being locked, and the iron core 2312 is not located in the area of the sensor 238, and hence the sensor 238 does not output a detection signal.

Figure 30:
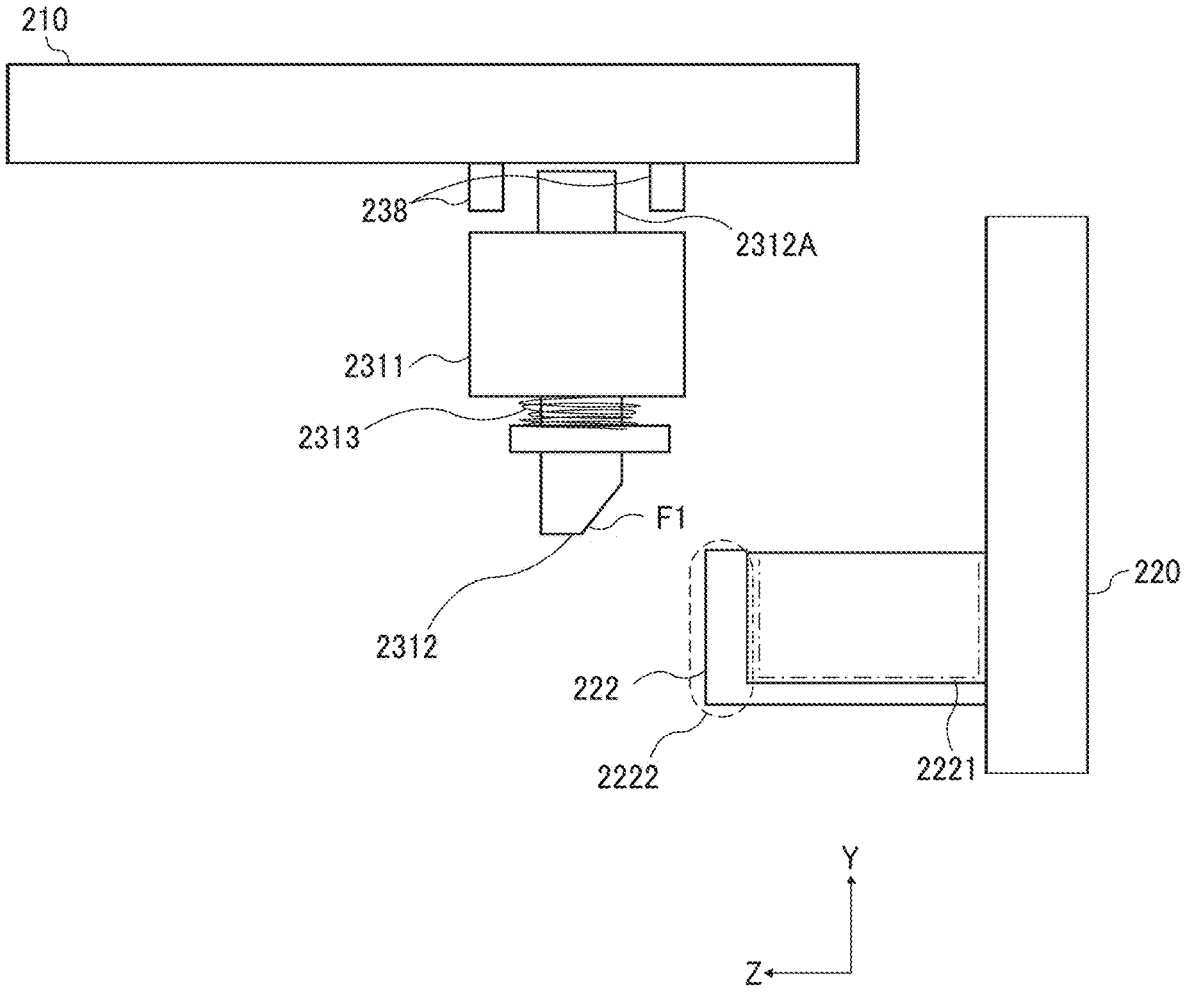
FIG. 30 is a fifth illustrative view illustrating the operation of the lock device.

FIG. 30 is a fifth illustrative view illustrating an operation of the lock device. The lock device 230 illustrated in FIG. 30 includes a sensor 238 that detects the iron core 2312, like FIG. 29, and the other configurations are the same as the configurations of FIG. 10. FIG. 30 illustrates a state of being unlocked, and a part 2312A of the iron core 2312 is located in the area of the sensor 238, and hence the sensor 238 outputs a detection signal.

Figure 31:
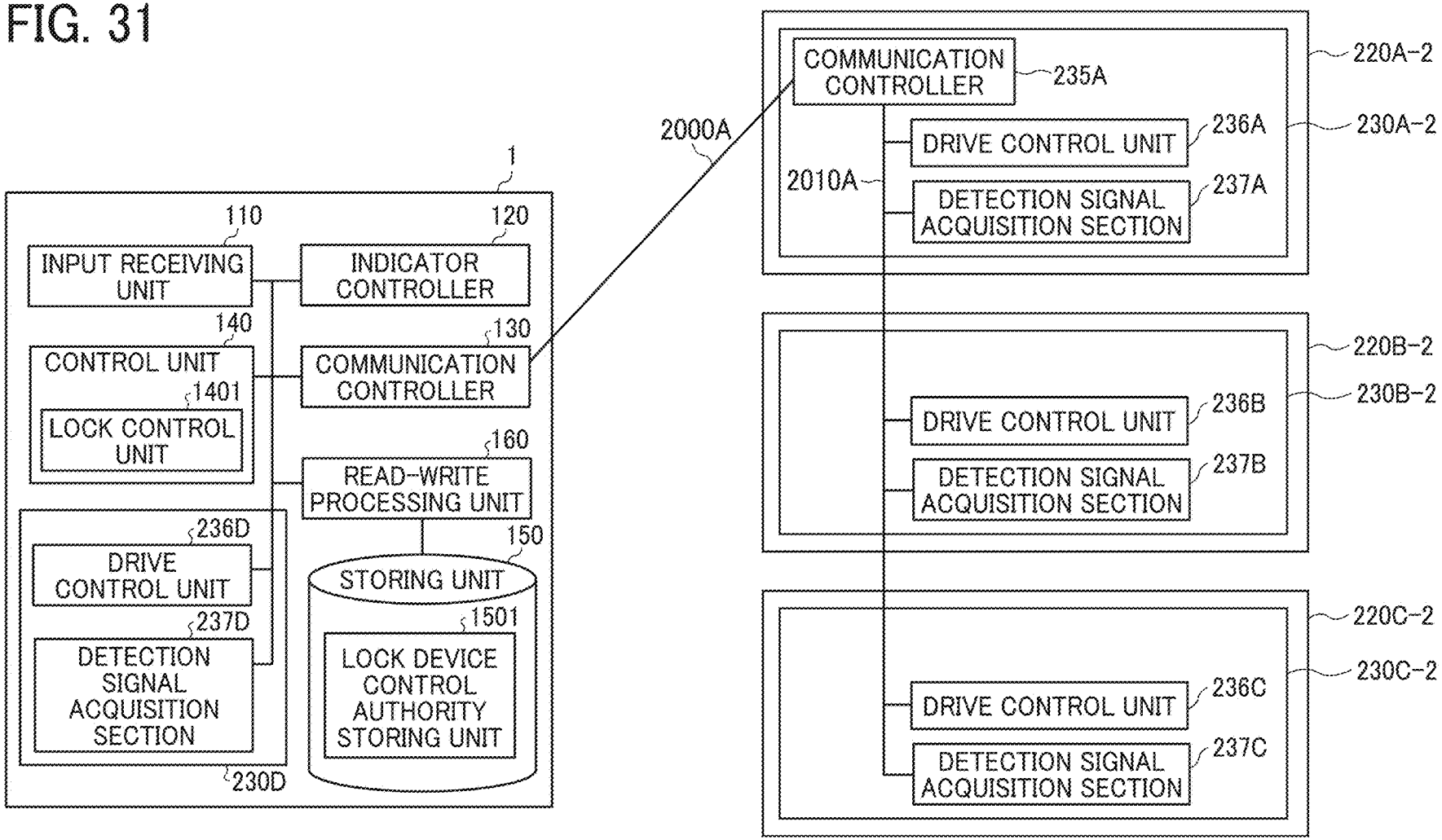
FIG. 31 is a functional block diagram of a lock system according to one embodiment of the present invention.

FIG. 31 is a functional block diagram of a lock system according to one embodiment of the present invention. The lock system corresponds to the usage state illustrated in FIG. 20, and includes the image forming apparatus 1 and the storage sections 220A-2, 220B-2, and 220C-2. The storage sections 220A-2, 220B-2, and 220C-2 correspond to "2-A", "2-B", and "2-C" as the storage section information illustrated in FIGS. 14B and 15B.

Illustration of the storage sections 220A-1, 220B-1, and 220C-1 (they correspond to "1-A", "1-B", and "1-C" as the storage section information illustrated in FIGS. 14B and 15B), which are illustrated in FIG. 20, are omitted, but the storage sections 220A-1, 220B-1, and 220C-1 are configured in the same way as the storage sections 220A-2, 220B-2, and 220C-2.

The image forming apparatus 1 has the input receiving unit 110, the indicator controller 120, the communication controller 130, the control unit 140, the storing unit 150, and the read-write processing unit 160, like the functional block diagram illustrated in FIG. 12. The control unit 140 includes the lock control unit 1401, and the storing unit 150 includes the lock device control authority storing unit 1501.

In addition to the functional block diagram illustrated in FIG. 12, the image forming apparatus 1 includes the lock device 230D that locks the storage section 16, and the lock device 230D includes a drive control unit 236D that controls power supply to the coil 2311 illustrated in FIGS. 29 and 30, and a detection signal acquisition section 237D implemented by the sensor 238 illustrated in FIGS. 29 and 30.

As described in step S4 and step S5 of FIG. 13, the lock control unit 1401 outputs an unlocking signal that designates the storage section 220 that is a target of unlocking, based on operation target information input to the input receiving unit 110 by a user.

The drive control unit 236D is implemented by CPU processing or the like and a drive circuit of the control board 15, and when receiving an unlocking signal output from the lock control unit 1401, the drive control unit 236D supplies power to the coil 2311, thereby creating an unlocked state, as illustrated in FIG. 30.

When the detection signal acquisition section 237D generates a detection signal of the sensor 238, the indicator controller 120 receives the detection signal to make a message reading "Released" displayed on the display screen of the operation panel 4, as illustrated in FIGS. 14D and 15D. When the image forming apparatus 1 does not include the storage section 16 and the lock device 230D, the indicator controller 120 does not make the button "3" illustrated in FIGS. 14B and 15B displayed on the operation panel 4.

The storage sections 220A-2, 220B-2, and 220C-2 include the lock devices 230A-2, 230B-2, and 230C-2 that lock the storage sections 220A-1, 220B-1, and 220C-1, respectively, and the lock device 230A-2 includes a communication controller 235A.

The lock devices 230A-2, 230B-2, and 230C-2 further include the drive control units 236A, 236B, and 236C that control power supply to the coil 2311 illustrated in FIGS. 29 and 30, and the detection signal acquisition sections 237A, 237B, and 237C implemented by the sensor 238 illustrated in FIGS. 29 and 30, respectively. The communication controller 235A, the drive control units 236A, 236B, and 236C, and the detection signal acquisition sections 237A, 237B, and 237C are coupled by signal lines 2010A.

The communication controller 235A is implemented by CPU processing of the control board, and executes a function to control a communication interface with the image forming apparatus 1. The communication controller 235A is coupled to the communication controller 130 of the image forming apparatus 1 by a signal line 2000A.

The communication controller 235A transmits, to the communication controller 130 of the image forming apparatus 1, a storage section identification signal that identifies whether the storage sections 220A-2, 220B-2, and 220C-2 are coupled, and an arrangement identification signal that identifies which positions the storage sections 220A-2, 220B-2, and 220C-2 are arranged at.

When receiving the storage section identification signal via the communication controller 130, the indicator controller 120 makes, of the buttons "2-A", "2-B", and "2-C" illustrated in FIGS. 14B and 15B, a button, corresponding to the storage section identification signal, displayed on the operation panel 4 in an arrangement corresponding to the arrangement identification signal. For example, when receiving, from the storage section 220A-2, the storage section identification signal and the arrangement identification signal indicating upper right, the indicator controller 120 makes the button "2-A" displayed in an upper right portion on the operation panel 4. The indicator controller 120 does not make a button for a storage section, the storage section identification signal for which has not been received, displayed on the operation panel 4.

When the lock control unit 1401 outputs an unlocking signal that designates any one of the storage sections 220A-1, 220B-1, and 220C-1, the communication controller 130 transmits an unlocking signal corresponding to the designated storage section to the communication controller 235A.

The drive control units 236A, 236B, and 236C are implemented by CPU processing, etc., and drive circuits, respectively, and when receiving an unlocking signal output from the lock control unit 1401 via the communication controller 235A, the drive control units 236A, 236B, and 236C supply power to the coil 2311, thereby creating an unlocked state, as illustrated in FIG. 30.

When the detection signal acquisition section 237A, 237B, or 237C generates a detection signal of the sensor 238, the communication controller 235A receives the detection signal and transmits the detection signal to the communication controller 130.

When receiving the detection signal output from the detection signal acquisition section 237A, 237B, or 237C via the communication controller 130, the indicator controller 120 makes a message reading "Released" displayed on the display screen of the operation panel 4, as illustrated FIGS. 14D and 15D.

Figure 32:
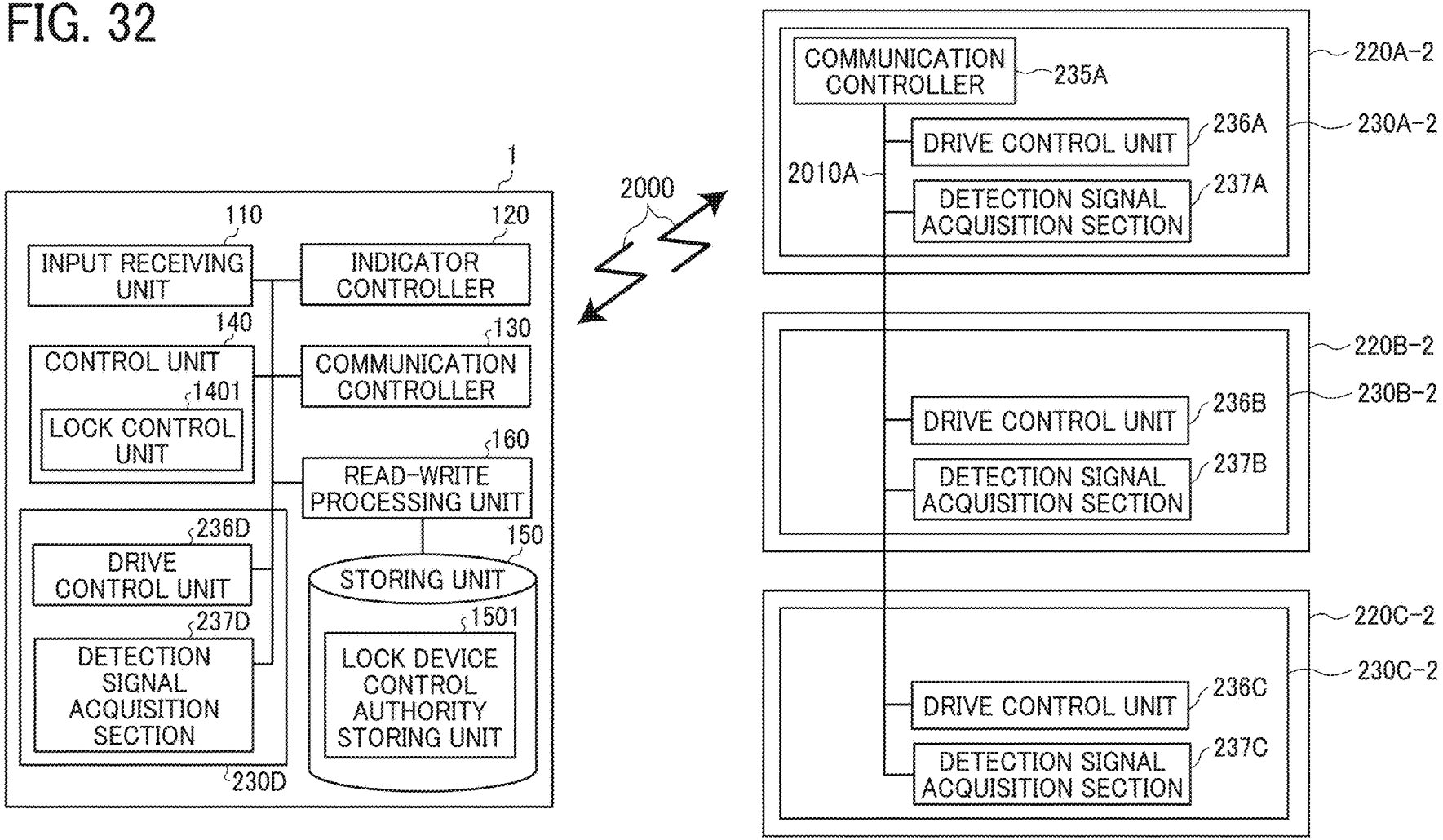
FIG. 32 illustrates a variation of the functional block diagram illustrated in FIG. 31.

FIG. 32 illustrates a variation of the functional block diagram illustrated in FIG. 31. In the variation illustrated in FIG. 32, the communication controller 235A is coupled to the communication controller 130 of the image forming apparatus 1 by two-way wireless communication 2000. The others are the same as in FIG. 31.

Figure 33:
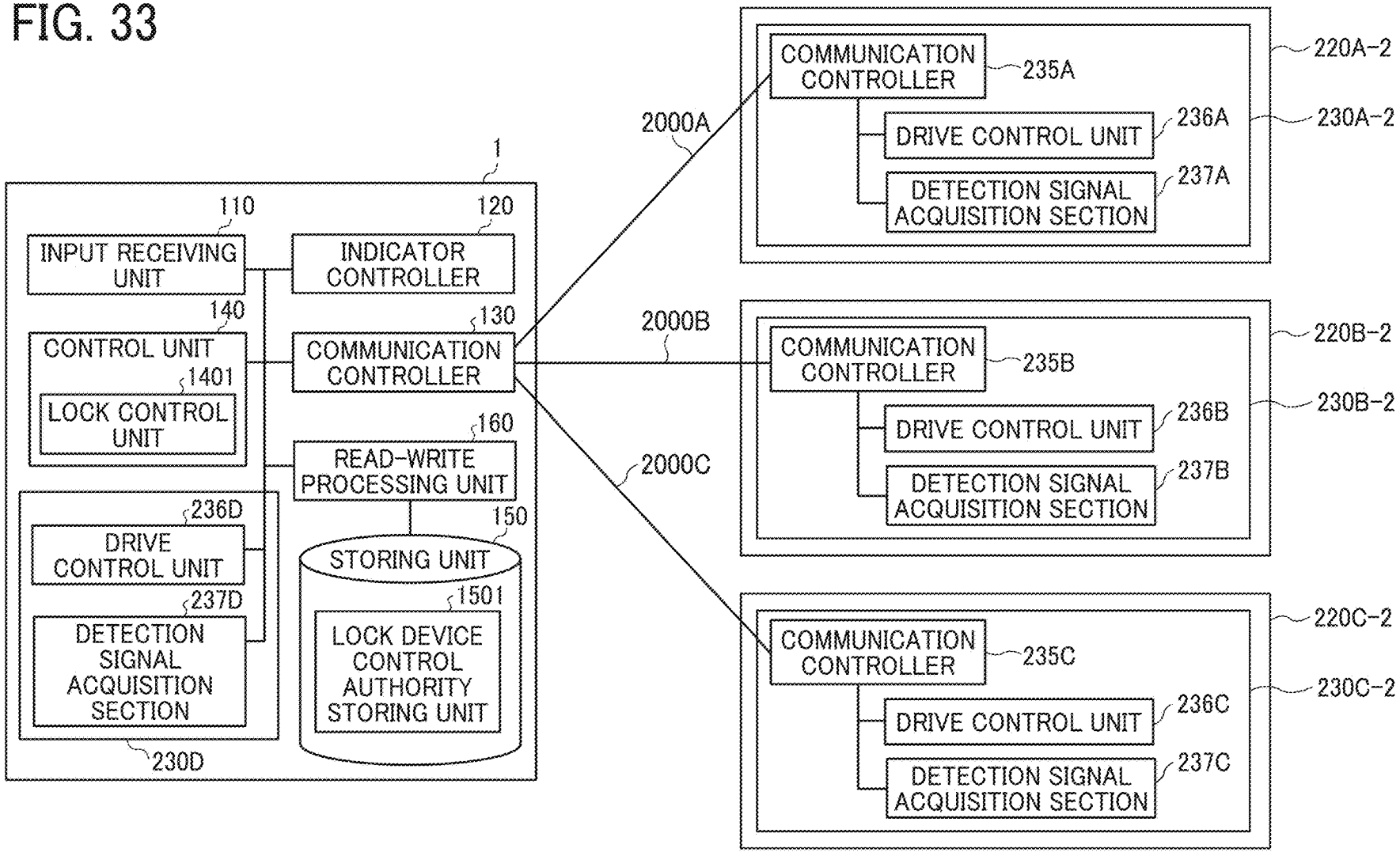
FIG. 33 illustrates another variation of the functional block diagram illustrated in FIG. 31.

FIG. 33 illustrates another variation of the functional block diagram illustrated in FIG. 31. In the variation illustrated in FIG. 33, the lock devices 230B-2 and 230C-2 include communication controllers 235B and 235C, respectively.

The communication controllers 235B and 235C are implemented by CPU processing of the control board, and execute a function to control a communication interface with the image forming apparatus 1, respectively. The communication controllers 235B and 235C are coupled to the communication controller 130 of the image forming apparatus 1 by signal lines 2000B and 2000C, respectively.

The communication controller 235A, 235B, and 235C transmit, to the communication controller 130 of the image forming apparatus 1, a storage section identification signal that identifies any one of the storage sections 220A-2, 220B-2, and 220C-2, and an arrangement identification signal that identifies which positions the storage sections 220A-2, 220B-2, and 220C-2 are arranged at, respectively.

When the lock control unit 1401 outputs an unlocking signal that designates any one of the storage sections 220A-1, 220B-1, and 220C-1, the communication controller 130 transmits the unlocking signal to the communication controller corresponding to, of the communication controllers 235A, 235B, and 235C, the designated storage section. The others are the same as in FIG. 31.

Figure 34:
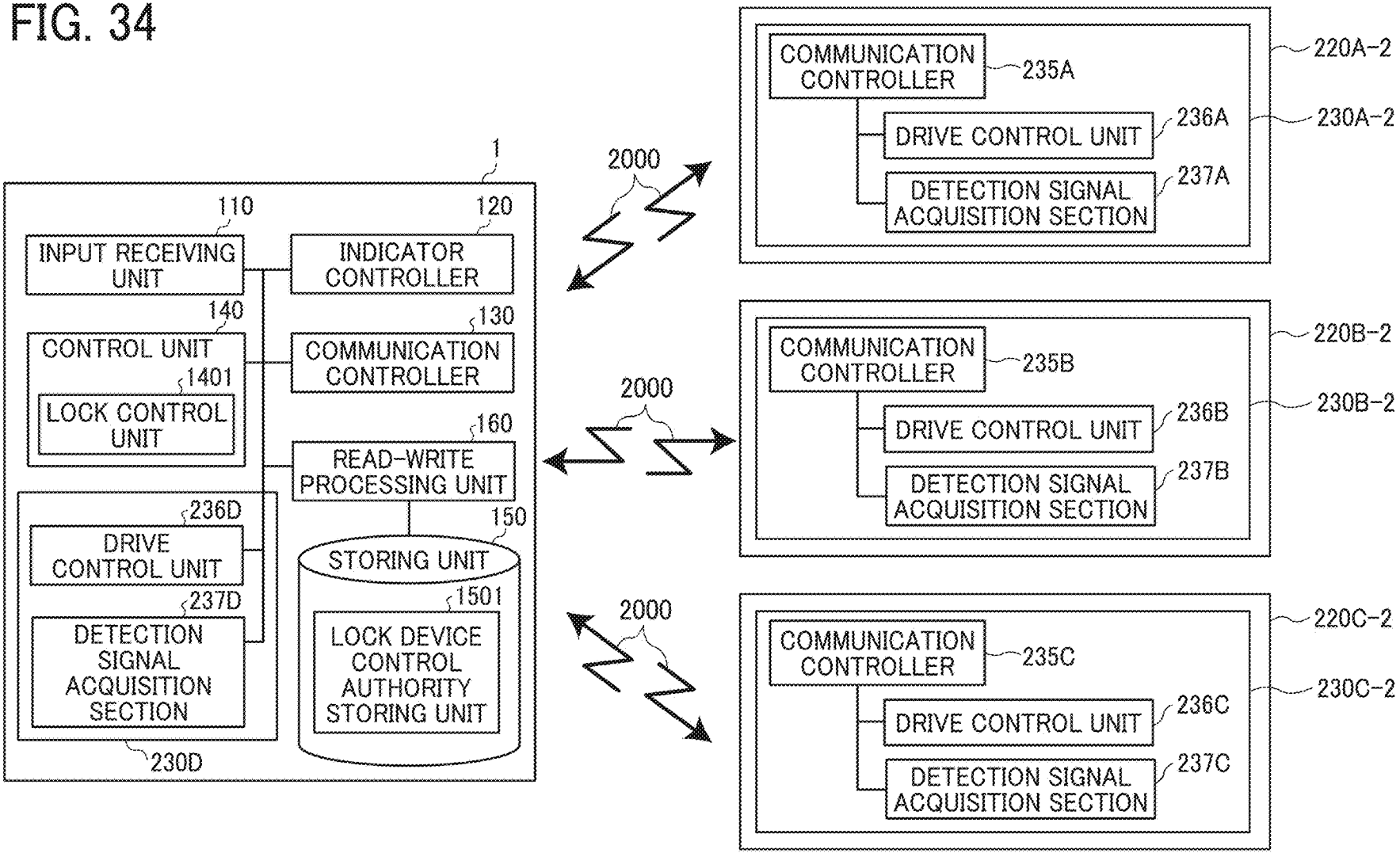
FIG. 34 illustrates a variation of the functional block diagram illustrated in FIG. 33.

FIG. 34 illustrates a variation of the functional block diagram illustrated in FIG. 33. In the variation illustrated in FIG. 34, the communication controllers 235A, 235B, and 235C are coupled to the communication controller 130 of the image forming apparatus 1 by two-way wireless communication 2000, respectively. The others are the same as in FIG. 33.

Figure 35:
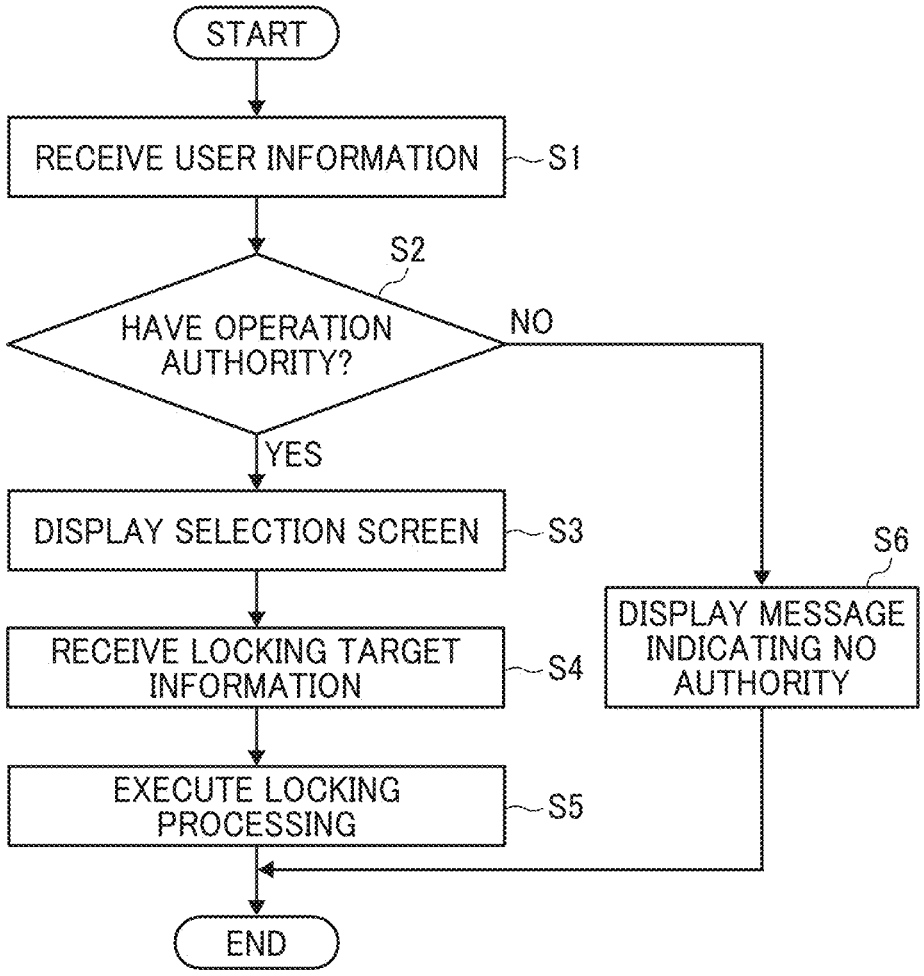
FIG. 35 is a second flowchart illustrating the lock device control processing.

FIG. 35 is a second flowchart illustrating the lock device control processing. In the flowchart illustrated in FIG. 13, the processing related to unlocking are performed, but in the flowchart illustrated in FIG. 35, processing related to locking are performed.

First, the input receiving unit 110 receives user information (S1). Then, the lock control unit 1401 determines based on the input user information whether a user has operation authority to the lock device by referring to the lock device control authority table in the lock device control authority storing unit 1501 (S2).

When it is determined that the user has authority (YES) in step S2, the indicator controller 120 makes candidates for the storage section 220, a target of locking, displayed on the operation panel 4 (S3). The input receiving unit 110 receives operation target information input by the user, as an example, information by which the storage section 220, a target of locking, can be identified (S4). When the number of the storage sections to be controlled by the lock control unit 1401 is one, step S4 may be omitted.

Then, the lock control unit 1401 executes operation processing of the storage section 220 that is the input operation target (S5), whereby the processing flow ends. An example of the operation processing is the end of power supply to the coil 2311, as described with reference to FIG. 10, but it is not limited to this.

On the other hand, when it is determined that the user does not have authority (NO) in step S2, the indicator controller 120 makes a message, reading that the user does not have locking authority, displayed on the operation panel 4 (S6), whereby the processing flow ends.

FIG. 36 illustrates a third example of the screen transitions displayed on the image forming apparatus.

Figure 36A:
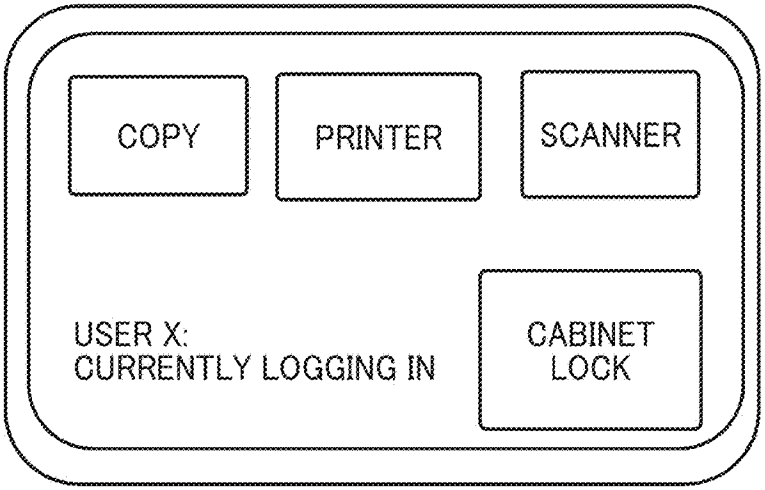
FIGS. 36A to 36D illustrate a third example of the screen transitions displayed on the image forming apparatus.

A screen illustrated in FIG. 36A is an initial screen (home screen) displayed on the operation panel 4 of the image forming apparatus 1. Buttons labeled with "copy", "printer", "scanner", and "cabinet lock", functions that can be executed in the image forming apparatus 1, are displayed, so that a user can select a function, which the user wants to execute in the image forming apparatus 1, by pushing a button labeled with the function. A user is logging in to the image forming apparatus 1 by inputting a password from the operation panel 4 or by making the card reader 14 read an ID card, and the user currently logging in is displayed on the screen of FIG. 36A as "User X: Currently logging in." A user who wants to unlock any one of the storage sections 220 selects the button labeled with "cabinet lock" in FIG. 36A.

Figure 36B:
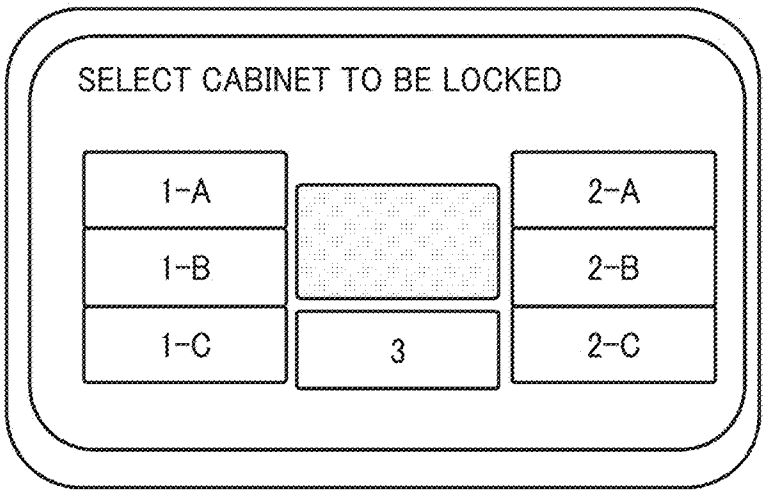

FIG. 36B illustrates a screen displayed when the button labeled with "cabinet lock" is selected in FIG. 36A. As candidates for the cabinet to be locked, seven types of buttons of "1-A", "1-B", "1-C", "3", "2-A", "2-B", and "2-C" are displayed on the screen of FIG. 36B. As an example, "1-A", "1-B", and "1-C" represent the three storage sections 220 of the storage apparatus 200, which are installed in order from the top on the left side of the image forming apparatus 1. "3" represents the storage section 16 in the lower portion of the image forming apparatus 1. "2-A", "2-B", and "2-C" represent the three storage sections 220 of the storage apparatus 200, which are installed in order from the top on the right side of the image forming apparatus 1. In FIG. 36B, a user selects a button labeled with a cabinet that the user wants to lock.

The image forming apparatus 1 may be configured such that in FIG. 36B, the storage apparatus 200, the lock device 230 of which a user has operation authority to, is only displayed based on the user information on the user currently logging in, and the storage apparatus 200, the lock device 230 of which a user does not have operation authority to, is not displayed. Or, the image forming apparatus 1 may be configured such that in FIG. 36B, the storage apparatus 200, the lock device 230 of which a user does not have operation authority to, is displayed based on the user information on the user currently logging in, but it cannot be selected.

Alternatively, the image forming apparatus may be configured such that after the button labeled with "cabinet lock" is pushed in FIG. 36A, the image forming apparatus 1 determines, based on the user information on the user currently logging in, whether the user has operation authority to the lock device 230, and when the user does not have the authority, it is displayed on the operation panel 4 that the user does not have the authority.

Figure 36C:
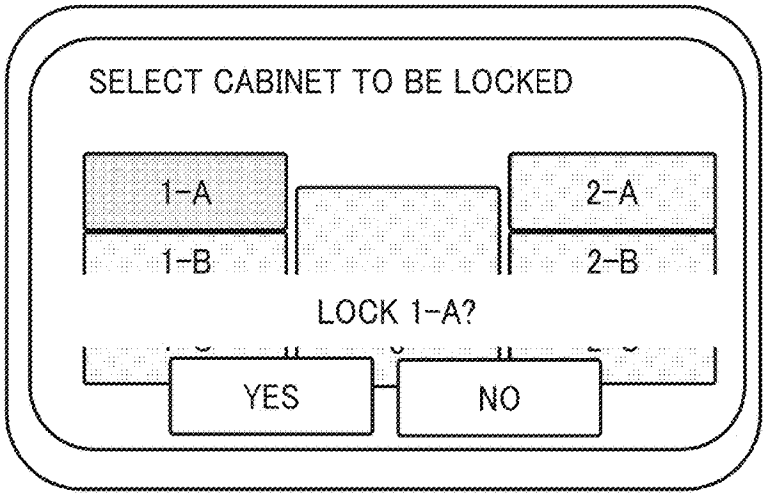

FIG. 36C illustrates a screen displayed when the button labeled with "1-A" is selected in FIG. 36B. The screen of FIG. 36C indicates that "1-A" selected as a target of locking is displayed in a darker color than the other candidates. And, "1-A to be locked?", "Yes", and "No" are displayed as confirmation messages. When the target of locking is right, a user selects "Yes."

Figure 36D:
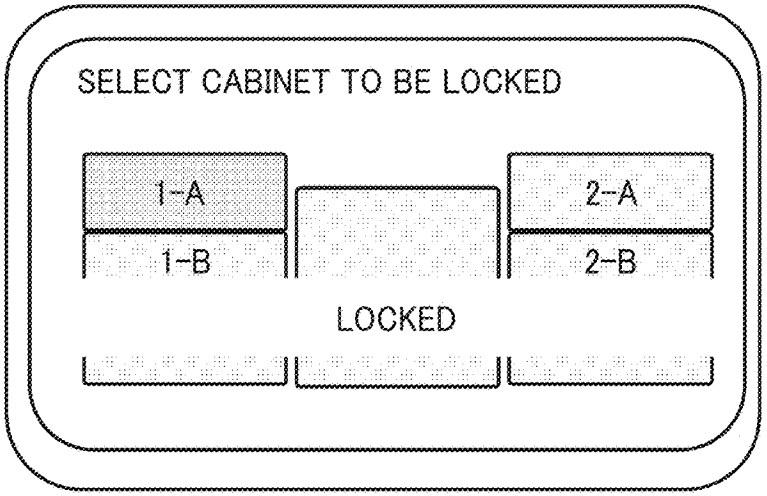

FIG. 36D illustrates a screen displayed when the button labeled with "Yes" is selected in FIG. 36C. In FIG. 36D, a message reading "Locked" is displayed as a message indicating an operation state of the lock device 230. When this message is displayed, a user can confirm that the target of locking has been locked.

These display contents of FIGS. 36A to 36D and switching of the display are controlled by the indicator controller 120.

Although respective embodiments of the present invention have been described in detail above, the present invention is not limited to such specific embodiments, and various modifications and changes can be made within the scope of the gist of the present invention described in the claims.

As described above, the image forming apparatus 1 according to one embodiment of the present invention includes the image forming section 7 that forms an image on a target and a lock control device. The lock control device controls a plurality of the lock devices (230A-1, 230B-1, 230C-1, 230A-2, 230B-2, 230C-2, and 230D) respectively provided in a plurality of the storage sections (220A-1, 220B-1, 220C-1, 220A-2, 220B-2, 220C-2, and 16), and includes: the indicator controller 120 that makes a plurality of pieces of storage section information ("1-A", "1-B", "1-C", "3", "2-A", "2-B", and "2-C"), which indicate the storage sections, displayed on the operation panel 4 (an example of the indicator), the input receiving unit 110 that receives an input of, of the plurality of piece of storage section information, partial storage section information (e.g., "1-A"), and the lock control unit 1401 (an example of the unlock control unit) that outputs an unlocking signal for unlocking a lock device to the partial lock device corresponding to the partial storage section information that the input receiving unit has received.

Thereby, a user can easily unlock, of the plurality of the storage sections, an arbitrary storage section by selecting it, whereby user convenience is improved.

Further, the indicator controller 120 makes the plurality of pieces of storage section information displayed on the operation panel 4 so as to indicate the arrangement of the plurality of the storage sections.

Thereby, a user can unlock a storage section, which the user wants to unlock, by selecting the storage section after confirming the arrangement of the storage section on the operation panel 4, and hence a fear that a storage section may be erroneously selected as the storage section the user wants to unlock is reduced, whereby user convenience is improved.

The input receiving unit 110 further receives an input of user information that authenticates a user, and the indicator controller 120 makes a plurality of pieces of storage section information, corresponding to the user information that the input receiving unit 110 has received, displayed on the operation panel 4.

Thereby, a user can unlock a storage section, which the user can unlock by himself or herself, by selecting the storage section after confirming it on the operation panel 4, whereby user convenience is improved.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A lock control device configured to control a plurality of lock devices, respectively provided in a plurality of storage sections, the lock control device comprising:

control circuitry configured to:

cause an indicator to visually indicate a plurality of pieces of storage section information representing the plurality of storage sections;

receive an input of partial storage section information of the plurality of pieces of storage section information; and output an unlocking signal, to a lock device of the plurality of lock devices corresponding to the partial storage section information received, to unlock the lock device, wherein the control circuitry is configured to cause the indicator to visually indicate relative positions of the plurality of storage sections, within an image forming section, so as to visually convey a representative positional arrangement of relative locations of the plurality of storage sections.

2. The lock control device of claim 1, wherein the control circuitry is configured to receive an input of user information to authenticate a user, wherein the control circuitry is configured to cause the indicator to indicate a piece of storage section information, of the plurality of pieces of storage section information, corresponding to the user information received.

3. An image forming apparatus comprising:

an image forming section configured to form an image on a target; and the lock control device of claim 1.

4. A lock control method for controlling a plurality of lock devices respectively provided in a plurality of storage sections, the lock control method comprising:

causing an indicator to visually indicate a plurality of pieces of storage section information representing the plurality of storage sections;

receiving an input of partial storage section information of the plurality of pieces of storage section information; and outputting an unlocking signal, to a lock device of the plurality of lock devices corresponding to the partial storage section information received, to unlock the lock device, wherein the causing of the indicator to visually indicate the plurality of pieces of storage section information causes the indicator to visually indicate relative positions of the plurality of storage sections, within an image forming section, so as to visually convey a representative positional arrangement of relative locations of the plurality of storage sections.

5. A lock system comprising:

a plurality of storage sections including a plurality of lock devices, respectively; and an image forming apparatus configured to form an image on a target, the image forming apparatus including:

an indicator; and control circuitry configured to:

cause the indicator to visually indicate a plurality of pieces of storage section information representing the plurality of storage sections;

receive an input of partial storage section information of the plurality of pieces of storage section information; and output an unlocking signal, to a lock device of the plurality of lock devices corresponding to the partial storage section information received, to unlock the lock device, wherein the control circuitry is configured to cause the indicator to visually indicate relative positions of the plurality of storage sections, within an image forming section, so as to visually convey a representative positional arrangement of relative locations of the plurality of storage sections.

6. An image forming apparatus configured to form an image, the image forming apparatus comprising:

an operating device configured to receive a user operation, the user operation received including partial storage section information of a plurality of pieces of storage section information representing a plurality of storage sections; and control circuitry configured to perform locking control and unlocking control on a lock device of an external apparatus, based on the partial storage section information received by the operating device, wherein the control circuitry is configured to cause an indicator to visually indicate relative positions of the plurality of storage sections to the user, within an image forming section, so as to visually convey a representative positional arrangement, of relative locations of the plurality of storage sections, to the user.

7. The lock control method of claim 4, further comprising:

receiving an input of user information to authenticate a user, wherein the causing includes causing the indicator to indicate a piece of storage section information, of the plurality of pieces of storage section information, corresponding to the user information received.

8. The locking system of claim 5, wherein the control circuitry is configured to receive an input of user information to authenticate a user, and wherein the control circuitry is configured to cause the indicator to indicate a piece of storage section information, of the plurality of pieces of storage section information, corresponding to the user information received.

9. The image forming apparatus of claim 6, wherein the control circuitry is configured to receive an input of user information to authenticate a user, wherein the control circuitry is configured to cause the indicator to indicate a piece of storage section information, of the plurality of pieces of storage section information, corresponding to the user information received.

* * * * *